US009825375B2

(12) United States Patent
Naganishi et al.

(10) Patent No.: US 9,825,375 B2
(45) Date of Patent: Nov. 21, 2017

(54) CONNECTION STRUCTURE FOR TERMINAL FITTING, CONNECTION METHOD FOR TERMINAL FITTING, AND WIRE HARNESS

(71) Applicant: YAZAKI CORPORATION, Tokyo (JP)

(72) Inventors: Yukinari Naganishi, Makinohara (JP); Kousuke Kinoshita, Makinohara (JP); Takatatsu Yamamoto, Makinohara (JP); Keiichi Mita, Makinohara (JP); Tomoyasu Terada, Makinohara (JP); Takehiko Uehara, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/468,318

(22) Filed: Mar. 24, 2017

(65) Prior Publication Data

US 2017/0194722 A1 Jul. 6, 2017

Related U.S. Application Data

(63) Continuation of application No. PCT/JP2015/077178, filed on Sep. 25, 2015.

(30) Foreign Application Priority Data

Sep. 25, 2014 (JP) ..... 2014-195658
Apr. 24, 2015 (JP) ..... 2015-089848
(Continued)

(51) Int. Cl.
*H01R 4/18* (2006.01)
*H01R 43/048* (2006.01)

(52) U.S. Cl.
CPC ..... *H01R 4/186* (2013.01); *H01R 4/185* (2013.01); *H01R 43/048* (2013.01)

(58) Field of Classification Search
CPC ..... H01R 4/20; H01R 4/185; H01R 4/184
See application file for complete search history.

(56) References Cited

U.S. PATENT DOCUMENTS 4,371,230 A * 2/1983 Inoue ..... H01R 11/12 439/849
4,583,069 A * 4/1986 Pierce ..... H01H 85/201 174/84 C
(Continued)

FOREIGN PATENT DOCUMENTS

JP 46-14129 5/1971
JP 56-41469 4/1981
(Continued)

OTHER PUBLICATIONS

Written Opinion dated Dec. 8, 2015 issued by International Searching Authority in counterpart International Application No. PCT/JP2015/077178 (PCT/ISA/237).
(Continued)

*Primary Examiner* — Ross Gushi
(74) *Attorney, Agent, or Firm* — Sughrue Mion, PLLC

(57) ABSTRACT

The present invention relates to a connection structure for a terminal fitting (1010). The connection structure includes a terminal fitting (1010) including a terminal body (1011) to be fastened and fixed to a grounding surface and a plurality of terminal connecting portions (1021) extended from the terminal body; and a junction terminal (1030) electrically connected to ground wire (D) and electrically connected to the terminal connecting portions (1021). This connection
(Continued)

structure enables a plurality of ground wires to be electrically connected all together to a grounding surface in a space-saving manner.

11 Claims, 75 Drawing Sheets

(30) Foreign Application Priority Data

Apr. 24, 2015 (JP) ..... 2015-089849
Apr. 24, 2015 (JP) ..... 2015-089850
Apr. 24, 2015 (JP) ..... 2015-089851

(56) References Cited

U.S. PATENT DOCUMENTS 4,745,239 A * 5/1988 Conrad ..... H01R 4/186 174/71 R
5,486,653 A * 1/1996 Dohi ..... H01R 43/058 174/84 C
5,733,152 A * 3/1998 Freitag ..... H01R 11/281 439/762
5,800,219 A * 9/1998 Siedlik ..... H01R 11/287 439/762
6,501,025 B2 * 12/2002 Tilli ..... F02M 37/10 123/516
6,960,723 B2 * 11/2005 Fujii ..... H01R 11/32 174/84 C
7,125,295 B2 * 10/2006 Zhao ..... H01R 11/12 439/287
7,252,564 B1 * 8/2007 Morello ..... H01R 4/185 439/843
7,402,751 B2 * 7/2008 Haberman ..... H01R 4/184 174/84 C
7,550,671 B2 * 6/2009 Haberman ..... H01R 4/184 174/84 C
8,100,730 B2 * 1/2012 Hara ..... H01R 4/64 439/721
8,105,103 B2 * 1/2012 Nishio ..... H01R 4/305 439/287
8,303,351 B2 * 11/2012 Taguchi ..... H01H 85/22 439/620.26
8,366,499 B2 * 2/2013 Shuey ..... H01R 11/07 439/883
9,083,094 B2 * 7/2015 Teramoto ..... H01R 4/64
9,153,880 B2 * 10/2015 Omori ..... H01R 4/64
9,211,852 B2 * 12/2015 Omori ..... H01R 4/64
9,252,527 B2 * 2/2016 Aizawa ..... B60R 16/02
9,300,093 B2 * 3/2016 Omori ..... H01R 4/64
9,362,665 B2 * 6/2016 Omori ..... H01R 4/64
2012/0318575 A1 * 12/2012 Koto ..... H01R 4/72 174/84 C
2014/0206244 A1 7/2014 Kato
2015/0079825 A1 3/2015 Miyamoto et al.
2015/0188244 A1 * 7/2015 Yoshioka ..... H01M 2/20 439/442
2017/0155200 A1 * 6/2017 Yamamoto ..... H01R 4/04
2017/0155202 A1 * 6/2017 Yamamoto ..... H01R 11/09
2017/0155220 A1 * 6/2017 Uehara ..... H01R 25/003

FOREIGN PATENT DOCUMENTS

JP 1-107878 U 7/1989
JP 2001-298824 A 10/2001
JP 2003-178824 A 6/2003
JP 2004-206965 A 7/2004
JP 2005-035331 A 2/2005
JP 2006-049069 A 2/2006
JP 2012-190749 A 10/2012
JP 2013-73741 A 4/2013
JP 2014-60093 A 4/2014
WO 2013/137429 A1 9/2013

OTHER PUBLICATIONS

Office Action dated May 9, 2017 issued by the Japanese Patent Office in counterpart Japanese Patent Application No. 2015-089848.
Office Action dated May 9, 2017 issued by the Japanese Patent Office in counterpart Japanese Patent Application No. 2015-089851.
Communication dated Jun. 6, 2017, from the Japanese Patent Office in counterpart application No. 2015-089850.
Communication dated Jun. 6, 2017, from the Japanese Patent Office in counterpart application No. 2015-089849.
International Search Report (PCT/ISA/210) dated Dec. 8, 2015 issued by the International Searching Authority in counterpart International Application No. PCT/JP2015/077178.
Written Opinion (PCT/ISA/237) dated Dec. 8, 2015 issued by the International Searching Authority in counterpart International Application No. PCT/JP2015/077178.

* cited by examiner

CONNECTION STRUCTURE FOR TERMINAL FITTING, CONNECTION METHOD FOR TERMINAL FITTING, AND WIRE HARNESS

CROSS-REFERENCES TO RELATED APPLICATION(S)

This application is based on and claims priority from Japanese Patent Application No. 2014-195658 filed on Sep. 25, 2014, Japanese Patent Application No. 2015-089848 filed on Apr. 24, 2015, Japanese Patent Application No. 2015-089849 filed on Apr. 24, 2015, Japanese Patent Application No. 2015-089850 filed on Apr. 24, 2015, Japanese Patent Application No. 2015-089851 filed on Apr. 24, 2015, and the entire contents of which are incorporated herein by reference.

BACKGROUND

Field of the Invention

The present invention relates to a connection structure for a terminal fitting, a connection method for a terminal fitting, and a wire harness.

Description of Related Art

A connection structure for connecting a plurality of terminal fittings to a grounding position all together has been conventionally proposed. For example, a connection structure in which a plurality of terminal fittings each having a wire crimping portion to which a ground wire is crimped are stacked, and a bolt is inserted through bolt holes of these stacked terminal fittings to fix the terminal fittings all together in a predetermined position on a vehicle with the bolt, so that the ground wires can be electrically connected to a grounding position (i.e., the predetermined position on the vehicle) via the terminal fittings is known.

As for details of the above connection structure, refer to JP 2005-353331 A and JP 2012-190749 A.

SUMMARY

In the above-described connection structure, since the terminal fittings respectively connected to the ground wires are stacked and fastened with the bolt, there arises a problem in which the weight is increased as well as cost is increased as the number of ground wires is increased, and in addition, the fastened fittings are liable to be loosened. Besides, as the number of ground wires is increased, the thickness of the stacked terminal fittings is increased, and hence, it is necessary to provide, above the grounding surface, a large space for holding these terminal fittings.

On the other hand, another connection structure in which a plurality of ground wires are bundled and conductor portions of these ground wires are thermally welded to one terminal fitting may be employed. In employing such thermal welding, however, it is necessary to expose the conductor portions from the sheaths of the plural ground wires at their ends, and to line up the tips of the conductor portions. Hence, it is very complicated and difficult to perform this operation.

As still another connection structure, a joint connector configured to be inserted with connection terminals each connected to a ground wire into a housing holding a joint terminal therein so that a plurality of connection terminals can be held in the housing and electrically connected all together through the joint terminal may be used. In using this joint connector, however, it is necessary to provide a holding mechanism for holding the connection terminals inside the housing. As a result, it is difficult to make the housing compact, and cost is unavoidably increased due to the housing including the holding mechanism.

In addition, when fastening with a bolt is employed, if the bolt is loosened, connection reliability may be degraded after the connection in some cases. In such a case, if a connection terminal is fastened to a terminal fitting by crimping, a firm connection structure can be obtained. In the crimping performed using a crimping machine, however, mutual positions cannot be stabilized, and hence, it is apprehended that the crimping strength may be varied.

In consideration of the aforementioned problem, an object of the invention is to provide a connection structure for a terminal fitting, a connection method for a terminal fitting, and a wire harness capable of connecting a plurality of ground wires all together to a grounding surface in a space-saving manner.

In order to achieve the above-described object, the connection structures for a terminal fitting according to the present invention are characterized by the following items (1) to (8):

(1) A connection structure for a terminal fitting, the connection structure comprising:

a terminal fitting including: a terminal body to be fastened and fixed to a grounding surface; and a plurality of terminal connecting portions extended from the terminal body; and a junction terminal electrically connected to a ground wire and electrically connected to the terminal connecting portion, the junction terminal having a pair of crimping pieces, the pair of crimping pieces being crimped on the terminal connecting portion in such a manner to externally roll up both sides of the terminal connecting portion without crimping the ground wire, and thus fastening the junction terminal to the terminal fitting to connect the terminal fitting to the ground wire via the junction terminal.

(2) The connection structure for a terminal fitting according to item (1), wherein a plurality of ground wires are electrically connected to the junction terminal.

(3) The connection structure for a terminal fitting according to item (1), wherein the terminal connecting portion has engagement walls extended from both sides of the terminal connecting portion to rise on a plane on which the terminal connecting portion is extended from the terminal body, and the crimping piece is crimped to engage with the engagement walls.

(4) The connection structure for a terminal fitting according to item (3), wherein the engagement wall has an engaging piece formed by folding an upper end of the engagement wall inward.

(5) The connection structure for a terminal fitting according to item (1), wherein the junction terminal defines a holding space surrounded by the crimping pieces, and side surfaces of the crimping pieces facing the holding space serve as rotation restricting surfaces to restrict rotation of the terminal connecting portion around an axis along an inserting direction into the holding space by contacting with both sides of the terminal connecting portion inserted into the holding space.

(6) The connection structure for a terminal fitting according to item (5), wherein a bottom of the holding space is curved to be swollen downward.

(7) The connection structure for a terminal fitting according to item (1), wherein the terminal connecting portions are extended radially on a same plane.

(8) The connection structure for a terminal fitting according to item (1), wherein the terminal connecting portions are extended on a same plane in a same direction to have a space between each other.

According to the connection structure for a terminal fitting configured as (1) described above, the junction terminals electrically connected to the ground wires are electrically connected to the plural terminal connecting portions of the terminal fitting having the terminal body fastened and fixed to the grounding surface. Thus, a plurality of ground wires can be grounded all together to, for example, a small number of grounding surfaces in a body of a vehicle. Besides, as compared with a structure in which terminal fittings connected to respective ground wires are stacked to be fastened to a grounding surface for electrical connection, since there is no need to stack terminal fittings, even if the number of ground wires is increased, increase in weight of the terminal fitting can be suppressed, so as to reduce cost through reduction of materials. Besides, since there is no need to stack terminal fittings, even if the number of ground wires to be electrically connected is increased, the thickness of the terminal fitting is not increased, and hence the space can be saved. In addition, the terminal fitting can be definitely fastened to the grounding surface, and the fastening can be inhibited from loosening thereafter.

Furthermore, since a plurality of ground wires are grounded by connecting a plurality of junction terminals to the terminal connecting portions of the terminal fitting in this structure, differently from the structure exemplified above (the structure in which conductor portions of a plurality of ground wires are directly connected to one terminal fitting by the thermal welding or the like), there is no need to line up and bundle the conductor portions of the ground wires so as not to be loosened. As a result, wiring workability can be greatly improved.

Additionally, According to the connection structure for a terminal fitting configured as (1) described above, when the crimping pieces of the connection terminals connected to the wires are crimped to the plural terminal connecting portions of the terminal fitting, the connection terminals can be fastened to the terminal fitting for electrically connecting the plural wires all together to the terminal fitting. Thus, as compared with the structure in which terminal fittings connected to respective ground wires are stacked to be fastened for electrical connection, since there is no need to stack terminal fittings, even if the number of wires is increased, increase in weight of the terminal fitting can be suppressed. Besides, since there is no need to stack terminal fittings, even if the number of wires to be electrically connected is increased, the thickness of the terminal fitting is not increased, and hence the space can be saved.

Besides, since the connection terminals are fastened to the terminal connecting portions of the terminal fitting, there is no need to provide a special holding mechanism for holding the connection terminals. Thus, as compared with a joint connector that needs to have a holding mechanism for holding a terminal in a housing, the size and the cost can be reduced.

Besides, the connection terminal separately provided is fastened and connected to the terminal fitting in this structure, and as a result, the connection terminals connected to wires of different sizes can be fastened to be electrically connected to the terminal connecting portions. In other words, this structure is applicable to wires of various sizes without changing the connection form between the terminal connecting portion of the terminal fitting and the fastening connecting portion of the connection terminal. Besides, if terminal fittings having different numbers of terminal connecting portions are prepared, the structure can easily deal with increase/decrease of the number of wires to be electrically connected. As a result, change in the number or the size of wires to be electrically connected can be dealt with by minimum variations of the terminal fitting.

In addition, since the connection terminals are fastened to the plural terminal connecting portions of the terminal fitting in this structure, the connection terminals can be fastened to the terminal connecting portions as needed, and as a result, the number of wires to be electrically connected all together can be easily increased/decreased within the limit of the number of the terminal connecting portions.

According to the connection structure for a terminal fitting configured as (2) described above, the number of ground wires to be grounded all together to the grounding surface via the terminal fitting can be easily and largely increased by electrically connecting a plurality of ground wires to the junction terminals.

According to the connection structure for a terminal fitting configured as (3) described above, the crimping pieces are engaged with the engagement walls of the terminal connecting portion by crimping the crimping pieces of the connection terminal to the terminal connecting portion. Thus, the crimping pieces are definitely crimped to the terminal connecting portion, so as to further increase connection strength of the terminal connecting portion to the connection terminal, and electrical resistance in the connection portion can be stabilized to attain good electrical connection.

According to the connection structure for a terminal fitting configured as (4) described above, since the engaging pieces folded inward are formed at the upper ends of the engagement walls of the terminal connecting portion, the crimping pieces can be definitely crimped to the terminal connecting portion so as to further increase engagement force with the crimping pieces of the connection terminal. As a result, high connection strength can be definitely obtained. Thus, the electrical resistance in the connection portion can be stabilized to attain good electrical connection.

According to the connection structure for a terminal fitting configured as (5) described above, the terminal connecting portion inserted into the holding space is held in the junction terminal with its rotation around an axis along the inserting direction restricted by the rotation restricting surfaces corresponding to the side surfaces of the holding space. Thus, the terminal connecting portion can be kept in a stable position against the junction terminal, so as to increase fastening accuracy. As a result, variation in crimping strength can be suppressed to obtain high connection reliability.

According to the connection structure for a terminal fitting configured as (6) described above, the terminal connecting portion inserted in the holding space is kept in a stable state on the downward curved bottom of the holding space. Thus, the terminal connecting portion can be kept in a more stable position against the junction terminal, so as to increase the fastening accuracy.

According to the connection structure for a terminal fitting configured as (7) described above, the terminal connecting portions are extended radially on the same plane, and as a result, with the area occupied by the terminal fitting suppressed to be as small as possible, a large number of terminal connecting portions can be provided. Accordingly, a large number of ground wires can be connected all together.

According to the connection structure for a terminal fitting configured as (8) described above, directions for connecting the connection terminals to the terminal fitting can be the same, and hence, the workability in fastening the connection terminals to the terminal connecting portions of the terminal fitting can be improved. Besides, the wiring directions of the wires can be aligned in the same direction along a trunk line. In addition, unwanted spread of the wires and bending of the wires in the vicinity of the connection terminals can be minimized.

Besides, to achieve the above-described object, the connection methods for a terminal fitting according to the present invention are characterized by the following items (9) and (10):

(9) A connection method for a terminal fitting, the method being to connect the terminal fitting including a terminal body and a plurality of terminal connecting portions extended from the terminal body with a junction terminal connected to a ground wire by crimping a pair of crimping pieces formed in the junction terminal to the terminal connecting portion, the method comprising:

a first step of forming a holding space in the junction terminal by using the crimping pieces to allow the terminal connecting portion to be inserted into the holding space;

a second step of holding the terminal connecting portion with the junction terminal by inserting the terminal connecting portion into the holding spaces; and a third step of crimping the crimping piece in such a manner to externally roll up both sides of the terminal connecting portion located in the holding space.

(10) The connection method for a terminal fitting according to item (9), wherein the ground wire is electrically connected to the junction terminal before the second step.

According to the connection method for a terminal fitting configured as (9) described above, the terminal connecting portion is inserted into and held in the holding space precedently formed in the junction terminal, and the crimping pieces are squashed and crimped so as to externally roll up the both sides of the terminal connecting portion held in the holding space, and thus, the fastening can be performed with the position of the terminal connecting portion against the junction terminal stabilized. Thus, the workability can be improved, and the variation in the crimping strength can be suppressed to obtain high connection reliability.

Furthermore, since the holding space is precedently formed in the junction terminal, as compared with, for example, crimping pieces formed in the shape of U spreading upward, the width can be suppressed. Thus, in using a crimping machine for the fastening, components such as a crimper can be made compact to reduce the working space.

According to the connection structure for a terminal fitting configured as (10) described above, for example, when the junction terminal having been electrically connected to a plurality of ground wires bundled as a sub harness is connected to each terminal connecting portion of the terminal fitting, the ground wires can be very easily electrically connected to the grounding surface. Thus, other wires different from the ground wires can be easily bundled, resulting in improving a prior fitting ratio and increasing wiring efficiency.

In addition, In order to achieve the above-described object, the wire harness according to the present invention is characterized by the following item (11):

(11) A wire harness comprising the connection structure for a terminal fitting according to item (1).

According to the wire harness configured as (11) described above, for example, when the junction terminal having been electrically connected to the ground wires bundled as a sub harness is connected to each terminal connecting portion of the terminal fitting, the ground wires can be very easily electrically connected to the grounding surface. Thus, other wires different from the ground wires can be easily bundled, resulting in improving a prior fitting ratio and increasing wiring efficiency.

According to the present invention, a connection structure for a terminal fitting, a connection method for a terminal fitting, and a wire harness capable of electrically connecting a plurality of ground wires all together to a grounding surface in a space-saving manner can be provided.

The present invention has been briefly described so far. The details of the present invention will be clearly understood by reading embodiments for practicing the present invention (hereinafter simply referred to as the "embodiments") described below with reference to the accompanying drawings.

BRIEF DESCRIPTION OF THE DRAWINGS

FIGS. 1A and 1B are diagrams explaining a connection structure for a terminal fitting according to Embodiment 1-1, in which FIG. 1A is a perspective view of a terminal fitting connected to a ground wire, and FIG. 1B is a plan view of the terminal fitting connected to the ground wire.

FIGS. 3A to 3C are diagrams explaining the connection structure for a terminal fitting according to Embodiment 1-1, in which FIG. 3A is a view taken on arrow A of FIG. 1A, FIG. 3B is a view taken on arrow B of FIG. 1A, and FIG. 3C is a view taken on arrow C of FIG. 1A.

FIGS. 5A and 5B are diagrams explaining a procedure for connecting the ground wire to the terminal fitting, in which FIG. 5A is a schematic plan view of the junction terminal connected to the ground wire, and FIG. 5B is a schematic plan view of the terminal fitting and the junction terminal.

FIGS. 7A and 7B are diagrams explaining a connection structure for a terminal fitting according to Embodiment 2-1, in which FIG. 7A is a perspective view of a terminal fitting connected to a ground wire, and FIG. 7B is a plan view of the terminal fitting connected to the ground wire.

FIGS. 9A to 9C are diagrams explaining the connection structure for a terminal fitting according to Embodiment 2-1, in which FIG. 9A is a view taken on arrow A of FIG. 7A, FIG. 9B is a view taken on arrow B of FIG. 7A, and FIG. 9C is a view taken on arrow C of FIG. 7A.

FIGS. 13A to 13C are diagrams explaining the junction terminal, in which FIG. 13A is a cross-sectional view taken on line D-D of FIG. 12, FIG. 13B is a cross-sectional view taken on line E-E of FIG. 12, and FIG. 13C is a cross-sectional view taken on line F-F of FIG. 12.

FIGS. 15A to 15C are diagrams illustrating fastening states of calking pieces of a fastening connecting portion to the terminal connecting portion of the terminal fitting, in which FIG. 15A is a cross-sectional view taken on line G-G of FIG. 7B before fastening with the crimping pieces, FIG. 15B is a cross-sectional view taken on line G-G of FIG. 7B during the fastening with the calking pieces, and FIG. 15C is a cross-sectional view taken on line G-G of FIG. 7B after the fastening with the crimping pieces.

FIGS. 17A and 17B are diagrams illustrating fastening states between a terminal connecting portion of a terminal fitting and crimping pieces of a fastening connecting portion according to Reference Example 2-1, in which FIG. 17A is a cross-sectional view taken on line G-G of FIG. 7B before fastening with the crimping pieces, and FIG. 17B is a cross-sectional view taken on line G-G of FIG. 7B after the fastening with the crimping pieces.

FIGS. 22A and 22B are diagrams illustrating a linking portion of a terminal fitting, in which FIG. 22A is a plan view of the linking portion, and FIG. 22B is a cross-sectional view of the linking portion.

FIGS. 23A and 23B are diagrams explaining a connection structure for a terminal fitting according to Embodiment 2-2, in which FIG. 23A is a perspective view of a terminal fitting connected to a ground wire, and FIG. 23B is a plan view of the terminal fitting connected to the ground wire.

FIGS. 24A and 24B are diagrams explaining the connection structure for a terminal fitting according to Embodiment 2-2, in which FIG. 24A is a perspective view of the terminal fitting and a junction terminal, and FIG. 24B is a plan view of the terminal fitting and the junction terminal.

FIGS. 25A to 25C are diagrams explaining the terminal fitting, in which FIG. 25A is a front view thereof, FIG. 25B is a side view thereof, and FIG. 25C is a cross-sectional view thereof.

FIGS. 26A to 26C are diagrams illustrating fastening states of crimping pieces of a fastening connecting portion to a terminal connecting portion of the terminal fitting, in which FIG. 26A is cross-sectional view taken on line H-H of FIG. 23B before fastening with the crimping pieces, FIG. 26B is a cross-sectional view taken on line H-H of FIG. 23B during the fastening with the crimping pieces, and FIG. 26C is a cross-sectional view taken on line H-H of FIG. 23B after the fastening with the crimping pieces.

FIGS. 27A and 27B are diagrams explaining a connection structure for a terminal fitting according to a modification of Embodiment 2-2, in which FIG. 27A is a perspective view of a terminal fitting connected to a ground wire, and FIG. 27B is a plan view of the terminal fitting connected to the ground wire.

FIGS. 28A and 28B are diagrams explaining the connection structure for a terminal fitting according to the modification of Embodiment 2-2, in which FIG. 28A is a perspective view of the terminal fitting and a junction terminal, and FIG. 28B is a plan view of the terminal fitting and the junction terminal.

FIGS. 29A and 29B are diagrams explaining a terminal fitting and a connection structure therefor according to Embodiment 3-1, in which FIG. 29A is a perspective view of a terminal fitting connected to a ground wire, and FIG. 29B is a plan view of the terminal fitting connected to the ground wire.

FIGS. 31A and 31B are diagrams illustrating a linking portion of the terminal fitting, in which FIG. 31A is a perspective view of the linking portion, and FIG. 31B is a cross-sectional view taken on line J-J of FIG. 31A.

FIGS. 32A and 32B are diagrams explaining a terminal fitting and a connection structure therefor according to Embodiment 3-2, in which FIG. 32A is a perspective view of a terminal fitting connected to a ground wire, and FIG. 32B is a plan view of the terminal fitting connected to the ground wire.

FIGS. 33A and 33B are diagrams illustrating a linking portion of the terminal fitting, in which FIG. 33A is a perspective view of the linking portion, and FIG. 33B is a cross-sectional view taken on line K-K of FIG. 33A.

FIGS. 36A and 36B are diagrams illustrating a linking portion of the terminal fitting, in which FIG. 36A is a plan view of the linking portion, and FIG. 36B is a cross-sectional view of the linking portion.

FIGS. 37A and 37B are diagrams explaining a connection structure for a terminal fitting according to Embodiment 3-4, in which FIG. 37A is a perspective view of a terminal fitting connected to a ground wire, and FIG. 37B is a plan view of the terminal fitting connected to the ground wire.

FIGS. 39A to 39C are diagrams explaining the connection structure for a terminal fitting according to Embodiment 3-4, in which FIG. 39A is a view taken on arrow A of FIG. 37A, FIG. 39B is a view taken on arrow B of FIG. 37A, and FIG. 39C is a view taken on arrow C of FIG. 37A.

FIGS. 43A to 43C are diagrams explaining the connection terminal, in which FIG. 43A is a cross-sectional view taken on line D-D of FIG. 42, FIG. 43B is a cross-sectional view taken on line E-E of FIG. 42, and FIG. 43C is a cross-sectional view taken on line F-F of FIG. 42.

FIGS. 44A to 44D are diagrams illustrating fastening states of crimping pieces of a fastening connecting portion to the terminal connecting portion of the terminal fitting, in which FIG. 44A is a cross-sectional view taken on line G-G of FIG. 37B before fastening with the crimping pieces, FIG. 44B is a cross-sectional view taken on line G-G of FIG. 37B at the beginning of the fastening with the crimping pieces, FIG. 44C is a cross-sectional view taken on line G-G of FIG. 37B during the fastening with the crimping pieces, and FIG. 44D is a cross-sectional view taken on line G-G of FIG. 37B after the fastening with the crimping pieces.

FIGS. 48A and 48B are diagrams explaining a connection structure for a terminal fitting according to Embodiment 3-5, in which FIG. 48A is a perspective view of a terminal fitting connected to a ground wire, and FIG. 48B is a plan view of the terminal fitting connected to the ground wire.

FIGS. 49A and 49B are diagrams explaining the connection structure for a terminal fitting according to Embodiment 3-5, in which FIG. 49A is a perspective view of the terminal fitting and a connection terminal, and FIG. 49B is a plan view of the terminal fitting and the connection terminal.

FIGS. 50A to 50C are diagrams explaining the terminal fitting, in which FIG. 50A is a front view thereof, FIG. 50B is a side view thereof, and FIG. 50C is a cross-sectional view thereof.

FIGS. 51A to 51C are diagrams illustrating fastening states of crimping pieces of a fastening connecting portion to a terminal connecting portion of the terminal fitting, in which FIG. 51A is a cross-sectional view taken on line H-H of FIG. 48B before fastening with the crimping pieces, FIG. 51B is a cross-sectional view taken on line H-H of FIG. 48B during the fastening with the crimping pieces, and FIG. 51C is a cross-sectional view taken on line H-H of FIG. 48B after the fastening with the crimping pieces.

FIGS. 52A and 52B are diagrams explaining a connection structure for a terminal fitting according to a modification of Embodiment 3-5, in which FIG. 52A is a perspective view of a terminal fitting connected to a ground wire, and FIG. 52B is a plan view of the terminal fitting connected to the ground wire.

FIGS. 53A and 53B are diagrams explaining a connection structure for a terminal fitting according to the modification of Embodiment 3-5, in which FIG. 53A is a perspective view of the terminal fitting and a connection terminal, and FIG. 53B is a plan view of the terminal fitting and the connection terminal.

FIGS. 54A and 54B are diagrams explaining a connection structure for terminals according to Embodiment 4-1, in which FIG. 54A is a perspective view of a terminal fitting connected to a ground wire, and FIG. 54B is a plan view of the terminal fitting connected to the ground wire.

FIGS. 56A to 56C are diagrams explaining the connection structure for terminals according to Embodiment 4-1, in which FIG. 56A is a view taken on arrow A of FIG. 54A, FIG. 56B is a view taken on arrow B of FIG. 54A, and FIG. 56C is a view taken on arrow C of FIG. 54A.

FIGS. 60A to 60C are diagrams explaining the connection terminal, in which FIG. 60A is a cross-sectional view taken on line D-D of FIG. 59, FIG. 60B is a cross-sectional view taken on line E-E of FIG. 59, and FIG. 60C is a cross-sectional view taken on line F-F of FIG. 59.

FIGS. 61A to 61D are diagrams illustrating fastening states of crimping pieces of a fastening connecting portion to the terminal connecting portion of the terminal fitting, in which FIG. 61A is a cross-sectional view taken on line G-G of FIG. 54B before fastening with the crimping pieces, FIG. 61B is a cross-sectional view taken online G-G of FIG. 54B at the beginning of the fastening with the crimping pieces, FIG. 61C is a cross-sectional view taken online G-G of FIG. 54B during the fastening with the crimping pieces, and FIG. 61D is a cross-sectional view taken on line G-G of FIG. 54B after the fastening with the crimping pieces.

FIGS. 70A and 70B are diagrams explaining a connection structure for terminals according to Embodiment 4-2, in which FIG. 70A is a perspective view of a terminal fitting connected to a ground wire, and FIG. 70B is a plan view of the terminal fitting connected to the ground wire.

FIGS. 71A and 71B are diagrams explaining the connection structure for terminals according to Embodiment 4-2, in which FIG. 71A is a perspective view of the terminal fitting and a connection terminal, and FIG. 71B is a plan view of the terminal fitting and the connection terminal.

FIGS. 72A to 72C are diagrams explaining the terminal fitting, in which FIG. 72A is a front view thereof, FIG. 72B is a side view thereof, and FIG. 72C is a cross-sectional view thereof.

FIGS. 73A to 73C are diagrams illustrating fastening states of crimping pieces of a fastening connecting portion to a terminal connecting portion of the terminal fitting, in which FIG. 73A is a cross-sectional view taken on line H-H of FIG. 70B before fastening with the crimping pieces, FIG. 73B is a cross-sectional view taken on line H-H of FIG. 70B during the fastening with the crimping pieces, and FIG. 70C is a cross-sectional view taken on line H-H of FIG. 70B after the fastening with the crimping pieces.

FIGS. 74A and 74B are diagrams explaining a connection structure for terminals according to a modification of Embodiment 4-2, in which FIG. 74A is a perspective view of a terminal fitting connected to a ground wire, and FIG. 74B is a plan view of the terminal fitting connected to the ground wire.

FIGS. 75A and 75B are diagrams explaining a connection structure for terminals according to a modification of Embodiment 4-2, in which FIG. 75A is a perspective view of a terminal fitting connected to a ground wire, and FIG. 75B is a plan view of the terminal fitting connected to the ground wire.

DETAILED DESCRIPTION

Preferred embodiments of the present invention will now be described with reference to the accompanying drawings.

Embodiment 1-1

Figure 1A:
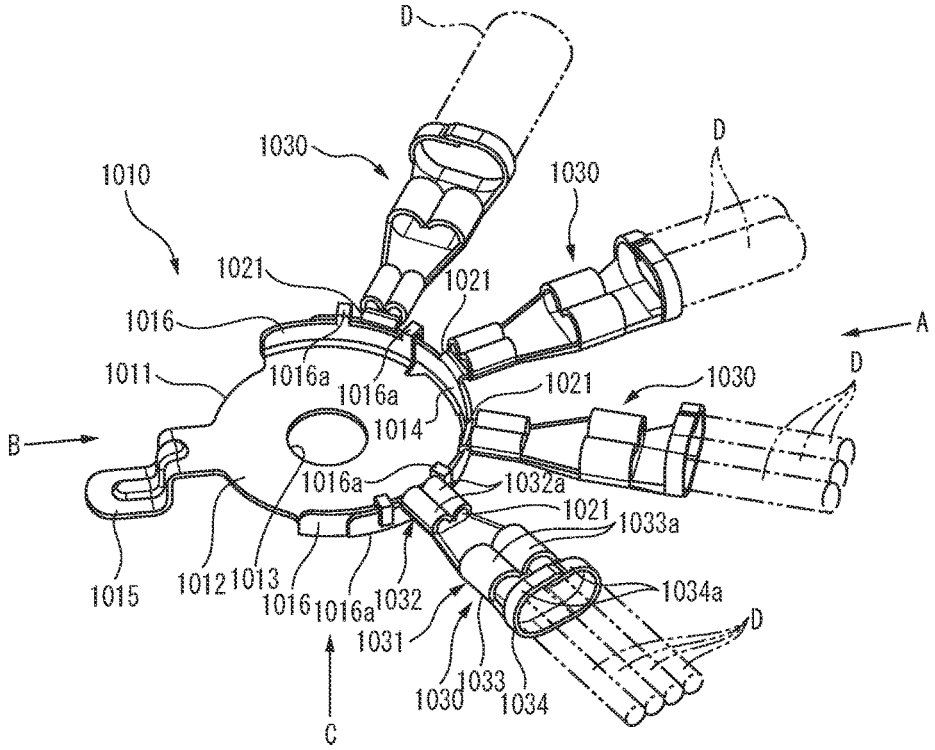
Figure 1B:
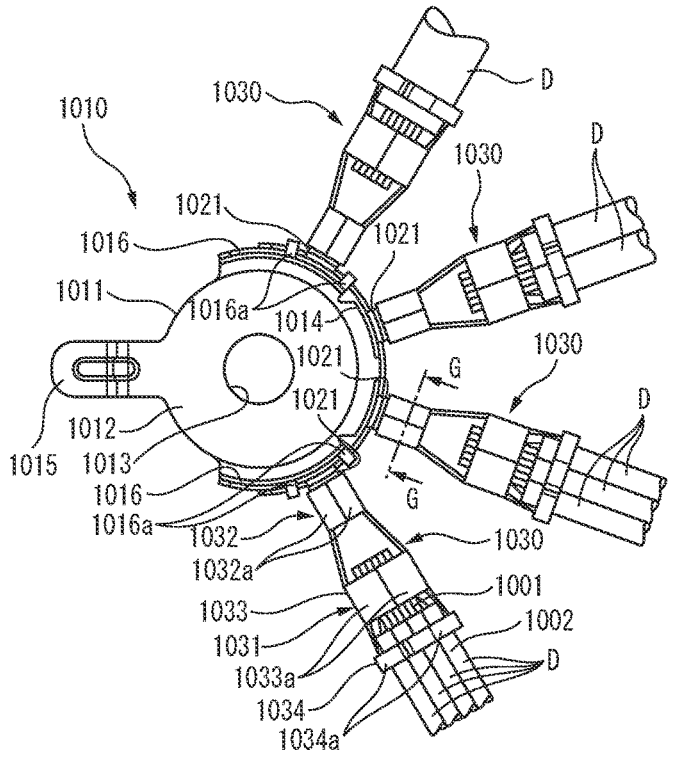

FIGS. 1A and 1B are diagrams explaining a connection structure for a terminal fitting according to Embodiment 1-1, in which FIG. 1A is a perspective view of a terminal fitting connected to a ground wire, and FIG. 1B is a plan view of the terminal fitting connected to the ground wire.

As illustrated in FIGS. 1A and 1B, the connection structure for a terminal fitting of the present embodiment includes a terminal fitting 1010 and junction terminals 1030. The junction terminals 1030 are connected to the terminal fitting 1010 for electrical connection.

The terminal fitting 1010 is electrically connected to a grounding surface such as a body of a vehicle. Each junction terminal 1030 connected to the terminal fitting 1010 is provided at an end of a ground wire (a wire) D branched from a wire harness connected to an in-vehicle circuit (an auxiliary device). The ground wire D has a conductor portion 1001, and a sheath 1002 covering the conductor portion 1001, and the conductor portion 1001 is exposed from the sheath 1002 at the end to be connected to the junction terminal 1030. In the ground wire D, the conductor portion 1001 is a copper wire made of copper or a copper alloy. In addition, in the ground wire D, the conductor portion 1001 may be an aluminum wire made of aluminum in some cases, or a copper wire and an aluminum wire may be used together in some cases. In the ground wire D, the conductor portion 1001 is electrically connected to the junction terminal 1030. Thus, the ground wire D of the in-vehicle circuit and the grounding surface such as a body of a vehicle are electrically connected to each other via the terminal fitting 1010.

Each junction terminal 1030 is connected to one to several ground wires D. In the exemplified case described herein, the junction terminals 1030 include a junction terminal 1030 connected to one ground wire D, a junction terminal 1030 connected to two ground wires D, a junction terminal 1030 connected to three ground wires D, and a junction terminal 1030 connected to four ground wires D.

Figure 2:
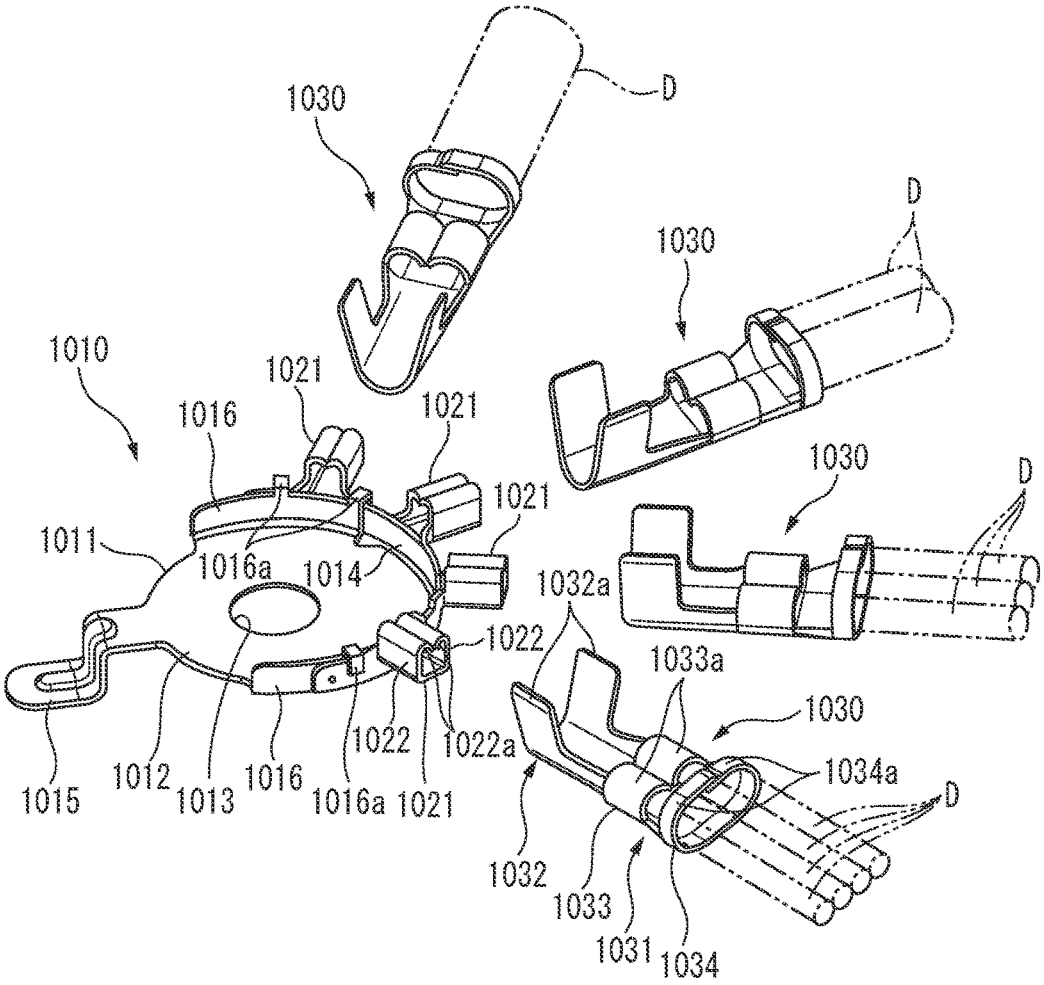
FIG. 2 is a perspective view of the terminal fitting and a junction terminal for explaining the connection structure for a terminal fitting according to Embodiment 1-1.
Figure 3A:
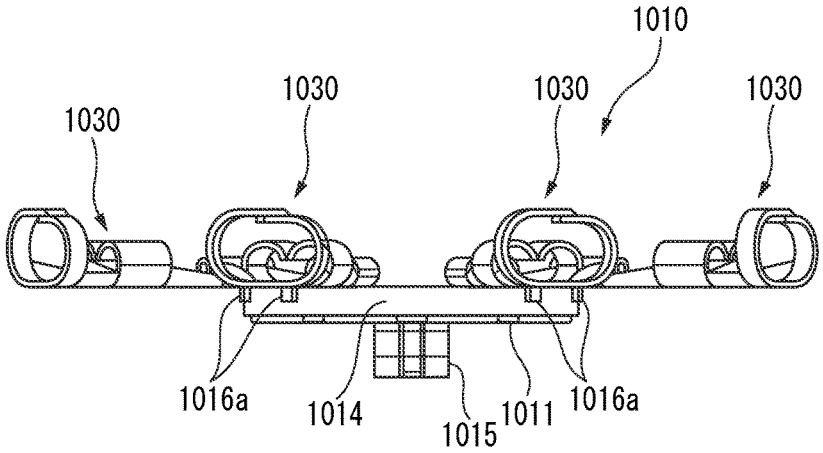
Figure 3B:
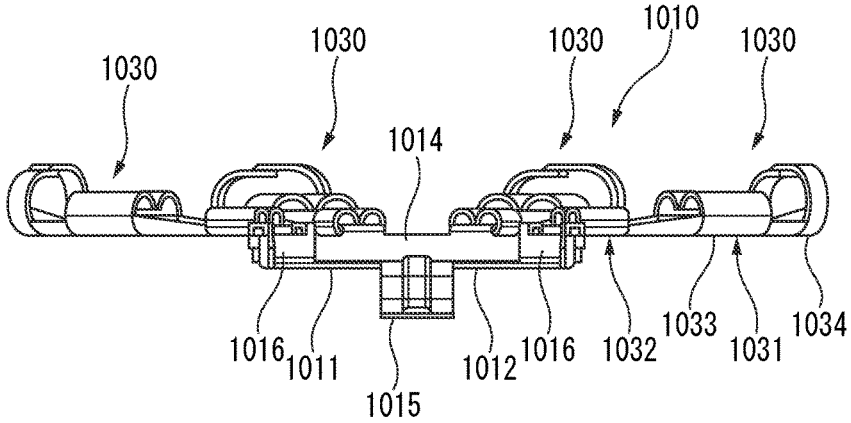
Figure 3C:
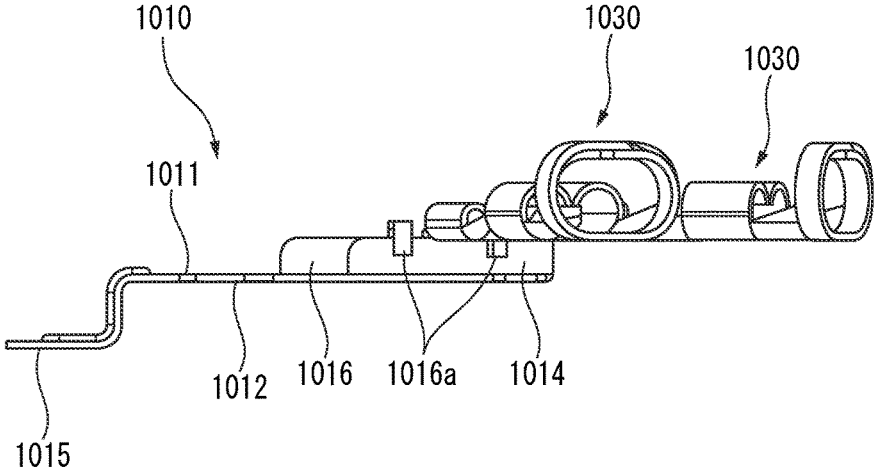

FIG. 2 is a perspective view of the terminal fitting and the junction terminals for explaining the connection structure for a terminal fitting according to Embodiment 1-1. FIGS. 3A to 3C are diagrams explaining the connection structure for a terminal fitting according to Embodiment 1-1, in which FIG. 3A is a view taken on arrow A of FIG. 1A, FIG. 3B is a view taken on arrow B of FIG. 1A, and FIG. 3C is a view taken on arrow C of FIG. 1A.

As illustrated in FIGS. 2 and 3A to 3C, the terminal fitting 1010 includes a terminal body 1011 and terminal connecting portions 1021. The terminal fitting 1010 is a pressed product of a conductive metal plate. The terminal body 1011 has a fixing plate 1012 in a circular shape in a plan view. At the center of the fixing plate 1012, a circular attaching hole 1013 is formed. The terminal body 1011 is fastened and fixed to the grounding surface such as a body of a vehicle with a bolt (not illustrated) inserted through the attaching hole 1013 of the fixing plate 1012. It is noted that the attaching hole 1013 may be provided eccentrically instead of at the center of the fixing plate 1012.

In substantially a half of the periphery of the fixing plate 1012, a connecting plate 1014 in an arc shape in a plan view is provided. The connecting plate 1014 is provided to rise toward one surface side, namely, toward the upper surface side, of the fixing plate 1012. The connecting plate 1014 is linked, at the center thereof, to the fixing plate 1012. Besides, the fixing plate 1012 has, on its periphery, two supporting walls 1016 each in an arc shape in a plan view. These supporting walls 1016 are provided to rise toward one surface side, namely, toward the upper surface side, of the fixing plate 1012, and the connecting plate 1014 is disposed along the outer circumferences of the supporting walls 1016. Each supporting wall 1016 has a plurality of fixing pieces 1016*a* formed at the upper edge thereof. These fixing pieces 1016*a* are folded toward an outer surface of the connecting plate 1014, and thus, the connecting plate 1014 is supported by the supporting walls 1016 with both ends thereof caught by the fixing pieces 1016*a*.

Besides, on a side opposite to the connecting plate 1014 in the fixing plate 1012, a rotation stopper piece 1015 is formed. The rotation stopper piece 1015 is a folded portion to be engaged with a step or a hole formed around the grounding surface to which the terminal body 1011 is fastened with the bolt, and the rotation of the terminal fitting 1010 on the grounding surface is restricted with this rotation stopper piece 1015 engaged with the step or the hole formed around the grounding surface.

The terminal connecting portions 1021 are formed integrally with the connecting plate 1014 of the terminal body 1011. The plural terminal connecting portions 1021 are provided in upper edge portions of the connecting plate 1014. Specifically, four terminal connecting portions 1021 are formed in the connecting plate 1014. These terminal connecting portions 1021 are extended, on the same plane, to radially protrude from a peripheral portion of the fixing plate 1012. Each of the terminal connecting portions 1021 has, as both sides thereof, engagement walls 1022 protruding toward one surface side, namely, toward the upper surface side, and each having a folded upper end curved inward in an arc shape.

Figure 4:
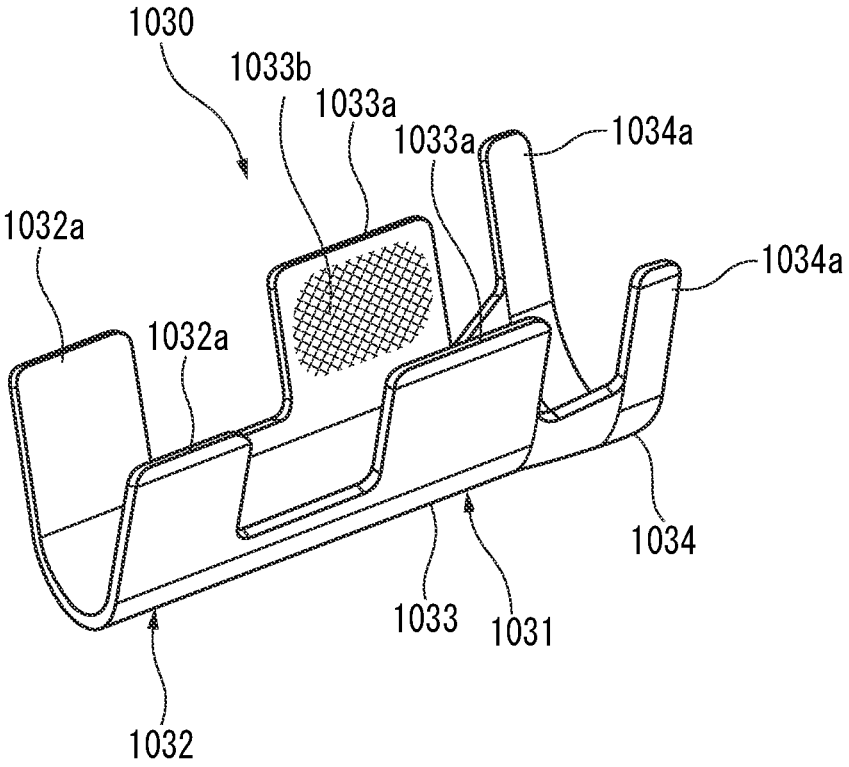
FIG. 4 is a perspective view of the junction terminal for explaining the junction terminal.

FIG. 4 is a perspective view of the junction terminal for explanation of the junction terminal.

As illustrated in FIG. 4, the junction terminal 1030 has a wire connecting portion 1031 and a fastening connecting portion 1032. The junction terminal 1030 provided on the ground wire D is a pressed product made of a conductive metal plate. The wire connecting portion 1031 of the junction terminal 1030 is connected to the ground wire D. Besides, the fastening connecting portion 1032 of the junction terminal 1030 is fastened to the terminal connecting portion 1021 of the terminal fitting 1010.

The wire connecting portion 1031 has a conductor crimping portion 1033 and a sheath crimping portion 1034. The conductor crimping portion 1033 is formed in the shape of U having a pair of conductor crimping pieces 1033*a*, and when these conductor crimping pieces 1033*a* are crimped, the conductor portion 1001 of the ground wire D is crimped and fixed in the conductor crimping portion 1033. Thus, the conductor portion 1001 of the ground wire D and the junction terminal 1030 are electrically connected to each other. Besides, on an inner surface of the conductor crimping portion 1033, a rough surface portion (a serration) 1033*b* roughened by machining is provided. Thus, the conductor portion 1001 of the ground wire D crimped in the conductor crimping portion 1033 is definitely electrically connected to the junction terminal 1030. The sheath crimping portion 1034 is formed in the shape of a U having a pair of sheath crimping pieces 1034*a*, and when these sheath crimping pieces 1034*a* are crimped, a tip portion of the sheath 1002 of the ground wire D is crimped and crimped in the sheath crimping portion 1034.

The fastening connecting portion 1032 of the junction terminal 1030 is formed in the shape of U having a pair of crimping pieces 1032*a*. If the crimping pieces 1032*a* are crimped with the terminal connecting portion 1021 of the terminal fitting 1010 disposed inside the U-shaped fastening connecting portion 1032 of the junction terminal 1030, the crimping pieces 1032*a* are crimped to externally roll up the engagement walls 1022 corresponding to the both sides of the terminal connecting portion 1021 of the terminal body 1011, and thus, the fastening connecting portion 1032 is firmly crimped to the terminal connecting portion 1021 at high contact pressure, and the terminal fitting 1010 and the junction terminal 1030 are definitely electrically connected to each other.

Next, connection of the ground wire D to the terminal fitting 1010 will be described.

Figure 5A:
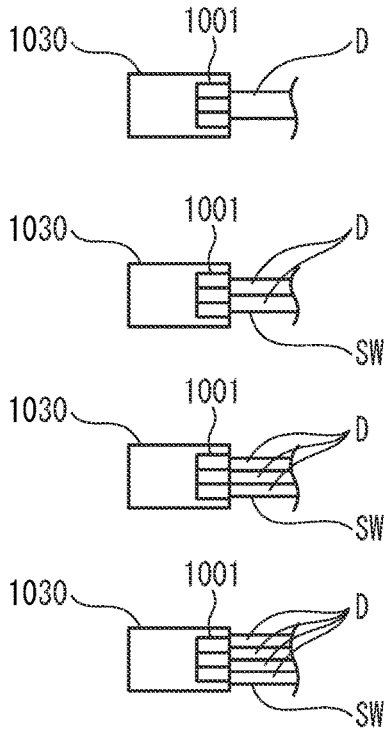
Figure 5B:
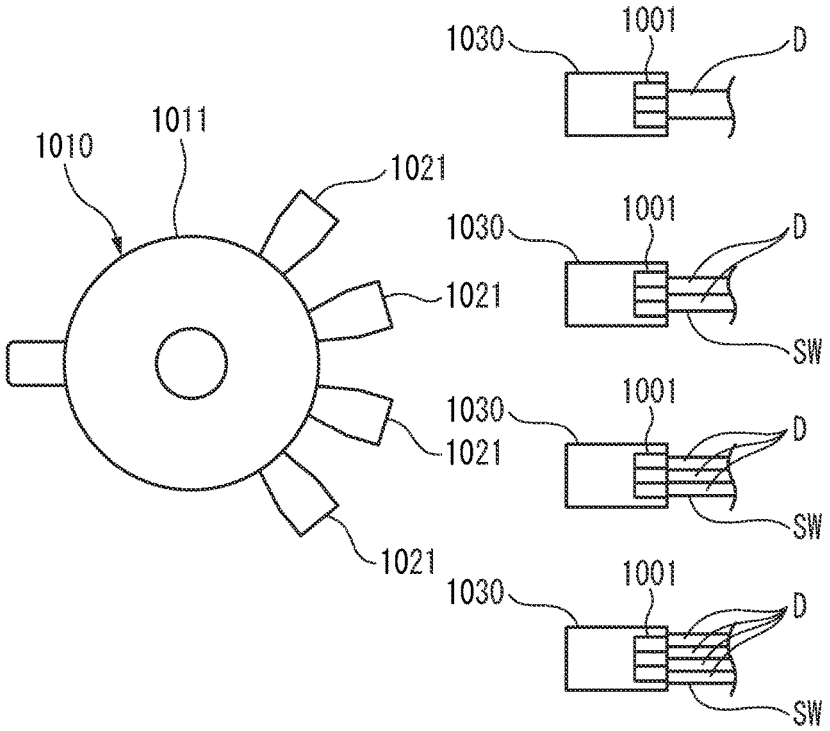

FIGS. 5A and 5B are diagrams explaining a procedure for connecting the ground wire to the terminal fitting, in which FIG. 5A is a schematic plan view of the junction terminals connected to the ground wires, and FIG. 5B is a schematic plan view of the terminal fitting and the junction terminals.

As illustrated in FIG. 5A, as a preceding process, the ground wire D is first connected to the wire connecting portion 1031 of the junction terminal 1030. For connecting the ground wire D to the terminal fitting 1010, the sheath 1002 is removed at the end of the ground wire D to expose the conductor portion 1001. Then, with the end of the ground wire D disposed on the wire connecting portion 1031 of the junction terminal 1030, the conductor crimping portion 1033 is crimped and the sheath crimping portion 1034 is crimped. Thus, the ground wire D is precedently connected to each junction terminal 1030.

Here, one ground wire D or a plurality of ground wires D are connected to the junction terminal 1030. If a plurality of ground wires D are connected, the ground wires are drawn out from wire harnesses connected to respective auxiliary devices, and bundled as a sub harness SW to be connected to the junction terminal 1030. In this exemplified case, one, two, three and four ground wires D are respectively connected to the junction terminals 1030.

As illustrated in FIG. 5B, the junction terminals 1030 are connected to the terminal connecting portion 1021. Specifically, the fastening connecting portion 1032 of each junction terminal 1030 having been connected to the ground wire D is placed on the rear surface of the terminal connecting portion 1021 of the terminal fitting 1010, and the crimping pieces 1032*a* are crimped to crimp and connect the junction terminal 1030 to the terminal fitting 1010. Thus, a plurality of ground wires D are electrically connected all together to the terminal fitting 1010. Then, the resultant terminal fitting 1010 is fixed to the grounding surface of a vehicle with a bolt, and thus, the plural ground wires D are grounded to be electrically connected to a negative electrode of a battery via the body of the vehicle.

As described so far, according to the connection structure for a terminal fitting of Embodiment 1-1, the junction terminals 1030 electrically connected to the ground wires D are respectively electrically connected to the plural terminal connecting portions 1021 of the terminal fitting 1010 to be fastened and fixed to the grounding surface through the terminal body 1011, and as a result, a plurality of ground wires D can be grounded all together to, for example, a small number of grounding surfaces provided in a body of a vehicle. As a result, as compared with a structure in which terminal fittings respectively connected to ground wires D are stacked and fastened to a grounding surface for electrical connection, there is no need to stack terminal fittings, and hence, even if the number of ground wires D is increased, increase in weight of the terminal fitting 1010 can be suppressed, so as to reduce cost through reduction of materials. Besides, since there is no need to stack the terminal fittings 1010, even if the number of ground wires D to be electrically connected is increased, the thickness of the terminal fitting 1010 is not increased, and hence the space can be saved. In addition, the terminal fitting can be definitely fastened to the grounding surface, and the fastening can be inhibited from loosening thereafter.

Reference Example 1-1

Figure 6:
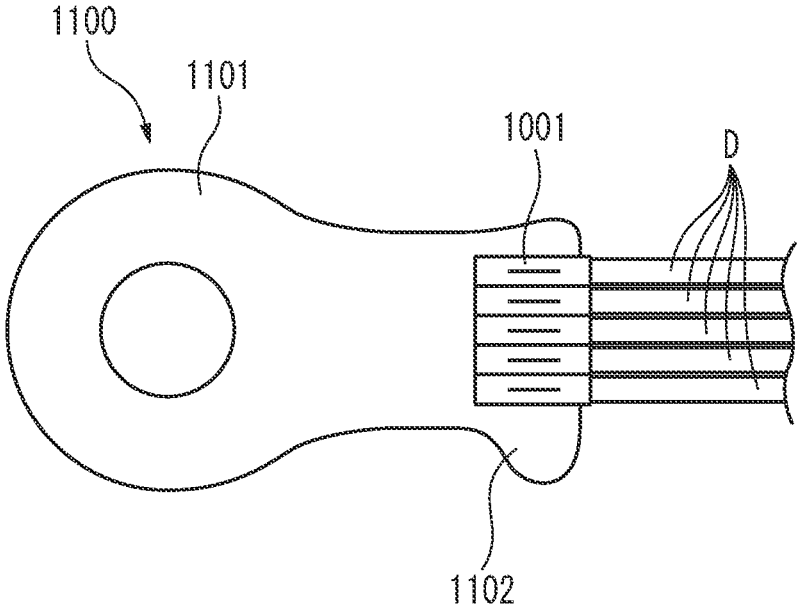
FIG. 6 is a schematic plan view of a terminal fitting according to Reference Example 1-1.

Here, a connection structure for a terminal fitting according to Reference Example 1-1 will be described. FIG. 6 is a schematic plan view of a terminal fitting of Reference Example 1-1.

As illustrated in FIG. 6, the terminal fitting 1100 of Reference Example 1-1 includes a terminal body 1101 to be fastened with a bolt to a grounding surface, and a connecting portion 1102 to which conductor portions 1001 of a plurality of ground wires D are electrically connected by thermal welding or the like. Also this terminal fitting 1100 can ground a plurality of ground wires D all together. In the terminal fitting 1100, however, it is necessary to expose the conductor portions 1001 from sheaths of the plural ground wires D at the ends thereof and to line up the tips of the conductor portions 1001 in connecting the ground wires D to the connecting portion 1102 by the thermal welding or the like, which is very complicated and difficult, and in addition, the conductor portions 1001 thus lined may be loosened to make the connection difficult.

On the contrary, in the structure of Embodiment 1-1, a plurality of ground wires D are grounded by connecting a plurality of junction terminals 1030 respectively to the terminal connecting portions 1021 of the terminal fitting 1010, and as a result, there is no need to line up and bundle the conductor portions 1001 of the ground wires D so as not to be loosened, and hence, wiring workability can be greatly improved.

Furthermore, when a plurality of ground wires D are electrically connected to each junction terminal 1030, the number of ground wires D to be grounded all together to the grounding surface via the terminal fitting 1010 can be easily and greatly increased.

In addition, since the junction terminal 1030 having been electrically connected to the ground wires D bundled as a sub harness SW is connected to the terminal connecting portion 1021 of the terminal fitting 1010, the ground wires D can be very easily electrically connected to the grounding surface. Thus, other wires different from the ground wires D can be easily bundled as a sub harness, resulting in improving a prior fitting ratio and increasing wiring efficiency.

In addition, the connection between the junction terminal 1030 and the ground wire D and the connection between the terminal connecting portion 1021 of the terminal fitting 1010 and the junction terminal 1030 are not limited those by crimping. The junction terminal 1030 and the ground wire D may be connected to each other by, for example, ultrasonic welding or thermal welding. Besides, the terminal connecting portion 1021 of the terminal fitting 1010 and the junction terminal 1030 may be connected to each other by, for example, ultrasonic welding, thermal welding, or male-female fitting through mutual fitting.

Embodiment 2-1

Next, a connection structure and a connection method for a terminal fitting according to Embodiment 2-1 will be described.

Figure 7A:
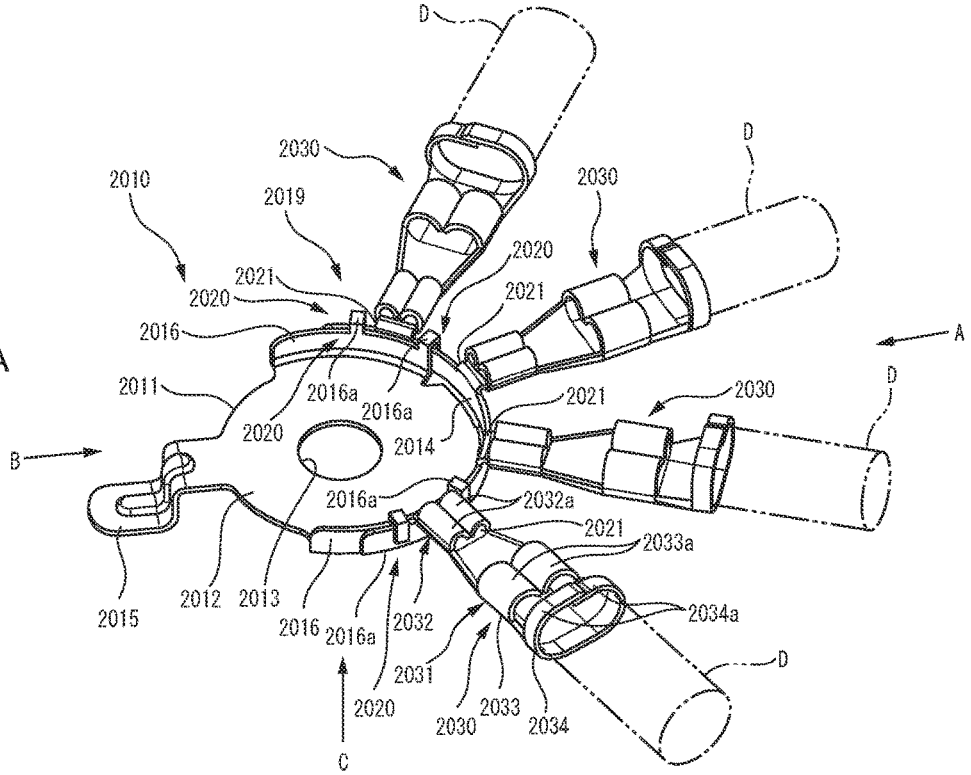
Figure 7B:
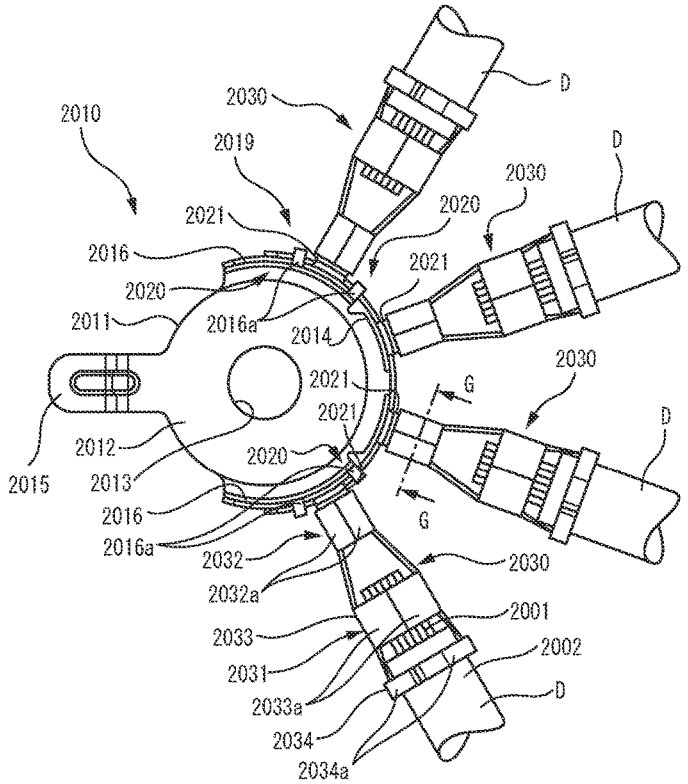

FIGS. 7A and 7B are diagrams explaining a connection structure for a terminal fitting according to Embodiment 2-1, in which FIG. 7A is a perspective view of a terminal fitting connected to a ground wire, and FIG. 7B is a plan view of the terminal fitting connected to the ground wire.

As illustrated in FIGS. 7A and 7B, in the connection structure for a terminal fitting according to Embodiment 2-1, terminal connecting portions 2021 of the terminal fitting 2010 are connected to junction terminals 2030. The terminal fitting 2010 is electrically connected to a grounding surface such as a body of a vehicle. Each of the junction terminals 2030 connected to the terminal fitting 2010 is provided at an end of a ground wire (a wire) D of an in-vehicle circuit (an auxiliary device). The ground wire D has a conductor portion 2001, and a sheath 2002 covering the conductor portion 2001, and the conductor portion 2001 is exposed from the sheath 2002 at the end to be connected to the junction terminal 2030. The conductor portion 2001 of the ground wire D is electrically connected to the junction terminal 2030. Thus, the ground wire D of the in-vehicle circuit and the grounding surface such as a body of a vehicle are electrically connected to each other via the terminal fitting 2010.

Figure 8:
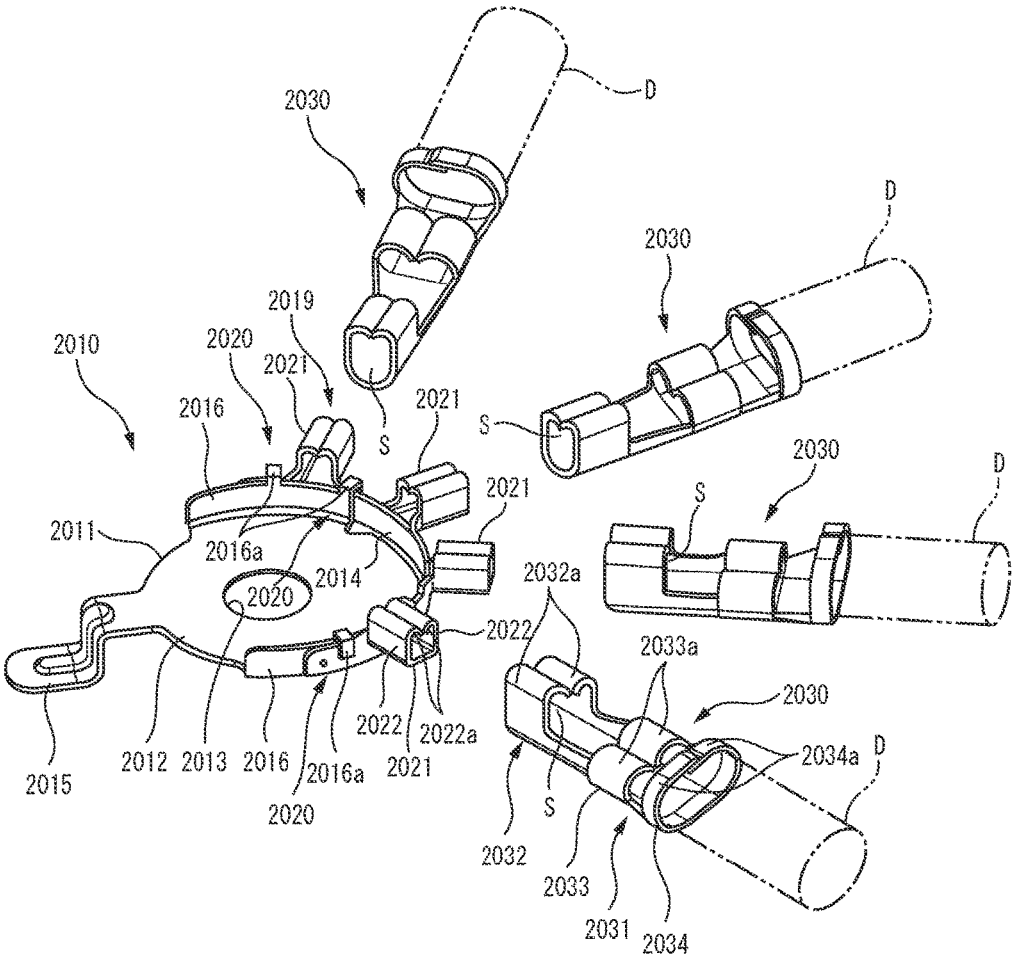
FIG. 8 is a perspective view of the terminal fitting and a junction terminal for explaining the connection structure for a terminal fitting according to Embodiment 2-1.
Figure 9A:
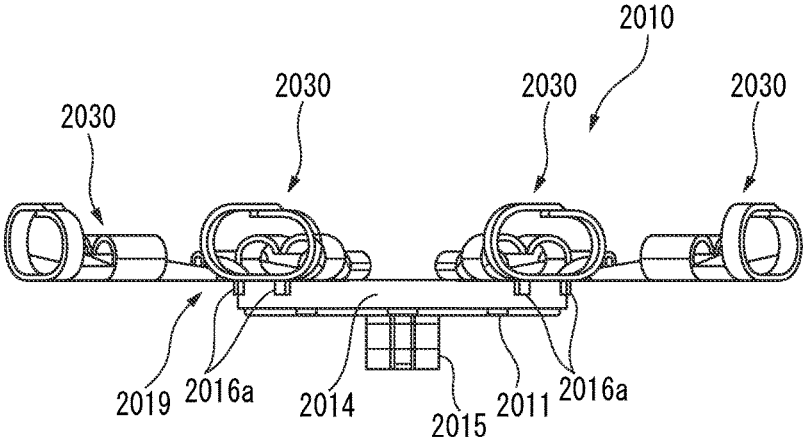
Figure 9B:
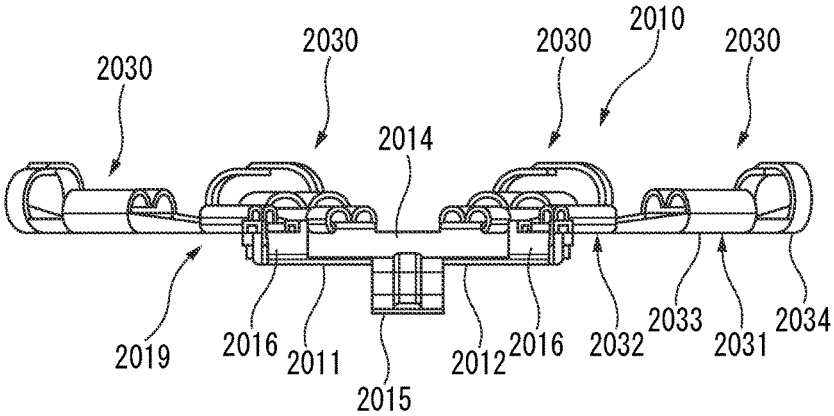
Figure 9C:
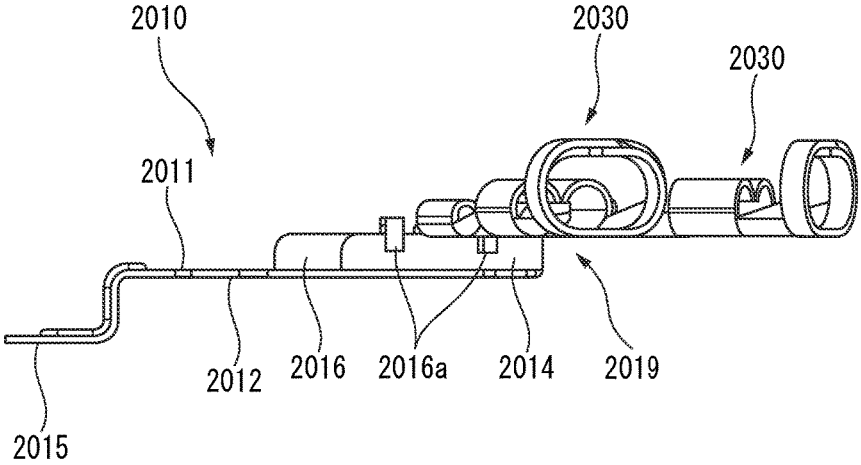
Figure 10:
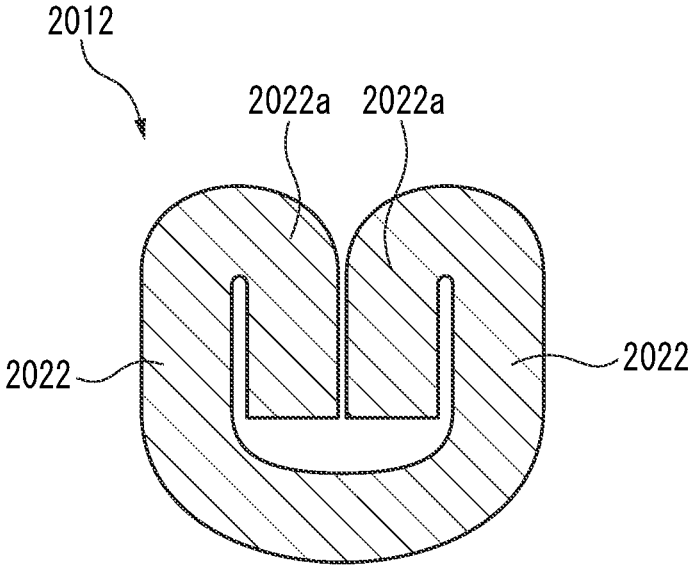
FIG. 10 is a cross-sectional view of a terminal connecting portion of the terminal fitting.

FIG. 8 is a perspective view of the terminal fitting and the junction terminal for explaining the connection structure for a terminal fitting according to Embodiment 2-1. FIGS. 9A to 9C are diagrams explaining the connection structure for a terminal fitting according to Embodiment 2-1, in which FIG. 9A is a view taken on arrow A of FIG. 7A, FIG. 9B is a view taken on arrow B of FIG. 7A, and FIG. 9C is a view taken on arrow C of FIG. 7A. FIG. 10 is a cross-sectional view of a terminal connecting portion of the terminal fitting.

As illustrated in FIGS. 8 and 9A to 9C, the terminal fitting 2010 includes a terminal body 2011 and a wire connecting body 2019 including a plurality of terminal connecting portions 2021. The terminal fitting 2010 is a pressed product of a conductive metal plate. The terminal body 2011 has a fixing plate 2012 in a circular shape in a plan view. At the center of the fixing plate 2012, a circular attaching hole 2013 is formed. The terminal body 2011 is fixed to the grounding surface such as a body of a vehicle with a bolt (not illustrated) inserted through the attaching hole 2013 of the fixing plate 2012. It is noted that the attaching hole 2013 may be provided eccentrically instead of at the center of the fixing plate 2012.

In a part of the fixing plate 2012, a rotation stopper piece 2015 is formed. The rotation stopper 2015 is a folded portion to be engaged with a step or a hole formed around the grounding surface to which the terminal body 2011 is fastened with the bolt, and the rotation of the terminal fitting 2010 on the grounding surface is restricted with the rotation stopper piece 2015 engaged with the step or the hole formed around the grounding surface.

The fixing plate 2012 has, on its periphery, two supporting walls 2016 each in an arc shape in a plan view. These supporting walls 2016 are provided to rise toward one surface side, namely, toward the upper surface side, of the fixing plate 2012. Besides, the wire connecting body 2019 has, in a substantially a half of the periphery of the fixing plate 2012, a connecting plate 2014 in an arc shape in a plan view. The connecting plate 2014 is provided to rise toward one surface side, namely, toward the upper surface side, of the fixing plate 2012. The connecting plate 2014 is disposed along the outer circumferences of the supporting walls 2016.

Each supporting wall 2016 has a plurality of catching pieces 2016*a* formed at the upper edge thereof. These catching pieces 2016*a* are folded toward an outer surface of the connecting plate 2014, and thus, the connecting plate 2014 is supported by the supporting walls 2016 with both ends thereof caught by the catching pieces 2016*a*.

Thus, in the terminal fitting 2010, portions where the connecting plate 2014 is caught by the catching pieces 2016*a* of the supporting walls 2016 correspond to linking portions 2020. In other words, the terminal fitting 2010 has a plurality of linking portions 2020, and the plural linking portions 2020 link the terminal body 2011 and the wire connecting body 2019 to each other.

The terminal connecting portions 2021 are formed integrally with the connecting plate 2014 of the terminal body 2011. The plural terminal connecting portions 2021 are provided in upper edge portions of the connecting plate 2014. Specifically, four terminal connecting portions 2021 are formed in the connecting plate 2014. These terminal connecting portions 2021 are extended, on the same plane, to radially protrude from a peripheral portion of the fixing plate 2012.

As illustrated in FIG. 10, each of the terminal connecting portions 2021 has, as both sides thereof, engagement walls 2022 protruding toward one surface side, namely, toward the upper surface side. Thus, each terminal connecting portion 2021 is formed in a recessed shape in a front view. Besides, each of the engagement walls 2022 has, at the upper end thereof, a folded engaging piece 2022*a* curved inward in an arc shape. The terminal connecting portion 2021 has a bottom curved to be swollen outward.

Figure 11:
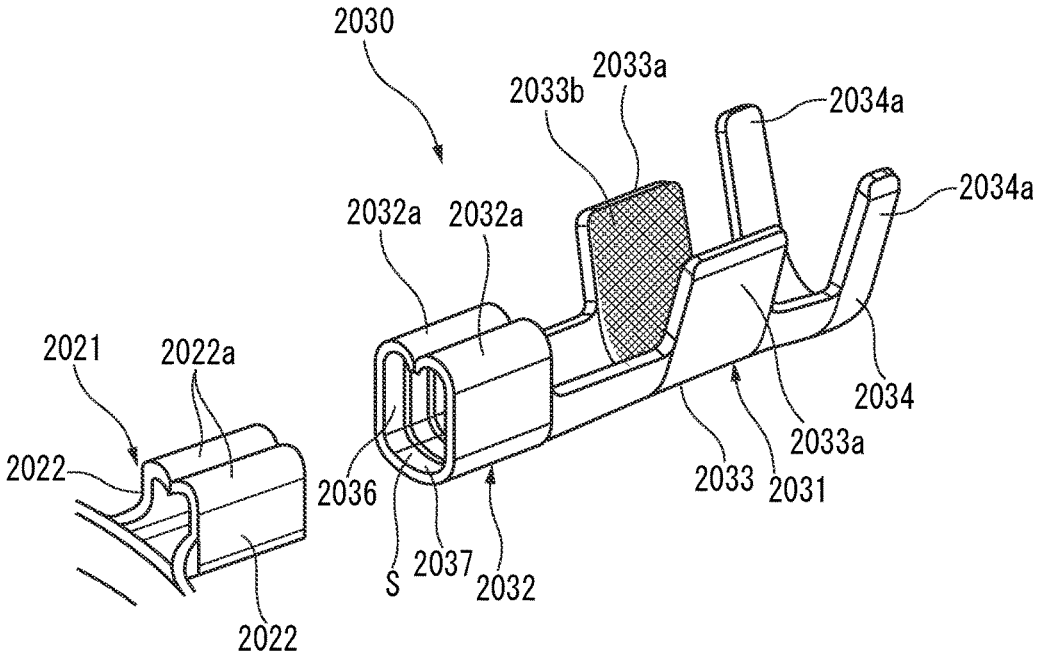
FIG. 11 is a perspective view of the terminal connecting portion and the junction terminal.
Figure 12:
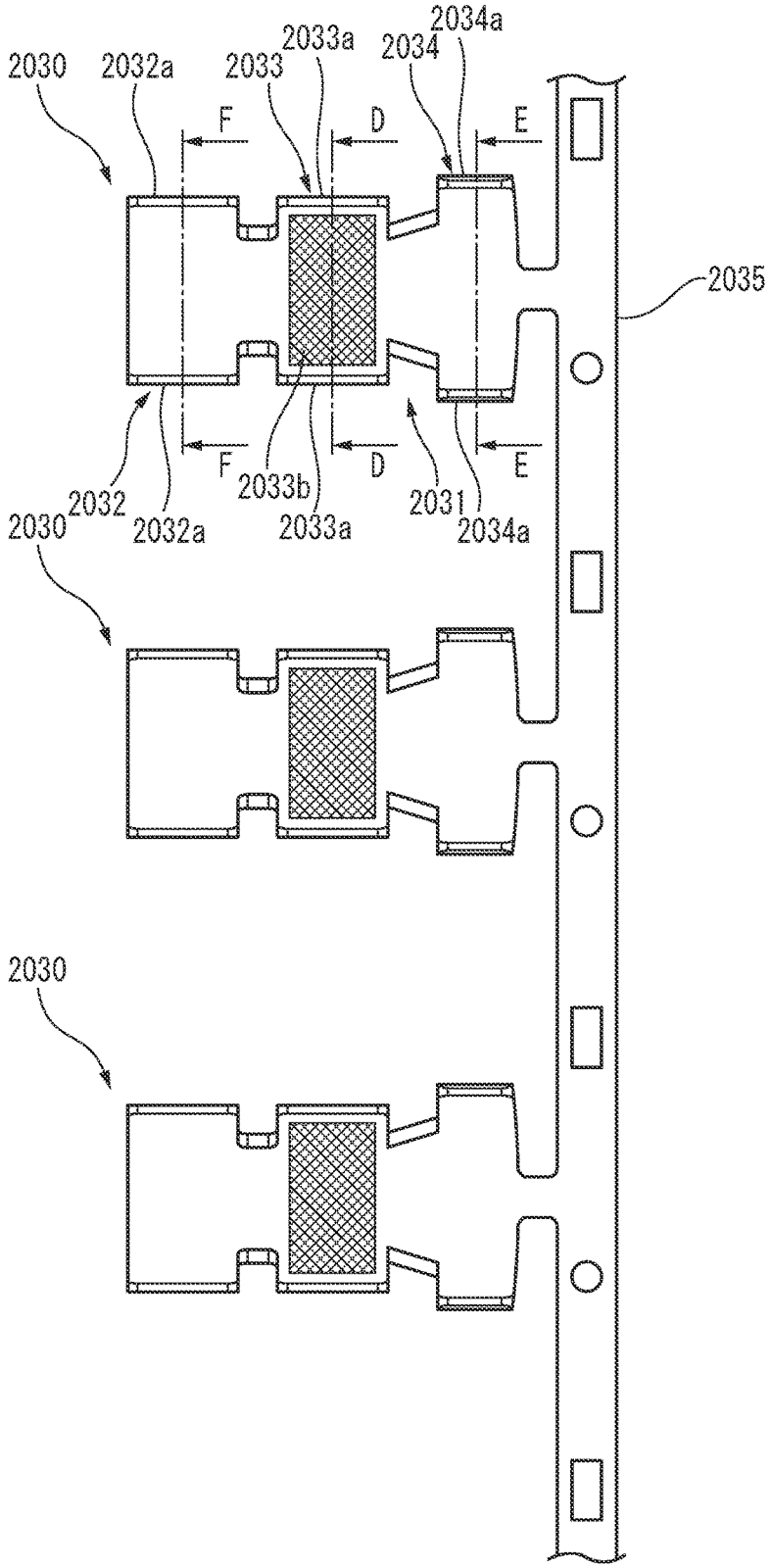
FIG. 12 is a plan view of the junction terminal linked to a carrier.
Figure 13A:
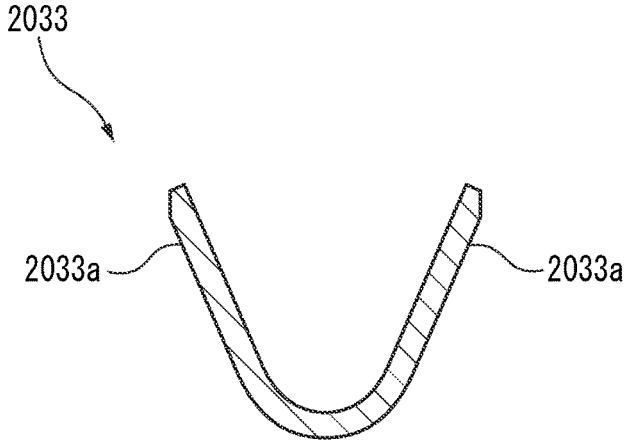
Figure 13B:
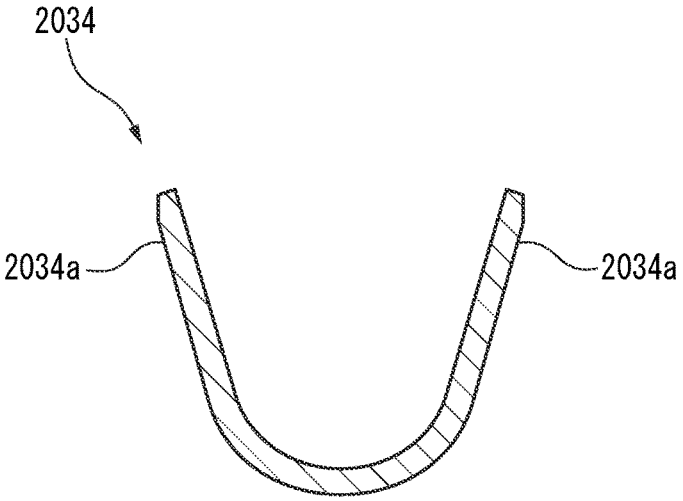
Figure 13C:
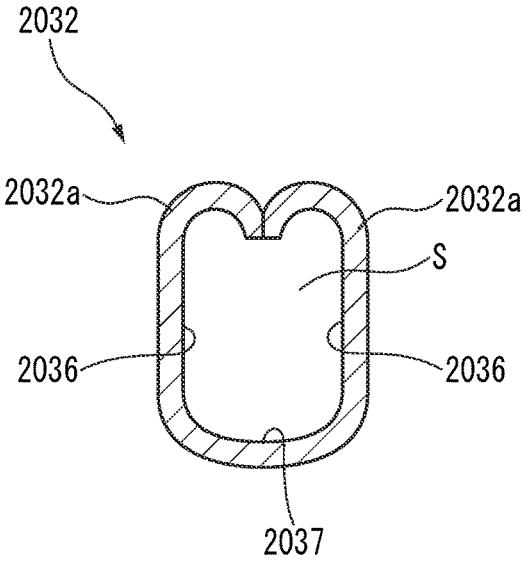

FIG. 11 is a perspective view of the terminal connecting portion and the junction terminal. FIG. 12 is a plan view of the junction terminal linked to a carrier. FIGS. 13A to 13C are diagrams explaining the junction terminal, in which FIG. 13A is a cross-sectional view taken on line D-D of FIG. 12, FIG. 13B is a cross-sectional view taken on line E-E of FIG. 12, and FIG. 13C is a cross-sectional view taken on line F-F of FIG. 12.

As illustrated in FIG. 11, the junction terminal 2030 has a wire connecting portion 2031 and a fastening connecting portion 2032. The ground wire D is connected to the wire connecting portion 2031. The junction terminal 2030 provided on the ground wire D is a pressed product made of a conductive metal plate. The fastening connecting portion 2032 is fastened to the terminal connecting portion 2021 of the terminal fitting 2010.

As illustrated in FIG. 12, the junction terminal 2030 is supplied in a state where it is linked, on the side of the wire connecting portion 2031, to a belt-shaped carrier 2035, and is used in a state where it is separated from the carrier 2035. The wire connecting portion 2031 has a conductor crimping portion 2033 and a sheath crimping portion 2034.

As illustrated in FIGS. 11 and 13A, the conductor crimping portion 2033 is formed in the shape of U having a pair of conductor crimping pieces 2033*a*, and when the conductor crimping pieces 2033*a* are crimped, the conductor portion 2001 of the ground wire D is crimped and fixed in the conductor crimping portion 2033. Thus, the conductor portion 2001 of the ground wire D and the junction terminal 2030 are electrically connected to each other. Besides, on an inner surface of the conductor crimping portion 2033, a rough surface portion (a serration) 2033*b* roughened by machining is provided. It is noted that the rough surface portion 2033*b* is not limited to the illustrated shape. Thus, the conductor portion 2001 of the ground wire D crimped in the conductor crimping portion 2033 is definitely electrically connected to the junction terminal 2030.

As illustrated in FIGS. 11 and 13B, the sheath calking portion 2034 is formed in the shape of U having a pair of sheath crimping pieces 2034*a*, and when the sheath crimping pieces 2034*a* are crimped, a tip portion of the sheath 2002 of the ground wire D is crimped and fixed in the sheath crimping portion 2034.

For connecting the ground wire D to the junction terminal 2030, the sheath 2002 is removed at the end of the ground wire D to expose the conductor portion 2001. Then, with the end of the ground wire D disposed on the wire connecting portion 2031 of the junction terminal 2030 having been separated from the carrier 2035, the conductor crimping portion 2033 is crimped and the sheath crimping portion 2034 is crimped. Thus, the ground wire D is electrically connected to the junction terminal 2030.

As illustrated in FIGS. 11 and 13C, the fastening connection portion 2032 of the junction terminal 2030 has a pair of crimping pieces 2032*a*. Each of the crimping pieces 2032*a* is caused to rise upward from the bottom. Besides, the crimping piece 2032*a* has an upper end portion curved and folded inward in an arc shape.

Thus, a holding space S surrounded by the crimping pieces 2032*a* is formed in the fastening connecting portion 2032 of the junction terminal 2030. Side surfaces of the holding space S are formed as substantially vertical planes by the crimping pieces 2032*a* rising upward, and the side surfaces work as rotation restricting surfaces 2036. Besides, a bottom 2037 of the holding space S is curved to be slightly swollen downward.

The holding space S of the fastening connecting portion 2032 is formed to be slightly larger than the external form of the terminal connecting portion 2021 in a front view. Thus, the terminal connecting portion 2021 can be inserted into the holding space S (see FIG. 15A). Besides, if the terminal connecting portion 2021 is inserted in the holding space S, the terminal connecting portion 2021 is restricted from rotating around an axis along a direction for inserting the terminal connecting portion 2021 into the holding space S because the terminal connecting portion 2021 is in contact with the rotation restricting surfaces 2036 corresponding to the side surfaces of the holding space S.

Next, fastening of the junction terminal 2030 to the terminal connecting portion 2021 of the terminal fitting 2010 will be described.

Figure 14:
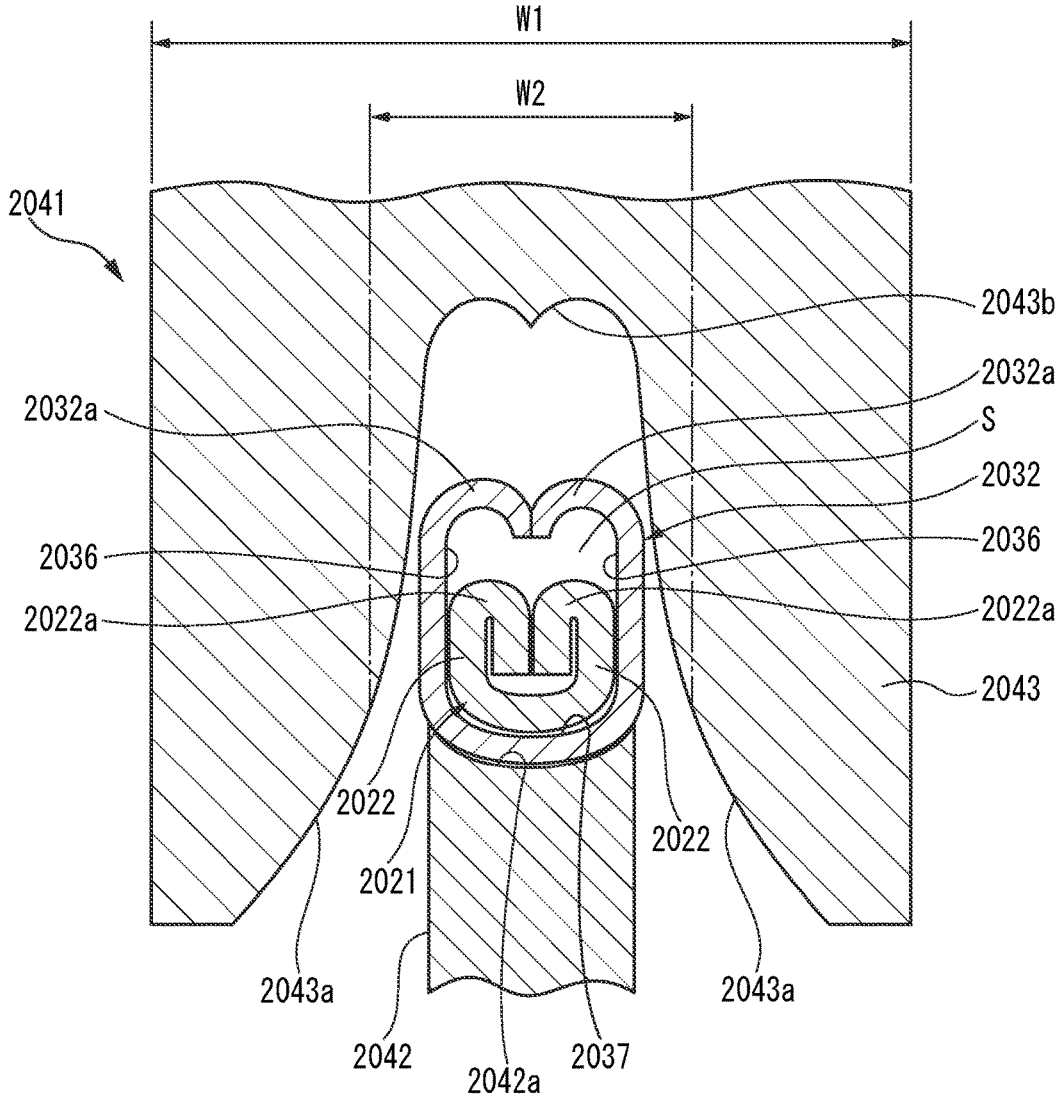
FIG. 14 is a schematic cross-sectional view of a crimping machine in which a junction terminal and a terminal connecting portion are set.
Figure 15A:
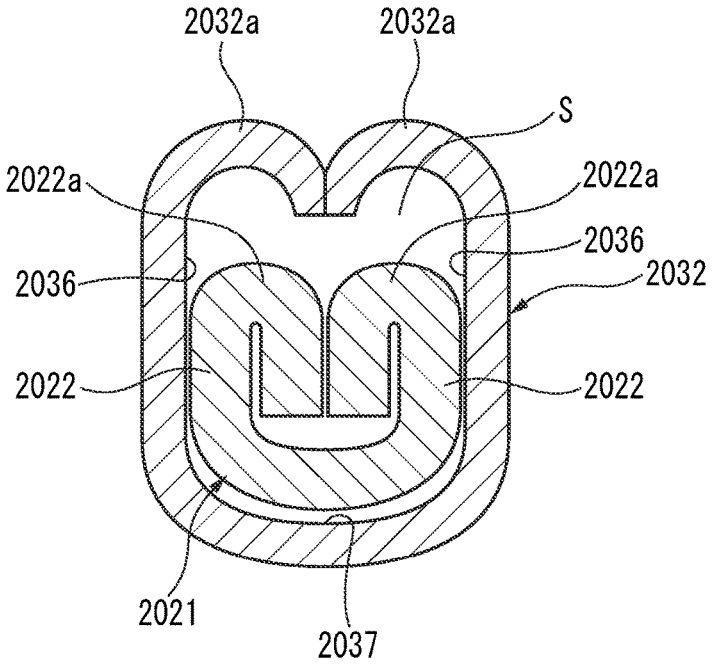
Figure 15B:
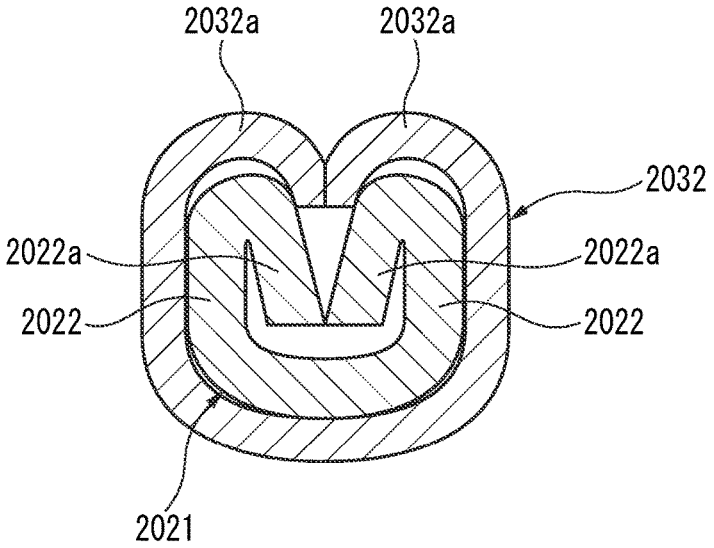
Figure 15C:
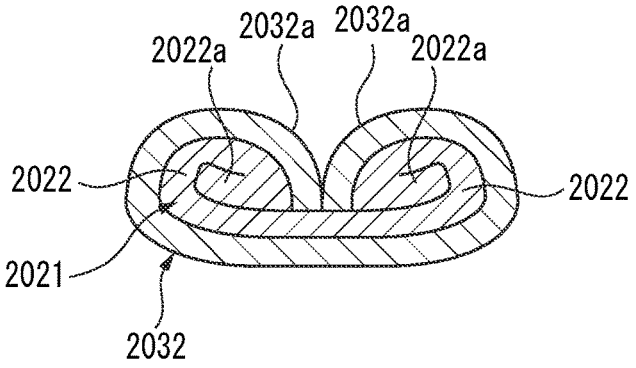

FIG. 14 is a schematic cross-sectional view of a crimping machine in which a junction terminal and a terminal connecting portion are set. FIGS. 15A to 15C are diagrams illustrating fastening states of the crimping pieces of the fastening connecting portion to the terminal connecting portion of the terminal fitting, in which FIG. 15A is a cross-sectional view taken on line G-G of FIG. 7B before fastening with the crimping pieces, FIG. 15B is a cross-sectional view taken on line G-G of FIG. 7B during the fastening with the crimping pieces, and FIG. 15C is a cross-sectional view taken on line G-G of FIG. 7B after the fastening with the crimping pieces.

As illustrated in FIG. 14, the crimping machine 2041 for crimping and fastening the junction terminal 2030 to the terminal connecting portion 2021 includes an anvil 2042 and a crimper 2043 movable toward or away from the anvil 2042. The anvil 2042 has an upper surface as a placing surface 2042*a*, and the junction terminal 2030 is placed on this placing surface 2042*a*. The placing surface 2042*a* is in a shape slightly recessed downward in an arc shape. Thus, the junction terminal 2030 placed on the placing surface 2042*a* is disposed on the anvil 2042. The crimper 2043 is formed in a recessed shape having inviting surfaces 2043*a* gently spread toward the anvil 2042, and has, in an upper portion of the recessed shape, a pressing surface 2043*b* for guiding and pressing the respective crimping pieces 2032*a* inward.

(Temporarily Fixing Step)

As illustrated in FIG. 15A, the junction terminal 2030 and the terminal connecting portion 2021 are first temporarily fixed. Specifically, the terminal connecting portion 2021 is inserted into the holding space S of the junction terminal 2030. When the terminal connecting portion 2021 is thus inserted into the holding space S, the both sides of the terminal connecting portion 2021 are in contact with the rotation restricting surfaces 2036 corresponding to the side surfaces of the holding space S, and hence the terminal connecting portion 2021 is held in the fastening connecting portion 2032 of the junction terminal 2030 with its rotation around the axis along the inserting direction restricted. Thus, the terminal connecting portion 2021 is kept in a prescribed position against the junction terminal 2030.

Besides, since the bottom 2037 of the holding space S is curved to be recessed downward, the terminal connecting portion 2021 inserted in the holding space S is in a stable position on the bottom 2037. In particular, since the terminal connecting portion 2021 has the bottom swollen outward, it is stably fit on the bottom 2037 of the holding space S.

(Setting Step)

As illustrated in FIG. 14, the junction terminal 2030 in which the terminal connecting portion 2021 is temporarily fixed is placed on the placing surface 2042*a* of the anvil 2042 of the crimping machine 2041. Also in this state, the terminal connecting portion 2021 is restricted from rotating around the axis along the inserting direction because it is inserted in the holding space S, and hence is kept in the prescribed position against the junction terminal 2030.

(Fastening Step)

The crimping machine 2041 is actuated to start crimping, and the crimper 2043 of the crimping machine 2041 is lowered. Then, the junction terminal 2030 is guided toward the recessed portion by the inviting surfaces 2043*a* of the crimper 2043. Also at this point, the terminal connecting portion 2021 is kept in the prescribed position against the junction terminal 2030 in the holding space S. Thereafter, the pressing surface 2043*b* of the crimper 2043 comes into contact with upper portions of the crimping pieces 2032*a* of the fastening connecting portion 2032, and thus, the crimping pieces 2032*a* are squashed to start the crimping.

Then, as illustrated in FIG. 15B, the crimping pieces 2032*a* roll up the both sides of the terminal connecting portion 2021, and thereafter, the crimping pieces 2032*a* are crimped so as to externally roll up the engagement walls 2022 of the terminal connecting portion 2021 and the engaging pieces 2022*a* provided at the upper ends thereof.

Thus, as illustrated in FIG. 15C, the engagement walls 2022 having the engaging pieces 2022*a* are curled up to be tightly held inside the crimping pieces 2032*a*, and as a result, the terminal connecting portion 2021 is filled within the fastening connecting portion 2032. Accordingly, the fastening connecting portion 2032 is firmly fastened to the terminal connecting portion 2021 at high contact pressure, and the terminal fitting 2010 and the junction terminal 2030 are definitely electrically connected to each other.

When the respective terminal connecting portions 2021 of the terminal fitting 2010 are respectively fastened and connected to the junction terminals 2030 through the above-described steps, a plurality of ground wires D are electrically connected all together to the terminal fitting 2010. Then, the terminal fitting 2010 is fixed to the grounding surface of a vehicle with a bolt, and thus, the plural ground wires D are grounded.

Reference Example 2-1

Next, Reference Example 2-1 will be described.

Figure 16:
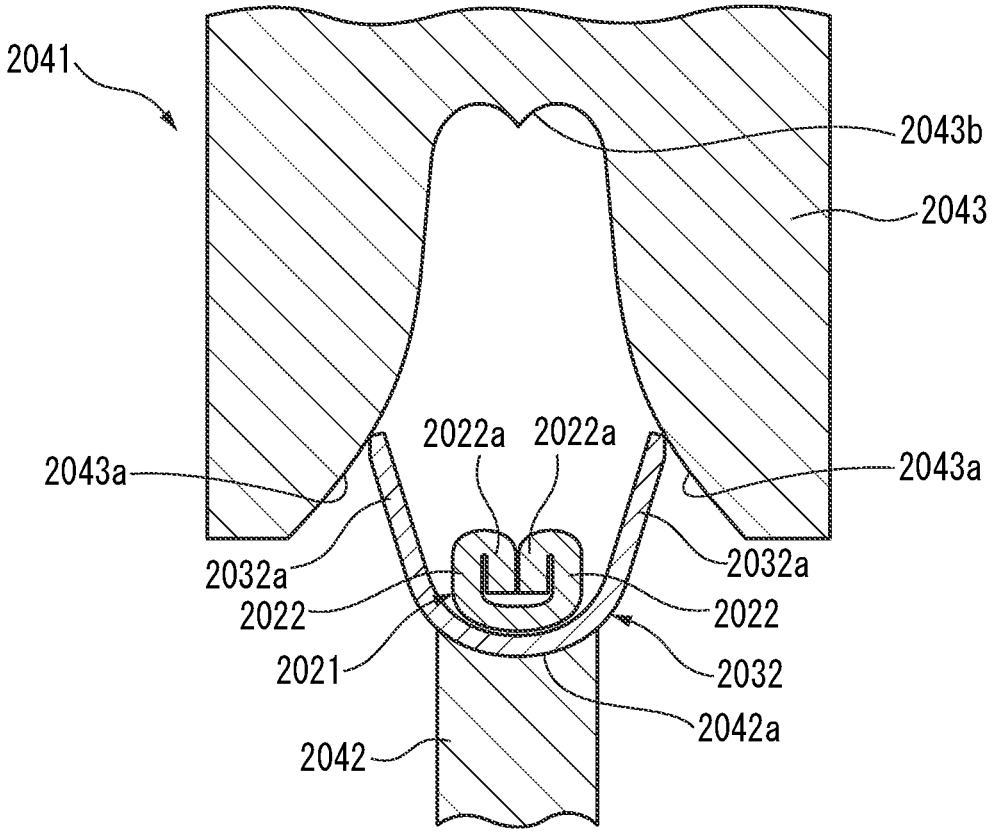
FIG. 16 is a schematic cross-sectional view, for explaining Reference Example 2-1, of a crimping machine in which a junction terminal and a terminal connecting portion are set.
Figure 17A:
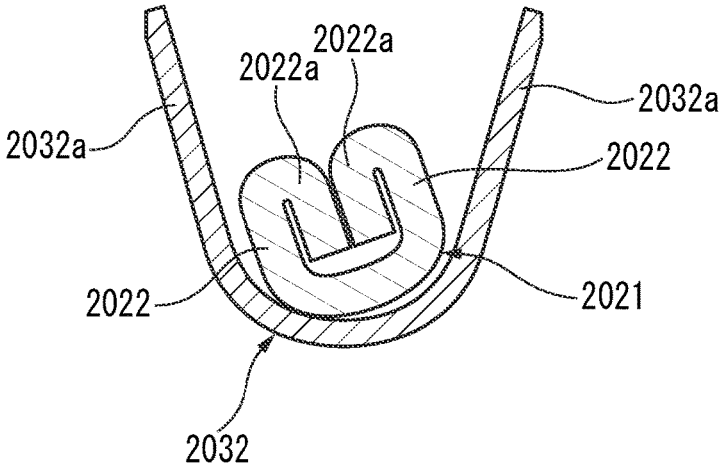
Figure 17B:
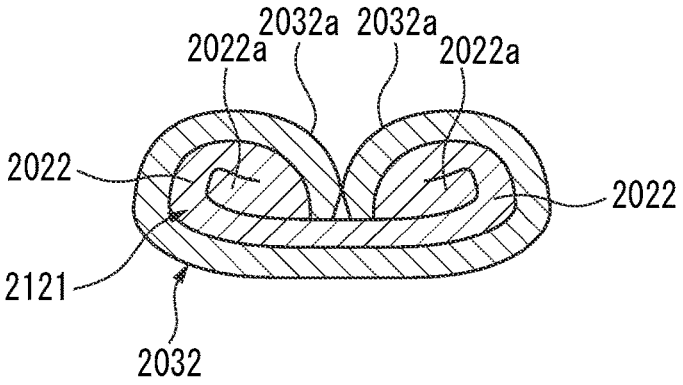

FIG. 16 is a schematic cross-sectional view, for explaining Reference Example 2-1, of a crimping machine in which a junction terminal and a terminal connecting portion are set. FIGS. 17A and 17B are diagrams illustrating fastening states of a terminal connecting portion of a terminal fitting and crimping pieces of a fastening connecting portion of Reference Example 2-1, in which FIG. 17A is a cross-sectional view taken on line G-G of FIG. 7B before fastening with the crimping pieces, and FIG. 17B is cross-sectional view taken on line G-G of FIG. 7B after the fastening with the crimping pieces.

As illustrated in FIG. 16, the crimping pieces 2032*a* of the fastening connecting portion 2032 are in a shape spreading upward to be away from each other in Reference Example 2-1. In the crimping machine 2041 used for crimping the terminal connecting portion 2021 to the junction terminal 2030 having the crimping pieces 2032*a* in this shape, the inviting surfaces 2043*a* guiding the spread crimping pieces 2032*a* toward the recessed portion of the crimper 2043 need to be in a shape widely spreading. Accordingly, the crimping machine 2041 becomes large to disadvantageously occupy a large working space.

Besides, as illustrated in FIG. 17A, when the terminal connecting portion 2021 is inserted and placed in the fastening connecting portion 2032 having the crimping pieces 2032*a* spreading upward, the position of the terminal connecting portion 2021 is not stabilized and the terminal connecting portion 2021 may rotate around the axis along the inserting direction. If the crimping is performed in such a spoiled position, the extent of biting the terminal connecting portion 2021 becomes unbalanced between the crimping pieces 2032*a* as illustrated in FIG. 17B, which may degrade connection reliability due to insufficient fastening and the like.

As described so far, in the connection structure for a terminal fitting according to the present embodiment, the terminal connecting portion 2021 is inserted in the holding space S surrounded by the crimping pieces 2032*a* of the junction terminal 2030, so as to hold the terminal connecting portion 2021 in the junction terminal 2030, and as a result, the crimping pieces 2032*a* can be crimped for fastening with the terminal connecting portion 2021 held in the junction terminal 2030. Thus, the terminal connecting portion 2021 can be kept in a stable position in the fastening, and hence, variation in crimping strength can be suppressed to attain high connection reliability.

Besides, in the connection method for a terminal fitting according to the present embodiment, the terminal connecting portion 2021 is inserted and held in the holding space S precedently formed in the junction terminal 2030, the crimping pieces 2032*a* are squashed for fastening so as to externally roll up the both sides of the terminal connecting portion 2021 in the holding space S, and hence, the fastening can be performed with the position of the terminal connecting portion 2021 against the junction terminal 2030 stabilized. Thus, the workability can be improved, and the variation in the crimping strength can be suppressed to attain high connection reliability. Furthermore, since the holding space S is precedently formed in the junction terminal 2030, the width can be reduced as compared with a case where the crimping pieces 2032*a* are in the shape of U spreading upward (see FIGS. 16 and 17). Thus, in using the crimping machine 2041 for the fastening, components such as the crimper 2043 can be made compact to reduce the working space. As compared with a case where, for example, the crimping pieces 2032*a* are formed in the shape of U spreading upward, the inviting surfaces 2043*a* can be made compact as illustrated in FIG. 14, and hence, the width of the crimper 2043 can be a width W2 greatly smaller than a width W1.

Besides, the terminal connecting portion 2021 inserted in the holding space S is held in the junction terminal 2030 with the rotation around the axis along the inserting direction restricted by the rotation restricting surfaces 2036 corresponding to the side surfaces of the holding space S. As a result, the terminal connecting portion 2021 can be kept in a more stable position against the junction terminal 2030, and hence fastening accuracy can be increased.

In addition, the terminal connecting portion 2021 inserted in the holding space S is held in a stable state on the bottom 2037 of the holding space S curved downward. Thus, the terminal connecting portion 2021 can be kept in a further stable position against the junction terminal 2030, and the fastening accuracy can be increased.

Furthermore, according to the present embodiment, a plurality of ground wires D can be electrically connected all together to the terminal fitting 2010 by connecting the plural ground wires D to the terminal fitting 2010, and as a result, as compared with a structure in which terminal fittings connected to respective ground wires are stacked and fastened for electrical connection, since there is no need to stack the terminal fittings 2010, increase in weight of the terminal fitting 2010 can be suppressed even when the number of ground wires D is increased. Besides, since there is no need to stack the terminal fittings 2010, even if the number of ground wires D to be electrically connected is increased, the thickness of the terminal fitting 2010 is not increased, and hence the space can be saved. In addition, since the junction terminal 2030 is fastened to the terminal connecting portion 2021 of the terminal fitting 2010, there is no need to provide a special holding mechanism for holding the junction terminal 2030. Thus, as compared with a joint connector that needs to have a holding mechanism for holding a terminal in a housing, the size and the cost can be reduced.

Besides, the junction terminal 2030 separately provided is fastened and connected to the terminal fitting 2010 in this structure, and as a result, the junction terminals 2030 connected to ground wires D of different sizes can be fastened to be electrically connected to the terminal connecting portions 2021. In other words, this structure is applicable to ground wires D of various sizes without changing the connection form between the terminal connecting portion

2021 of the terminal fitting 2010 and the fastening connecting portion 2032 of the junction terminal 2030. Besides, if terminal fittings 2010 having different numbers of terminal connecting portions 2021 are prepared, the structure can easily deal with increase/decrease of the number of ground wires D to be electrically connected.

Here, for example, assuming a terminal fitting in which a plurality of connecting portions connectable to ground wires D are integrally formed, a plurality of ground wires D can be electrically connected all together. In such a terminal fitting, however, it is necessary to prepare different terminal fittings correspondingly to the number of ground wires D to be connected. Besides, if the size of a ground wire D is varied, it is necessary to prepare a terminal fitting including a connecting portion in accordance with the size of the ground wire D.

On the contrary, according to the connection structure for a terminal fitting of Embodiment 2-1, change in the number or the size of ground wires D to be electrically connected can be dealt with by minimum variations of the terminal fitting 2010.

In addition, since the junction terminals 2030 are fastened to the plural terminal connecting portions 2021 of the terminal fitting 2010 in this structure, the junction terminals 2030 can be fastened to the terminal connecting portions 2021 as needed, and as a result, the number of ground wires D to be electrically connected all together can be easily increased/decreased within the limit of the number of the terminal connecting portions 2021.

Besides, the engagement walls 2022 to be engaged with the crimping pieces 2032*a* are formed as the both sides of the terminal connecting portion 2021. Accordingly, when the crimping pieces 2032*a* of the junction terminal 2030 are crimped to the terminal connecting portion 2021, the crimping pieces 2032*a* are engaged with the engagement walls 2022 of the terminal connecting portion 2021. As a result, the crimping pieces 2032*a* are definitely crimped to the terminal connecting portion 2021, so as to further increase the connection strength of the terminal connecting portion 2021 to the junction terminal 2030, and electrical resistance in the connection portion can be stabilized to attain good electrical connection.

In particular, the engaging pieces 2022*a* folded inward are formed at the upper ends of the engagement walls 2022 of the terminal connecting portion 2021, the crimping pieces 2032*a* can be definitely crimped to the terminal connecting portion 2021 so as to further increase engagement force with the crimping pieces 2032*a* of the junction terminal 2030, and hence, high connection strength can be definitely obtained. Thus, the electrical resistance in the connection portion can be stabilized to attain good electrical connection.

In addition, the terminal connecting portions 2021 are extended radially on the same plane. Accordingly, with the area occupied by the terminal fitting 2010 suppressed to be as small as possible, a large number of terminal connecting portions 2021 can be provided, and hence, a large number of ground wires D can be connected all together.

Besides, in disassembling the connection structure for a terminal fitting of the present embodiment, when the wire connecting body 2019 linked to the terminal body 2011 via the linking portions 2020 is separated, a plurality of ground wires D can be separated from the terminal body 2011 all together, and thus, good recyclability can be obtained.

In addition, if catching force of the catching pieces 2016*a* of the linking portion 2020 for linking the terminal body 2011 and the wire connecting body 2019 is adjusted to adjust linking strength in accordance with wiring conditions such as the diameter or the number of ground wires D to be connected, connection strength at the time of wiring can be definitely obtained as well as a good separation property can be attained in the disassembly, and hence, durability and recyclability can be both achieved. For example, the linking strength between the terminal body 2011 and the wire connecting body 2019 can be adjusted in a range from strength necessary for the connection to strength realizing good separation (for example, from 100 N to 500 N).

In addition, the terminal connecting portion 2021 is provided with the engagement walls 2022 as the sides thereof to be in a recessed shape in a cross-sectional view, and the engaging piece 2022*a* curved and folded inward in an arc shape is formed at the upper end of each engagement wall 2022 in the above-described embodiment, but the terminal connecting portion 2021 is not limited to the aforementioned cross-sectional shape.

Modification of Embodiment 2-1

Figure 18:
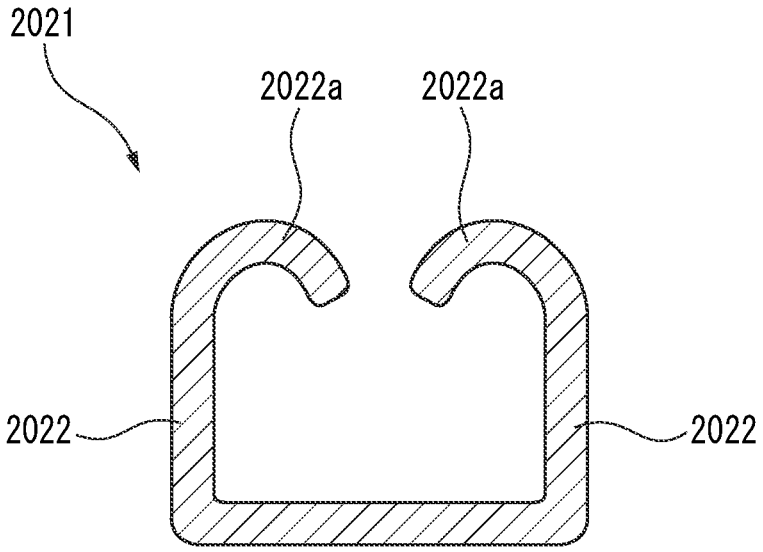
FIG. 18 is a cross-sectional view of the terminal connecting portion in another shape.
Figure 19:
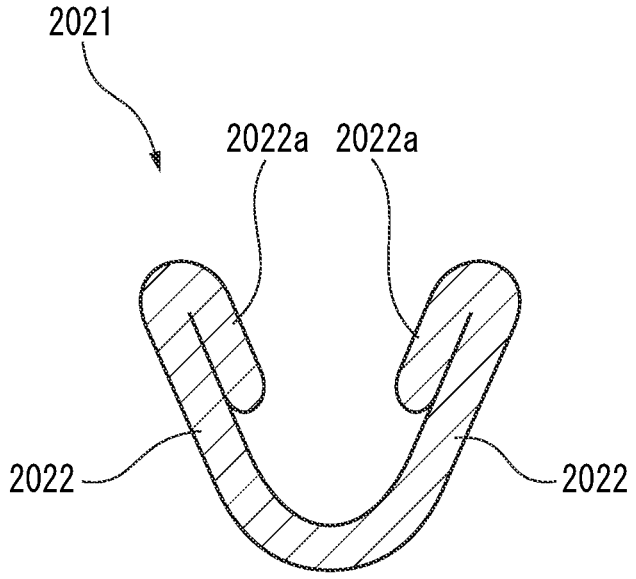
FIG. 19 is a cross-sectional view of the terminal connecting portion in still another shape.
Figure 20:
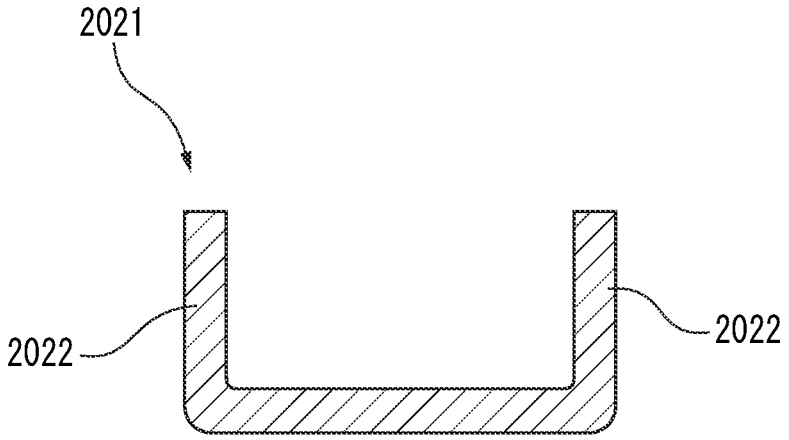
FIG. 20 is a cross-sectional view of the terminal connecting portion in still another shape.

FIGS. 18 to 20 are cross-sectional views of the terminal connecting portion in different shapes.

As illustrated in FIG. 18, the terminal connecting portion 2021 may have a bottom formed in a plate shape. Even if the bottom of the terminal connecting portion 2021 is in such a plate shape, when it is inserted into the holding space S of the junction terminal 2030, its position is stable because the both sides of the terminal connecting portion 2021 are in contact with the rotation restricting surfaces 2036 of the holding space S, and hence it can be crimped in a balanced manner.

Alternatively, as illustrated in FIG. 19, the engagement walls 2022 of the both sides of the terminal connecting portion 2021 may be in the shape of V spreading upward in a cross-sectional view, and the engaging piece 2022*a* curved and folded inward may be formed at the upper end of each engagement wall 2022. Also in employing this shape, high connection strength can be obtained because the crimping pieces 2032*a* can be firmly engaged with the engaging pieces 2022*a* at the upper ends of the engagement walls 2022 of the terminal connecting portion 2021.

In addition, if large proof tensile strength is not required between the terminal connecting portion 2021 and the junction terminal 2030, the terminal connecting portion 2021 may be in a recessed cross-sectional shape having no engaging piece 2022*a* at the upper end of each engagement wall 2022 as illustrated in FIG. 20.

Next, a modification will be described.

It is noted that like reference signs are used to refer to like elements used in Embodiment 2-1 described above to omit the description.

Figure 21:
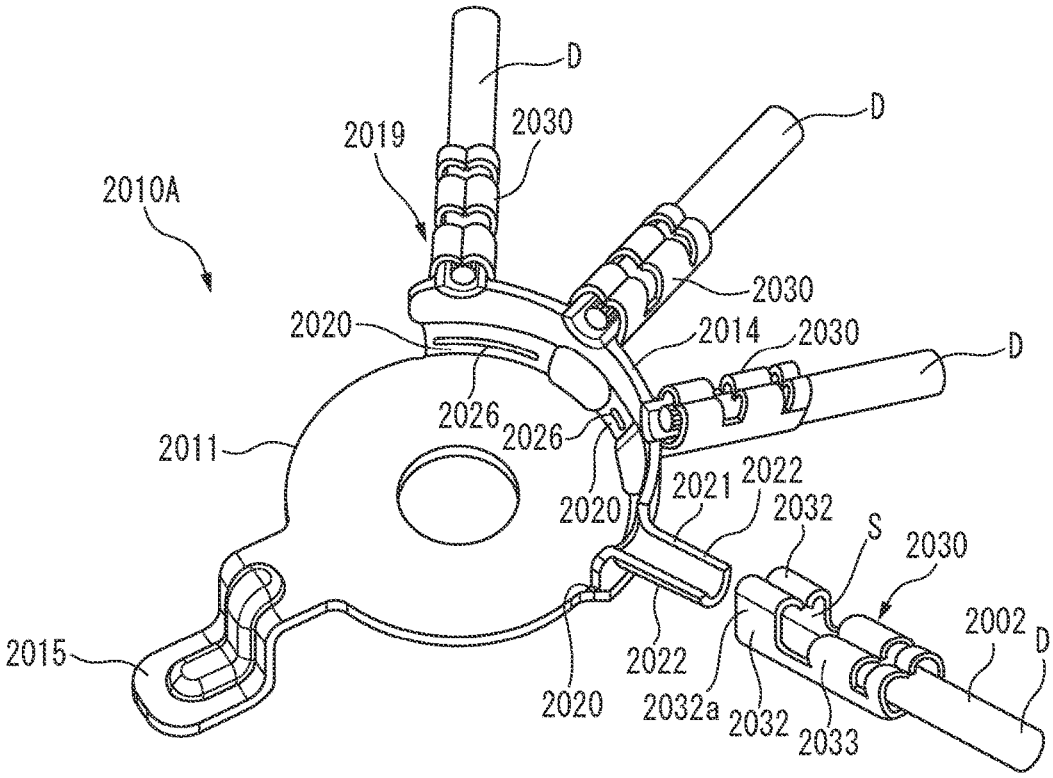
FIG. 21 is a perspective view of a terminal fitting connected to a ground wire for illustrating a connection structure for a terminal fitting according to a modification.
Figure 22A:
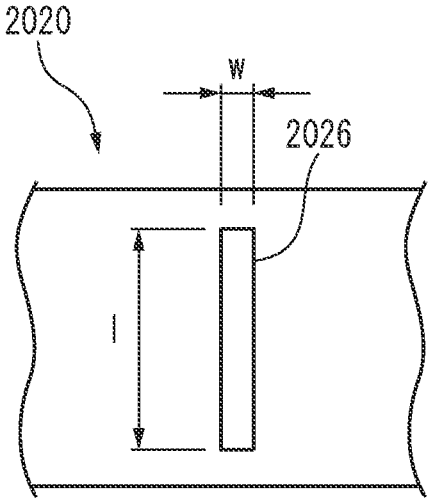
Figure 22B:
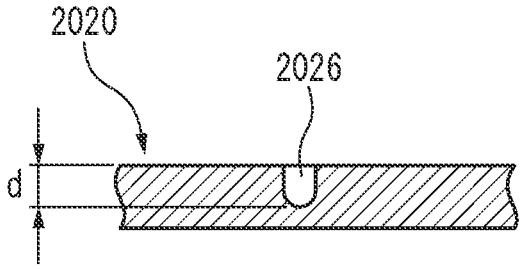

FIG. 21 is a perspective view of a terminal fitting connected to a ground wire for illustrating a terminal fitting and a connection structure therefor according to the modification. FIGS. 22A and 22B are diagrams illustrating a linking portion of the terminal fitting, in which FIG. 22A is a plan view of the liking portion, and FIG. 22B is a cross-sectional view of the linking portion.

As illustrated in FIG. 21, in the terminal fitting 2010A according to the modification, the terminal body 2011 to be fastened to a body of a vehicle is linked to a wire connecting body 2019 connected to a plurality of ground wires D via a plurality of linking portions 2020. In the terminal fitting 2010A, plate-shaped portions integrally linked between the terminal body 2011 and the wire connecting body 2019 correspond to the linking portions 2020.

As illustrated in FIGS. 22A and 22B, in the terminal fitting 2010A, a notch 2026 formed as a groove extending in a width direction is formed in each linking portion 2020 of the plate-shaped portion. In employing the linking portion 2020 having such a notch 2026, tensile force and shear force of the linking portion 2020 can be adjusted by adjusting a depth d, a length l and a width w of the notch 2026. In other words, in the linking portion 2020 having the notch 2026, the linking strength between the terminal body 2011 and the wire connecting body 2019 can be adjusted. It is noted that the linking strength of the linking portion 2020 can be adjusted also by adjusting the width and the thickness of the linking portion 2020.

In employing the terminal fitting 2010A, if the ground wires D are grabbed and pulled in disassembling the vehicle, the linking portions 2020 provided between the terminal body 2011 and the wire connecting body 2019 can be broken when the pulling force reaches a prescribed value (of, for example, 500 N). Thus, the terminal body 2011 fastened to the body of the vehicle is separated from the wire connecting body 2019 connected to the plural ground wires D.

In using the terminal fitting 2010A, if the linking strength of the linking portions 2020 linking the terminal body 2011 and the wire connecting body 2019 to each other is adjusted in accordance with the wiring conditions such as the diameter and the number of the ground wires D to be connected, the connection strength at the time of wiring can be definitely obtained as well as a good separation property can be attained in the disassembly, and hence, the durability and the recyclability can be both achieved.

Besides, when the depth d, the length l and the width w of the notch 2026 formed in the plate-shaped portion corresponding to the linking portion 2020 are adjusted, the linking strength between the terminal body 2011 and the wire connecting body 2019 can be very easily adjusted.

In addition, although Embodiment 2-1 has been described above assuming that the terminal fitting 2010 has four terminal connecting portions 2021, the number of the terminal connecting portions 2021 of the terminal fitting 2010 is not limited to four as long as it is plural.

Embodiment 2-2

Next, a connection structure for a terminal fitting according to Embodiment 2-2 will be described. It is noted that this structure is substantially the same as that of Embodiment 2-1 except for a terminal fitting, and hence like reference signs are used to omit the description.

Figure 23A:
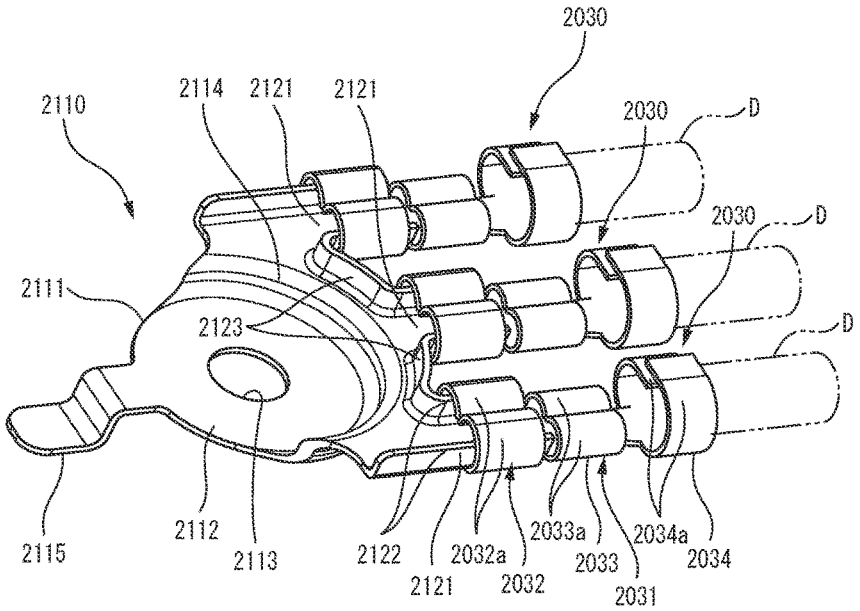
Figure 23B:
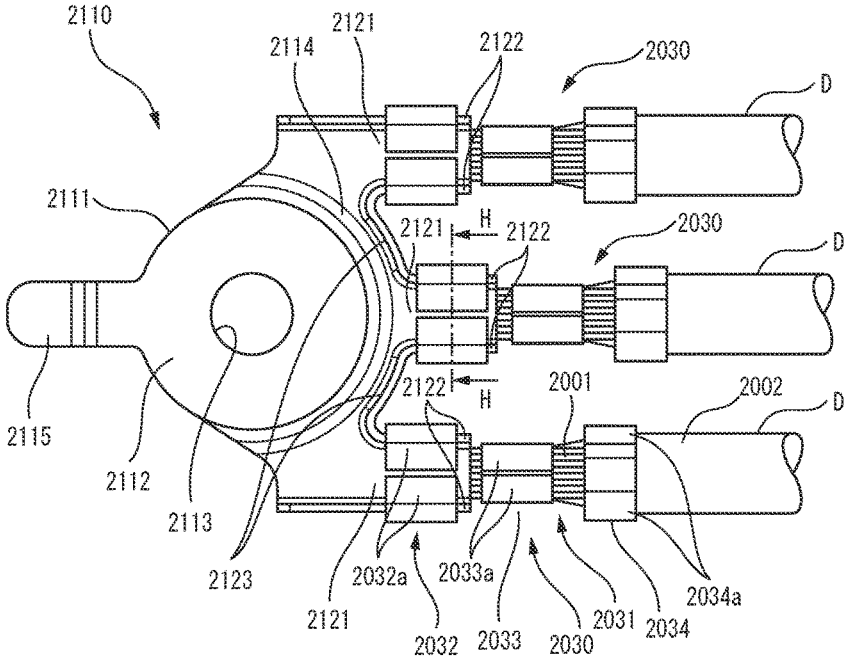
Figure 24A:
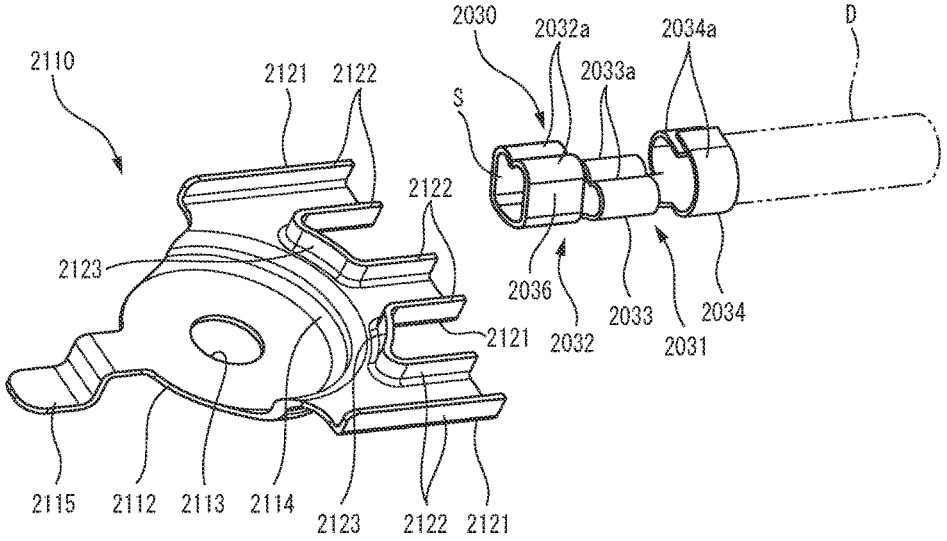
Figure 24B:
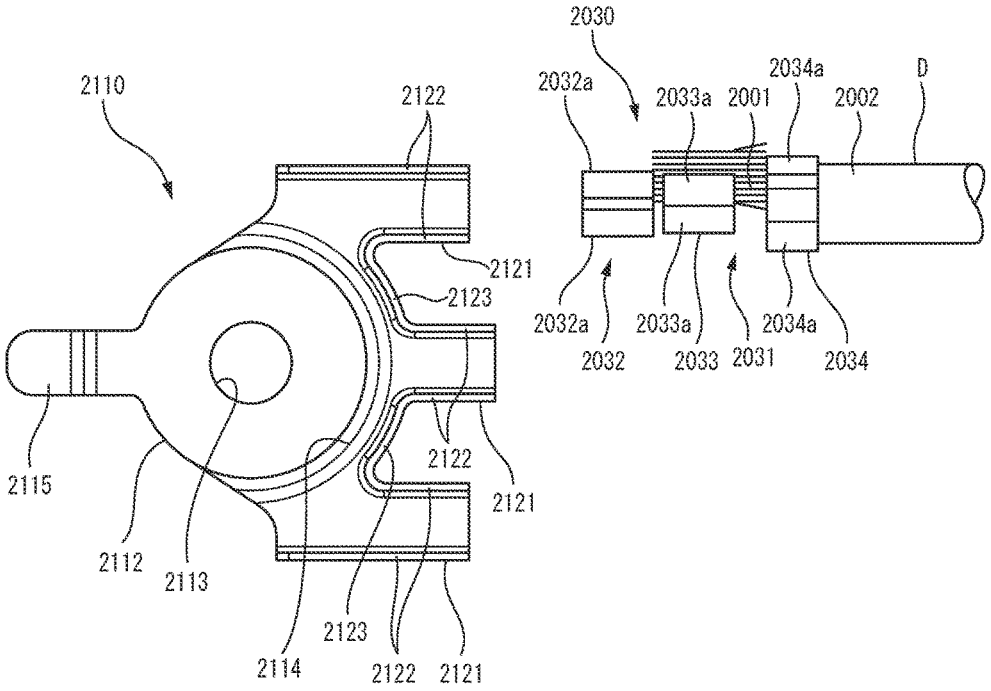

FIGS. 23A and 23B are diagrams explaining the connection structure for a terminal fitting according to Embodiment 2-2, in which FIG. 23A is a perspective view of a terminal fitting connected to a ground wire, and FIG. 23B is a plan view of the terminal fitting connected to the ground wire. FIGS. 24A and 24B are diagrams explaining the connection structure for a terminal fitting according to Embodiment 2-2, in which FIG. 24A is a perspective view of the terminal fitting and a junction terminal, and FIG. 24B is a plan view of the terminal fitting and the junction terminal.

As illustrated in FIGS. 23A, 23B, 24A and 24B, in the connection structure for a terminal fitting of the present embodiment, the terminal fitting 2110 and the junction terminal 2030 are connected to each other. The terminal fitting 2110 is also electrically connected to a grounding surface such as a body of a vehicle. Thus, a ground wire D of an in-vehicle circuit and the grounding surface such as a body of a vehicle are electrically connected to each other via the terminal fitting 2110. The terminal fitting 2030 is connected to a ground wire D of a size of, for example, 8 sq. (square millimeter).

Figure 25A:
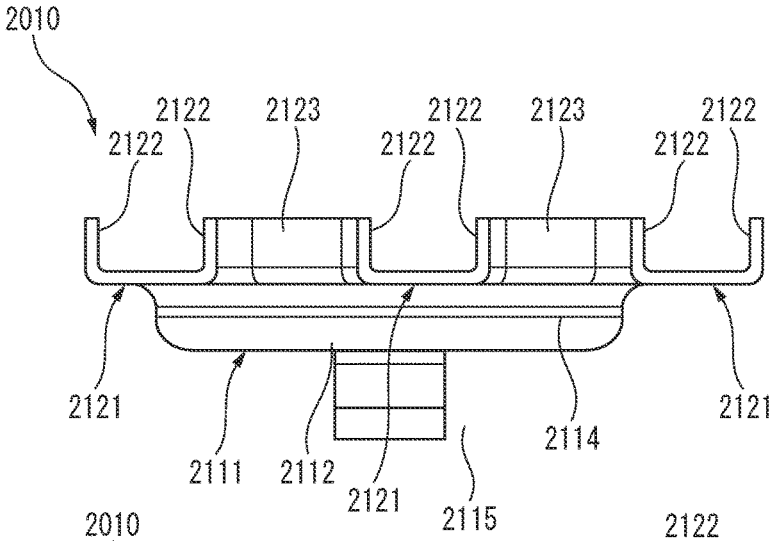
Figure 25B:
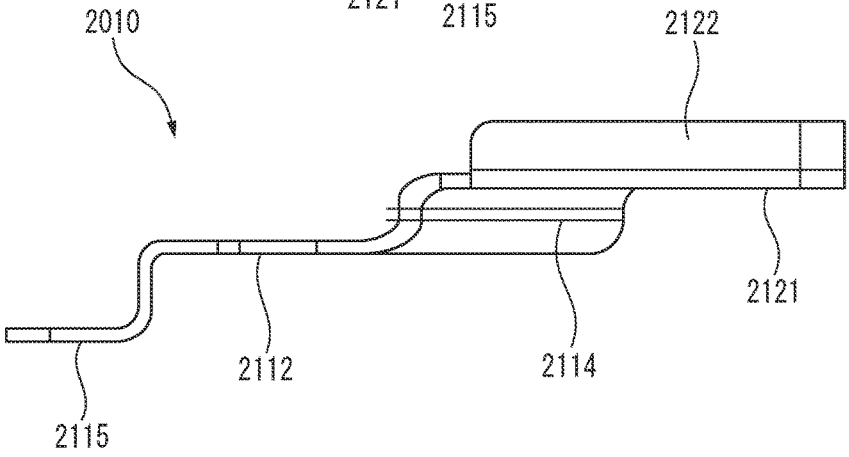
Figure 25C:
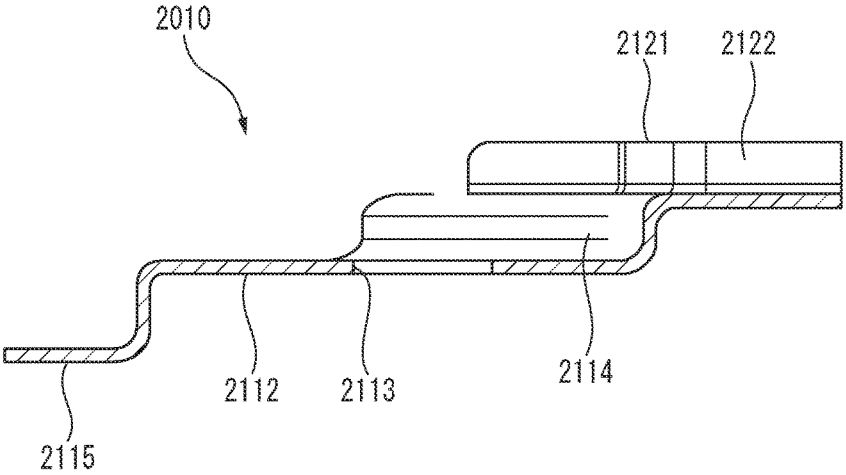
Figure 26A:
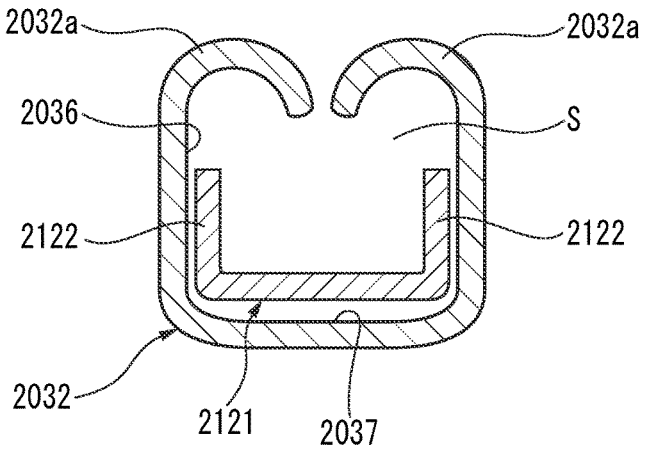
Figure 26B:
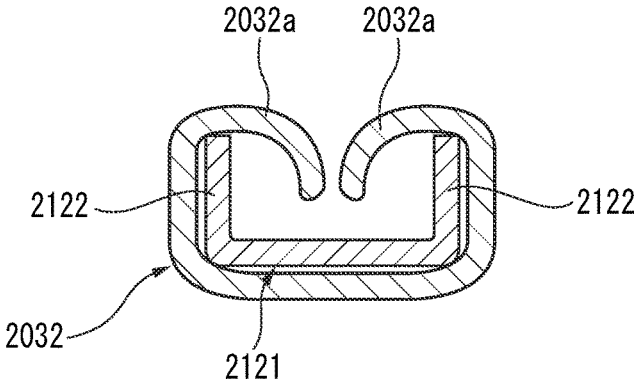
Figure 26C:
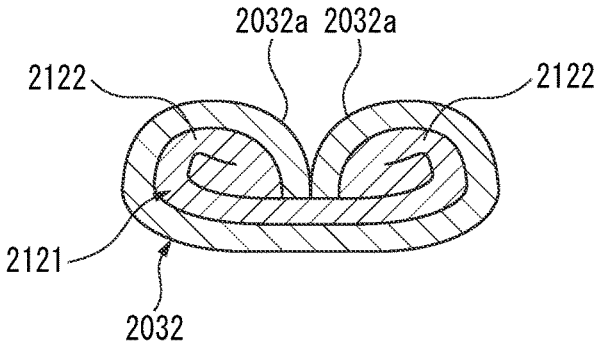

FIGS. 25A to 25C are diagrams explaining the terminal fitting, in which the FIG. 25A is a front view thereof, FIG. 25B is a side view thereof, and FIG. 25C is a cross-sectional view thereof. FIGS. 26A to 26C are diagrams illustrating fastening states of crimping pieces a fastening connecting portion to a terminal connecting portion of the terminal fitting, in which FIG. 26A is a cross-sectional view taken on line H-H of FIG. 23B before fastening with the crimping pieces, FIG. 26B is a cross-sectional view taken on line H-H of FIG. 23B during the fastening with the crimping pieces, and FIG. 26C is a cross-sectional view taken on line H-H of FIG. 23B after the fastening with the crimping pieces.

As illustrated in FIGS. 25A to 25C, the terminal fitting 2110 includes a terminal body 2111 and a terminal connecting portion 2121. The terminal fitting 2110 is a pressed product of a conductive metal plate. The terminal body 2111 has a fixing plate 2112 in a circular shape in a plan view. This fixing plate 2112 has a circular attaching hole 2113 formed at the center thereof. The terminal body 2111 is fixed to the grounding surface such as a body of a vehicle with a bolt (not illustrated) inserted through the attaching hole 2113 of the fixing plate 2112. It is noted that the attaching hole 2113 may be provided eccentrically instead of at the center of the fixing plate 2112.

In substantially a half of the periphery of the fixing plate 2112, a connecting plate 2114 is formed. The connecting plate 2114 projects toward one surface side, namely, the upper surface side. Thus, a step is formed between the fixing plate 2112 and the connecting plate 2114. Besides, in a portion of the fixing plate 2112 where the connecting plate 2114 is not provided, a rotation stopper piece 2115 is formed in a center position in the peripheral direction. The rotation stopper piece 2115 is a folded portion to be engaged with a step or a hole formed around the grounding surface to which the terminal body 2111 is fastened with the bolt, and the rotation of the terminal fitting 2110 on the grounding surface is restricted with this rotation stopper piece 2115 engaged with the step or the hole formed around the grounding surface.

The terminal connecting portions 2121 are formed integrally with the connecting plate 2114 of the terminal body 2111. A plurality of terminal connecting portions 2121 are provided in the connecting plate 2114. Specifically, three terminal connecting portions 2121 are formed in the connecting plate 2114. These terminal connecting portions 2121 are extended to protrude, on the same plane, from the periphery of the fixing plate 2112 in the same direction, and are disposed at intervals in the width direction. It is noted that the center terminal connecting portion 2121 is protruded in the extending direction beyond the terminal connecting portions 2121 disposed on the both sides.

Each terminal connecting portion 2121 has, as both sides thereof, engagement walls 2122 protruding toward one surface side, namely, the upper surface side. Thus, each terminal connecting portion 2121 is formed in a recessed shape in a front view. It is noted that the engagement walls 2122 of the terminal connecting portions 2121 adjacent to each other are formed continuously to a peripheral wall 2123 formed on the side of the fixing plate 2112.

For connecting the ground wire D to the terminal fitting 2110, the sheath 2002 is first removed at the end of the ground wire D to expose the conductor portion 2001. Then, with the end of the ground wire D disposed on the wire connecting portion 2031 of the junction terminal 2030 having been separated from the carrier 2035, the conductor crimping portion 2033 is crimped and the sheath crimping portion 2034 is crimped. Thus, the ground wire D is connected to the junction terminal 2030.

Subsequently, the terminal connecting portion 2121 of the terminal fitting 2110 is inserted into and temporarily fixed in the holding space S of the fastening connecting portion 2032 of the junction terminal 2030 having been connected to the ground wire D, and then the crimping pieces 2032*a* are crimped.

Here, if the crimping pieces 2032*a* are crimped, as illustrated in FIG. 26A, with the terminal connecting portion 2121 of the terminal fitting 2110 disposed in the holding space S of the fastening connecting portion 2032 of the junction terminal 2030, the crimping pieces 2032*a* roll up the both sides of the terminal connecting portion 2121 of the terminal body 2111 at the beginning of the crimping as illustrated in FIG. 26B.

Thereafter, as illustrated in FIG. 26C, the crimping pieces 2032*a* are crimped so as to externally roll up the engagement walls 2122 of the terminal connecting portion 2121, and thus, the engagement walls 2122 are curled up to be tightly held inside the crimping pieces 2032*a*, and the terminal connecting portion 2121 is filled within the fastening connecting portion 2032. Also in this case, the terminal connecting portion 2121 is kept in a prescribed position in the holding space S against the junction terminal 2030. Accordingly, the fastening connecting portion 2032 is firmly fastened to the terminal connecting portion 2021 at high contact pressure, and the terminal fitting 2110 and the junction terminal 2030 are crimped in a balanced manner to be definitely electrically connected to each other.

The junction terminal 2030 is fastened to each of the terminal connecting portions 2121 of the terminal fitting 2110 in the above-described manner. Thus, the plural ground wires D are electrically connected all together to the terminal fitting 2110. Then, the terminal fitting 2110 is fixed to the grounding surface of a vehicle with a bolt so as to ground the plural ground wires D.

As described so far, also in Embodiment 2-2, the terminal connecting portion 2121 is inserted in the holding space S surrounded by the crimping pieces 2032*a* of the junction terminal 2030, and thus, the terminal connecting portion 2121 is held in the junction terminal 2030, and as a result, the crimping pieces 2032*a* can be crimped for the fastening with the terminal connecting portion 2121 held in the junction terminal 2030. As a result, the terminal connecting portion 2121 can be kept in a stable position in the fastening, and hence, the variation in the crimping strength can be suppressed and high connection reliability can be attained.

Besides, since the fastening can be performed with the position of the terminal connecting portion 2121 against the junction terminal 2030 stabilized, the workability can be improved, and the variation in the crimping strength can be suppressed to attain high connection reliability. Furthermore, since the holding space S is precedently formed in the junction terminal 2030, the width can be reduced as compared with a case where the crimping pieces 2032*a* are in the shape of U spreading upward. Thus, in using the crimping machine 2041 for the fastening, components such as the crimper 2043 can be made compact to reduce the working space.

Besides, also in employing the connection structure for a terminal fitting according to Embodiment 2-2, when the junction terminal 2030 connected a ground wire D is crimped and fastened to each terminal connecting portion 2121 of the terminal fitting 2110, a plurality of ground wires D can be electrically connected all together to the terminal fitting 2110 definitely and with high connection reliability.

Furthermore, in the same manner as in Embodiment 2-1, when the crimping pieces 2032*a* of the junction terminals 2030 connected to the plural ground wires D are crimped to the plural terminal connecting portions 2121 of the terminal fitting 2110, a plurality of ground wires D can be electrically connected all together to the terminal fitting 2010 by fastening the junction terminal 2030 to the terminal fitting 2110. Thus, as compared with a structure in which terminal fittings connected to respective ground wires are stacked and fastened for electrical connection, since there is no need to stack the terminal fittings 2110, the increase in weight of the terminal fitting can be suppressed even when the number of ground wires is increased. Besides, since there is no need to stack the terminal fittings, even if the number of ground wires to be electrically connected is increased, the thickness is not increased, and hence the space can be saved. In addition, since the junction terminal 2030 is fastened to the terminal connecting portion 2121 of the terminal fitting 2110, there is no need to provide a special holding mechanism for holding the junction terminal 2030. Thus, as compared with a joint connector that needs to have a holding mechanism for holding a terminal in a housing, the size and the cost can be reduced.

Besides, the junction terminal 2030 separately provided is fastened and connected to the terminal fitting 2110 in this structure, the junction terminals 2030 connected to ground wires D of different sizes can be fastened to be electrically connected to the terminal connecting portions 2021. In other words, this structure is applicable to ground wires D of various sizes without changing the connection form between the terminal connecting portion 2121 of the terminal fitting 2110 and the fastening connecting portion 2032 of the junction terminal 2030. Besides, if terminal fittings 2110 having different numbers of terminal connecting portions 2121 are prepared, the structure can easily deal with the increase/decrease of the number of ground wires D to be electrically connected.

In other words, also in employing the connection structure for a terminal fitting according to Embodiment 2-2, change in the number or the size of ground wires D to be electrically connected can be dealt with by minimum variations of the terminal fitting 2110.

In addition, since the junction terminals 2030 are fastened to the plural terminal connecting portions 2121 of the terminal fitting 2110 in this structure, the junction terminals 2030 can be fastened to the terminal connecting portions 2121 as needed, and as a result, the number of ground wires D to be electrically connected all together can be easily increased/decreased within the limit of the number of the terminal connecting portions 2121.

Besides, the engagement walls 2122 to be engaged with the crimping pieces 2032*a* are formed as the both sides of the terminal connecting portion 2121. Accordingly, when the crimping pieces 2032*a* of the junction terminal 2030 are crimped to the terminal connecting portion 2121, the crimping pieces 2032*a* are engaged with the engagement walls 2122 of the terminal connecting portion 2121. Thus, the crimping pieces 2032*a* are definitely crimped to the terminal connecting portion 2121, so as to further increase the connection strength of the terminal connecting portion 2121 to the junction terminal 2030, and the electrical resistance in the connection portion can be stabilized to attain good electrical connection.

In addition, the terminal connecting portions 2121 are extended on the same plane in the same direction at intervals. Accordingly, a direction for connecting the junction terminal 2030 to the terminal fitting 2110 and a wiring direction of the ground wire D can be the same, and hence, the workability in fastening the junction terminal 2030 to the terminal connecting portion 2121 of the terminal fitting 2110 can be improved. Besides, the wiring directions of the ground wires D can be aligned in the same direction along a trunk line, and in addition, unwanted spread of the ground wires D and bending of the ground wires D in the vicinity of the junction terminals 2030 can be minimized.

Furthermore, also in the terminal connecting portion 2121 of the terminal fitting 2010 of Embodiment 2-2, an engaging piece may be formed at the upper end of each engagement wall 2122 as in Embodiment 2-1, and the cross-sectional shape of the engagement walls may be in the shape of V.

Although the terminal fitting 2010 has three terminal connecting portions 2121 in the above-described exemplified case, the number of the terminal connecting portions 2121 of the terminal fitting 2010 is not limited to three as long as it is plural.

Modification of Embodiment 2-2

Next, as a modification of Embodiment 2-2, a connection structure for a terminal fitting including a different number of terminal connecting portions 2121 will be described. It is noted that like reference signs are used to refer to like elements used in the above-described embodiment to omit the description.

Figure 27A:
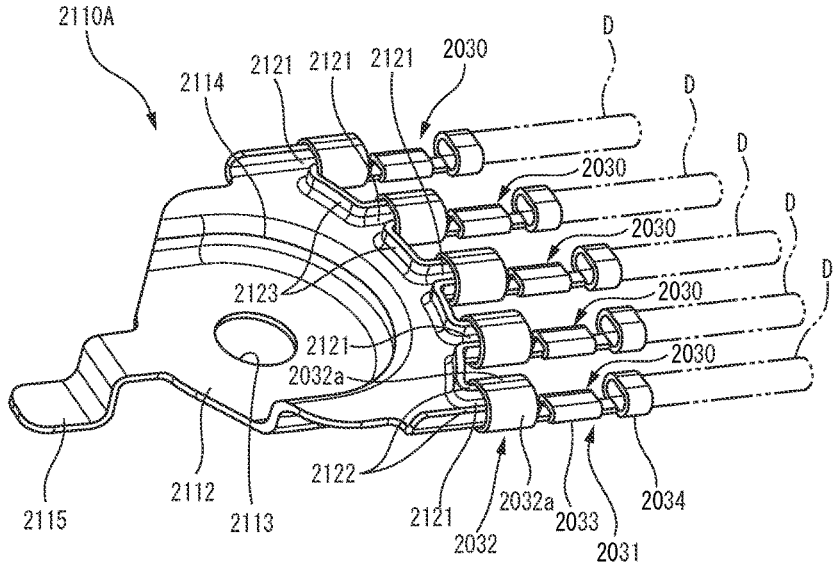
Figure 27B:
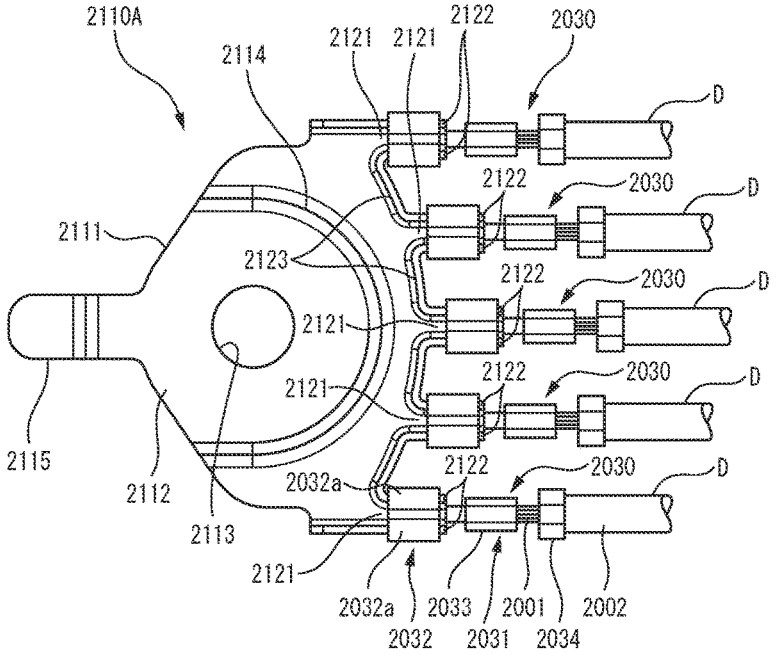
Figure 28A:
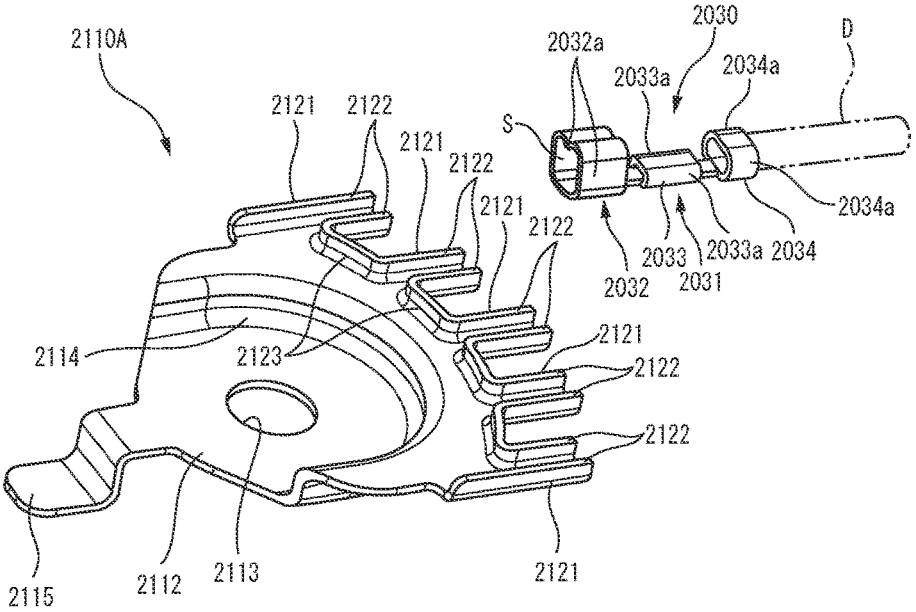
Figure 28B:
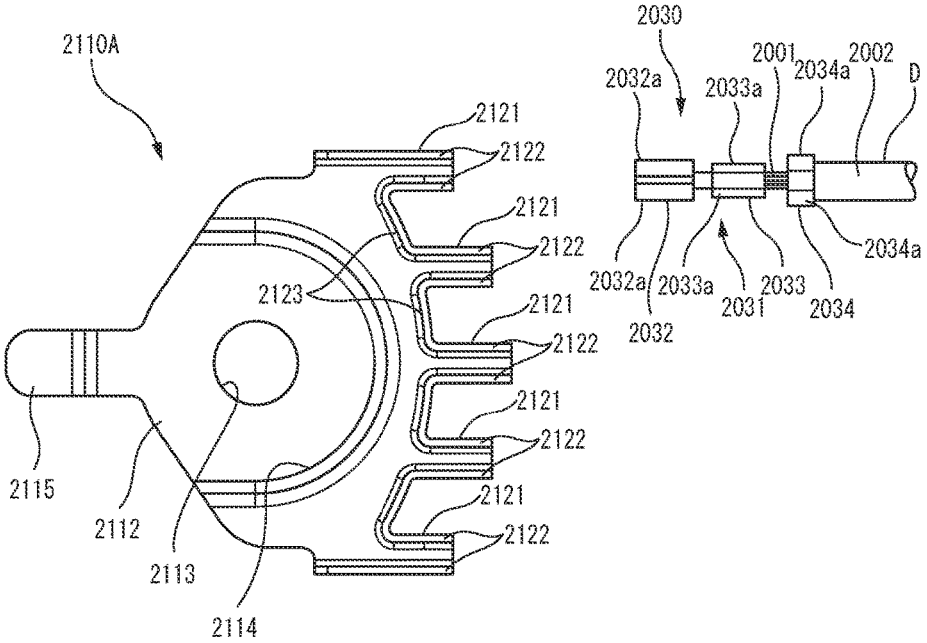

FIGS. 27A and 27B are diagrams explaining a connection structure for a terminal fitting according to a modification of Embodiment 2-2, in which FIG. 27A is a perspective view of a terminal fitting connected to a ground wire, and FIG. 27B is a plan view of the terminal fitting connected to the ground wire. FIGS. 28A and 28B are diagrams explaining the connection structure for a terminal fitting according to the modification of Embodiment 2-2, in which FIG. 28A is a perspective view of the terminal fitting and a junction terminal, and FIG. 28B is a plan view of the terminal fitting and the junction terminal.

As illustrated in FIGS. 27A, 27B, 28A and 28B, this terminal fitting 2110A has five terminal connecting portions 2121. These terminal connecting portions 2121 are also extended in the same direction and are disposed at intervals in the width direction. Besides, the junction terminal 2030 is also fastened to each of the terminal connecting portions 2121 of this terminal fitting 2110A for connection to a ground wire D. The junction terminal 2030 is connected to a ground wire D of a size smaller than 8 sq., for example, a size of 0.5 sq.

Thus, when the terminal fitting 2110A having the five terminal connecting portions 2121 is used, a larger number of ground wires D of a smaller size can be electrically connected all together to be grounded.

In addition, in Embodiments 1 and 2-2 described above, the ground wires D of the in-vehicle circuit (the auxiliary device) are connected to the terminal fitting 2010, 2010A, 2110 or 2110A to be grounded all together, but a wire to be connected to the terminal fitting 2010, 2010A, 2110 or 2110A is not limited to a wire for grounding.

Besides, instead of providing the rotation stopper piece 2015 or 2115 to the terminal body 2011 or 2111 of the terminal fitting 2010, 2010A, 2110 or 2110A, a step or a rotation stopper piece to be brought into contact with and stop rotation of the terminal fitting 2010, 2010A, 2110 or 2110A when the terminal fitting 2010, 2010A, 2110 or 2110A is attached onto the grounding surface may be provided on the side of the grounding surface.

Embodiment 3-1

As a terminal fitting used for grounding an earth wire, a terminal fitting in which a fixing member fastening portion having a through hole for attaching a fixing member, and at least two or more wire connecting portions are integrally formed, and an easily breakable portion is provided between the fixing member fastening portion and the two or more wire connecting portions is known (see, for example, JP 2003-178824 A).

In using the above-described terminal fitting, a plurality of wires can be separated at the same time in disassembly by breaking a portion between the fastening portion and the plural wire connecting portions by pulling up the plural wires.

On the other hand, wires having various diameters are used as earth wires. Besides, in a wire harness for a vehicle, an earth wire is required to be definitely grounded even when vibration occurs during drive of the vehicle or the like. As a result, a terminal fitting for earthing is required to have sufficient strength so as not to be easily broken, and is required to be recycled after separating a plurality of wires therefrom at the same time in the disassembly. In other words, a terminal fitting for earthing is required not only to be easily disassembled but also to have linking strength, in a linking portion between a fastening portion and a plurality of wires, adjustable in accordance with wiring conditions such as the number and the diameter of wires to be connected and whether or not vibration occurs.

In the terminal fitting having the above-described structure in which the groove-shaped easily breakable portion is simply formed between the fixing member fastening portion and the plural wire connecting portions, however, the linking strength is difficult to adjust in accordance with the wiring conditions, and as a result, it is difficult to attain both durability and recyclability.

In consideration of these circumstances, an embodiment of the connection structure for a terminal fitting of the present invention can be configured so that a plurality of wires can be separated all together in disassembly, and in addition, both durability and recyclability can be attained regardless of wiring conditions.

Figure 29A:
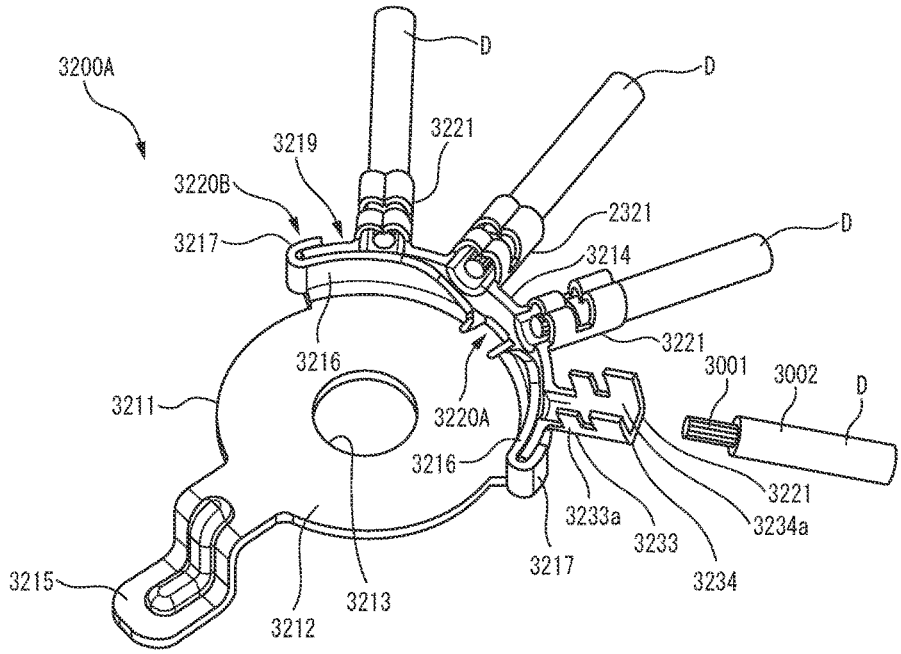
Figure 29B:
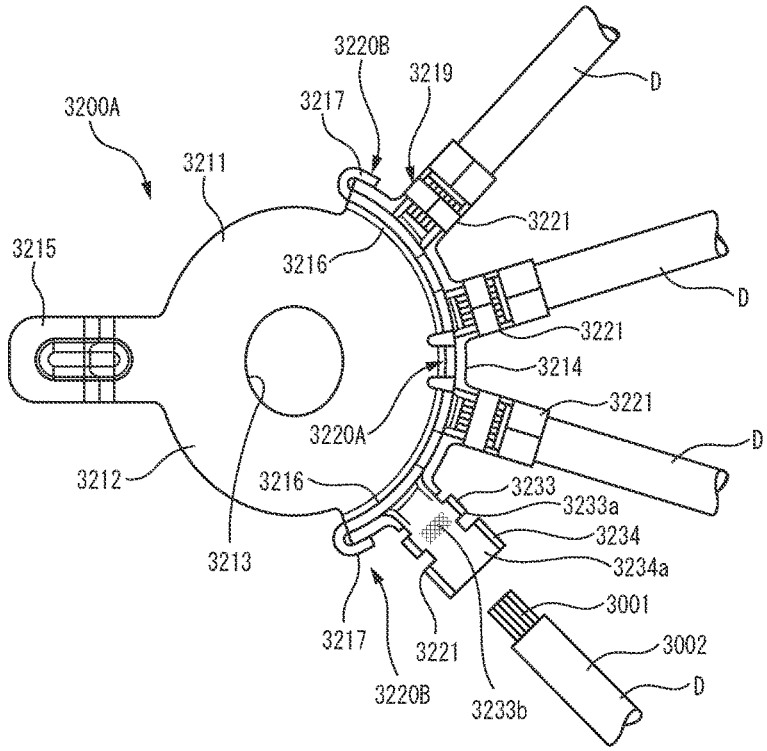

Specifically, FIGS. 29A and 29B are diagrams explaining a terminal fitting and a connection structure therefor according to Embodiment 3-1, in which FIG. 29A is a perspective view of the terminal fitting connected to a ground wire, and FIG. 29B is a plan view of the terminal fitting connected to the ground wire.

As illustrated in FIGS. 29A and 29B, the terminal fitting 3200A of Embodiment 3-1 is connected to a plurality of (four, in this embodiment) ground wires D. The terminal fitting 3200A is electrically connected to a grounding surface such as a body of a vehicle. Each ground wire D connected to this terminal fitting 3200A is a ground wire of an in-vehicle circuit (an auxiliary device). The ground wire D includes a conductor portion 3001 and a sheath 3002 covering the conductor portion 3001, and the conductor portion 3001 is exposed from the sheath 3002 at an end thereof to be connected to the terminal fitting 3200A. The conductor portion 3001 of the ground wire D is electrically connected to the terminal fitting 3200A. Thus, the ground wire D of the in-vehicle circuit is electrically connected to the grounding surface such as a body of a vehicle via the terminal fitting 3200A.

The terminal fitting 3200A includes a terminal body 3211, and a wire connecting body 3219 having a plurality of wire connecting portions 3221. The terminal fitting 3200A is a pressed product of a conductive metal plate. The terminal body 3211 has a fixing plate 3212 in a circular shape in a plan view. This fixing plate 3212 has a circular attaching hole 3213 formed at the center thereof. The terminal body 3211 is fixed to the grounding surface such as a body of a vehicle with a bolt (not illustrated) inserted through the attaching hole 3213 of the fixing plate 3212. It is noted that the attaching hole 3213 may be provided eccentrically instead of at the center of the fixing plate 3212.

A rotation stopper piece 3215 is formed in a part of the fixing plate 3212. The rotation stopper piece 3215 is a folded portion to be engaged with a step or a hole formed around the grounding surface to which the terminal body 3211 is fastened with the bolt, and the rotation of the terminal fitting 3200A on the grounding surface is restricted with this rotation stopper piece 3215 engaged with the step or the hole formed around the grounding surface.

The fixing plate 3212 has, on its periphery, two supporting walls 3216 each in an arc shape in a plan view. These supporting walls 3216 are provided to rise toward one surface side, namely, toward the upper surface side, of the fixing plate 3212. Besides, the wire connecting body 3219 has, in substantially a half of the periphery of the fixing plate 3212, a connecting plate 3214 in an arc shape in a plan view. The connecting plate 3214 is provided to rise toward one surface side, namely, toward the upper surface side, of the fixing plate 3212. The connecting plate 3214 is disposed along the outer circumferences of the supporting walls 3216.

Figure 30:
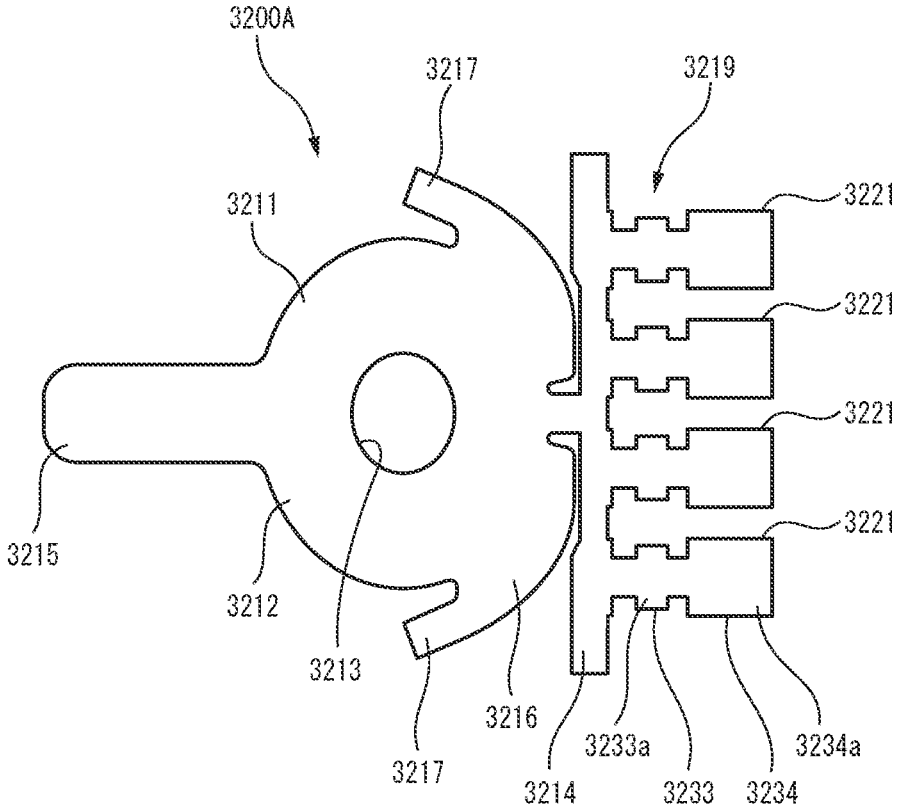
FIG. 30 is a development view of the terminal fitting of Embodiment 3-1 before bending.

FIG. 30 is a development view of the terminal fitting of Embodiment 3-1 before bending.

As illustrated in FIG. 30, in the terminal fitting 3200A in a plane state obtained by punching a metal plate, a portion corresponding to the terminal body 3211 and a portion corresponding to the wire connecting body 3219 are integrally linked to each other in parts thereof. When the terminal fitting 3200A in this plane state is subjected to bending, the supporting walls 3216 are caused to rise on the side of the terminal body 3211, and the connecting plate 3214 is formed, on the side of the wire connecting body 3219, along the supporting walls 3216.

In this manner, in the terminal fitting 3200A formed through the bending, end portions of the supporting walls 3216 are folded to the side of the connecting plate 3214, and these folded portions correspond to catching pieces 3217. Both ends of the connecting plate 3214 are caught by the catching pieces 3217 on the supporting walls 3216.

Thus, in the terminal fitting 3200A, a portion integrally linked between the terminal body 3211 and the wire connecting body 3219 corresponds to a linking portion 3220A, and portions where the both ends of the connecting plate 3214 are caught by the catching pieces 3217 of the supporting walls 3216 correspond to linking portions 3220B. In other words, the terminal fitting 3200A includes a plurality of linking portions 3220A and 3220B, and the terminal body 3211 and the wire connecting body 3219 are mutually linked via these plural linking portions 3220A and 3220B.

Figure 31A:
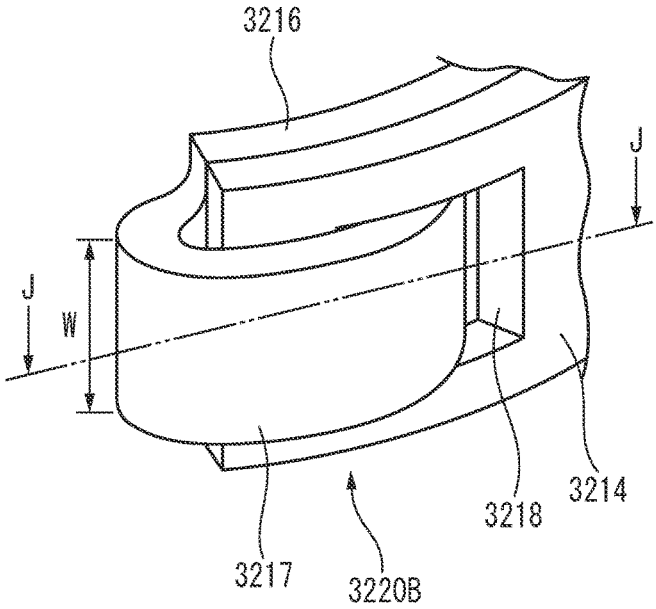
Figure 31B:
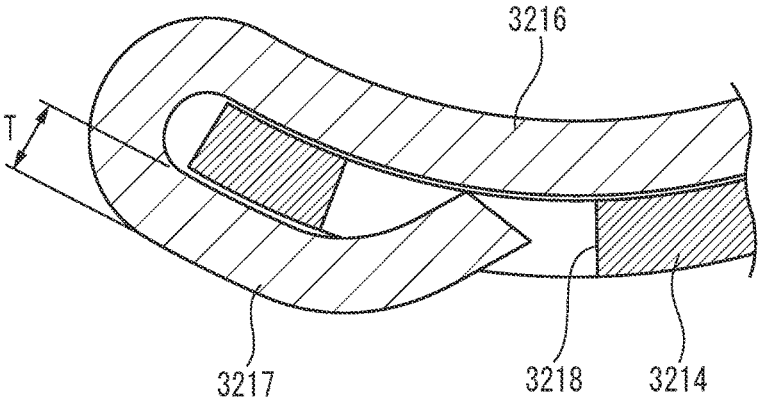

FIGS. 31A and 31B are diagrams illustrating the linking portion of the terminal fitting, in which FIG. 31A is a perspective view of the linking portion and FIG. 31B is a cross-sectional view taken on line J-J of FIG. 31A. As illustrated in FIGS. 31A and 31B, a window portion 3218 is formed in the vicinity of each end of the connecting plate 3214 of the wire connecting body 3219, and the catching piece 3217 formed in the supporting wall 3216 of the terminal body 3211 is inserted in the window portion 3218.

Each linking portion 3220B links the terminal body 3211 and the wire connecting body 3219 to each other by using catching force of the catching piece 3217, and the catching force can be adjusted by adjusting the width W and the thickness T of the catching piece 3217 and the extent of its insertion into the window portion 3218. In other words, among the linking portions 3220A and 3220B linking the terminal body 3211 and the wire connecting body 3219 to each other in the terminal fitting 3200A, each linking portion 3220B has a liking strength adjusting function. In particular, the linking strength for linking the terminal body 3211 upward of the wire connecting body 3219 is increased by inserting the catching piece 3217 into the window portion 3218 in the linking portion 3220B. In addition, if there is no need to increase the linking strength for the terminal body 3211 upward of the wire connecting body 3219, the catching piece 3217 may be simply folded to be caught on the connecting plate 3214 without forming the window portion 3218.

The wire connecting portion 3221 is formed integrally with the connecting plate 3214 of the wire connecting body 3219. A plurality of wire connecting portions 3221 are provided in an upper edge portion of the connecting plate 3214. Specifically, four wire connecting portions 3221 are formed in the connecting plate 3214. These wire connecting portions 3221 are extended, on the same plane, to protrude radially from a peripheral portion of the fixing plate 3212.

Each wire connecting portion 3221 has a conductor crimping portion 3233 and a sheath crimping portion 3234. The conductor crimping portion 3233 has a pair of conductor crimping pieces 3233*a*, and the conductor portion 3001 of the ground wire D is crimped and fixed in the conductor crimping portion 3233 by crimping the conductor crimping pieces 3233*a*. Thus, the conductor portion 3001 of the ground wire D is electrically connected to the terminal fitting 3200A. Besides, the conductor crimping portion 3233 has, on an inner surface thereof, a rough surface portion (a serration) 3233*b* roughened by machining is provided. Thus, the conductor portion 3001 of the ground wire D crimped in the conductor crimping portion 3233 is definitely electrically connected to the terminal fitting 3200A. The sheath crimping portion 3234 is formed in the shape of U having a pair of sheath crimping pieces 3234*a*, and a tip portion of the sheath 3002 of the ground wire D is crimped and fixed in the sheath crimping portion 3234 by crimping these sheath crimping pieces 3234*a*.

A plurality of ground wires D connected to the respective wire connecting portions 3221 are electrically connected all together to the terminal fitting 3200A. When the terminal fitting 3200A is fixed to the grounding surface of a vehicle with a bolt, the plural ground wires D are grounded all together.

In a state where the ground wires D are fastened to the body of the vehicle with the terminal fitting 3200A, if the ground wires D are grabbed and pulled in the disassembly of the vehicle, the linkage through the linking portions 3220B between the terminal body 3211 and the wire connecting body 3219 is eliminated and the linking portion 3220A is broken when the pulling force reaches a prescribed value (of, for example, 500 N). Thus, the terminal body 3211 fastened to the body of the vehicle and the wire connecting body 3219 connected to the plural ground wires D are separated from each other.

In this manner, according to the terminal fitting and the connection structure therefor of Embodiment 3-1 described above, since a plurality of ground wires D are connected to the wire connecting body 3219, the plural ground wires D can be electrically connected all together to the terminal fitting 3200A to be grounded to a body of a vehicle. Besides, in the disassembly, the wire connecting body 3219 linked to the terminal body 3211 through the linking portions 3220A and 3220B is separated so that the plural ground wires D can be separated all together from the terminal body 3211, and thus, good recyclability can be obtained.

In addition, when the linking strength of each linking portion 3220B, which has the linking strength adjusting function out of the linking portions 3220A and 3220B linking the terminal body 3211 and the wire connecting body 3219 to each other, is adjusted in accordance with the wiring conditions such as the diameter and the number of the ground wires to be connected, a good separation property can be definitely obtained in the disassembly while definitely obtaining the connection strength in the wiring, and thus, both the durability and the recyclability can be attained. The linking strength between the terminal body 3211 and the wire connecting body 3219 can be adjusted, for example, in a range from strength necessary for the connection to strength realizing a good separation property (for example, from 100 N to 500 N).

Besides, when the catching force of each catching piece 3217 is adjusted by adjusting the width W and the thickness T of the catching piece 3217 and the like, the linking strength between the terminal body 3211 and the wire connecting body 3219 can be very easily adjusted.

In addition, when the catching piece 3217 is inserted in the window portion 3218, the catching force in the linking portion 3220B can be increased to increase the linking strength. Besides, when the extent of the insertion of the catching piece 3217 into the window portion 3218 is adjusted, the linking strength between the terminal body 3211 and the wire connecting body 3219 can be very easily adjusted.

In addition, although the catching piece 3217 for catching the edge of the connecting plate 3214 of the wire connecting body 3219 is formed in the supporting wall 3216 of the terminal body 3211 in the above-described exemplified case, a catching piece 3217 for catching the edge of the supporting wall 3216 of the terminal body 3211 may be formed in the connecting plate 3214 of the wire connecting body 3219 instead.

On the contrary, according to the present embodiment, a plurality of ground wires D can be electrically connected all together to the terminal fitting 3200A to be grounded by connecting the plural ground wires D to the wire connecting body 3219, and hence, as compared with a structure in which terminal fittings respectively connected to ground wires D are stacked and fastened for electrical connection (see Patent Literatures 1 and 2), there is no need to stack terminal fittings, and hence, even if the number of ground wires D is increased, the increase in weight of the terminal fitting 3200A can be suppressed. Besides, since there is no need to stack the terminal fittings 3200A, even if the number of ground wires D to be electrically connected is increased, the thickness of the terminal fitting 3200A is not increased and hence the space can be saved.

Embodiment 3-2

Next, a connection structure for a terminal fitting according to Embodiment 3-2 will be described. It is noted that like reference signs are used to refer to like elements used in Embodiment 3-1 to omit the description.

Figure 32A:
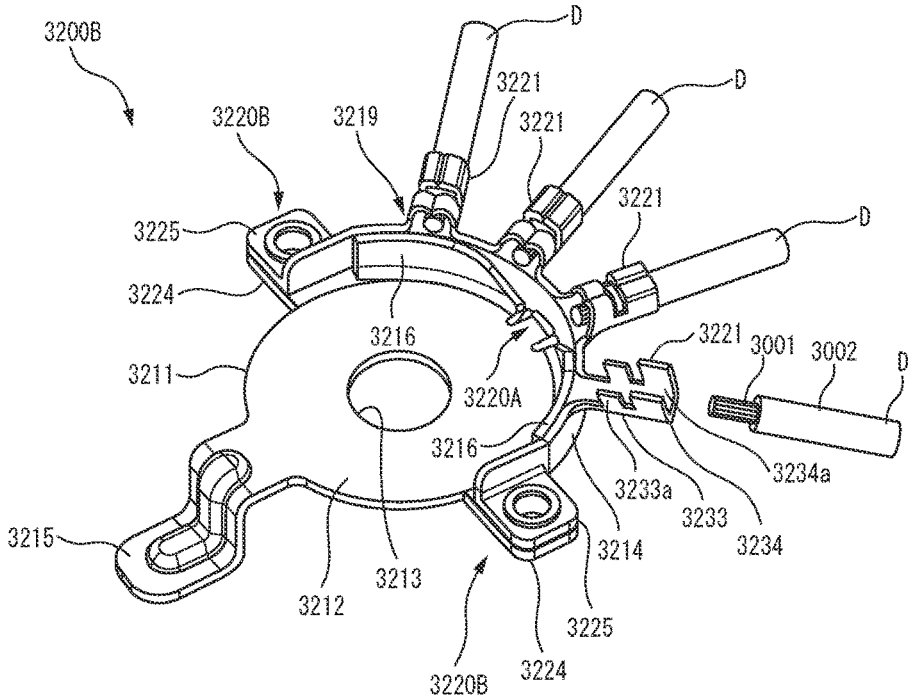
Figure 32B:
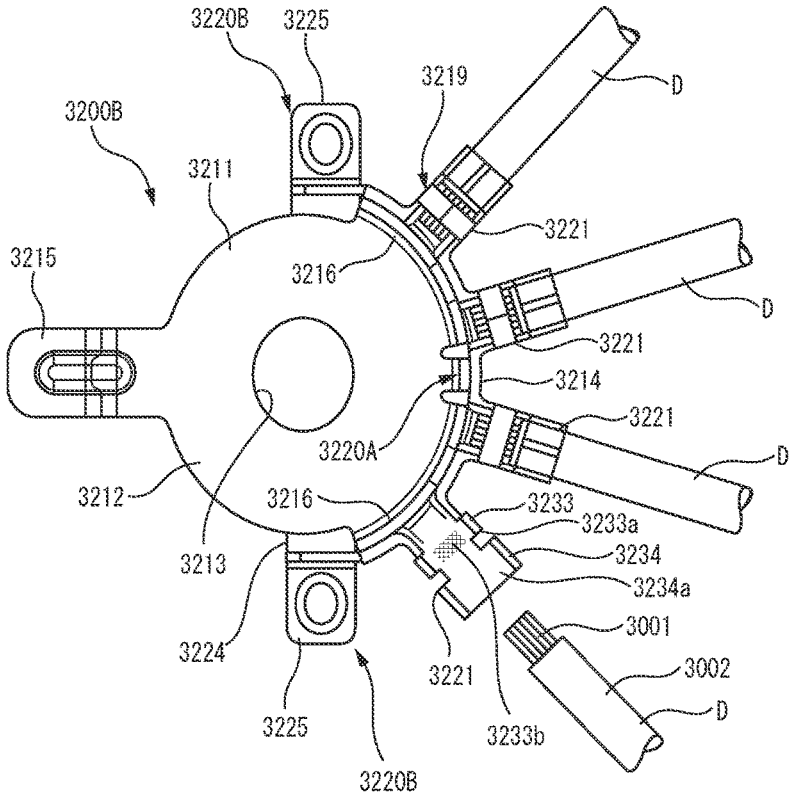
Figure 33A:
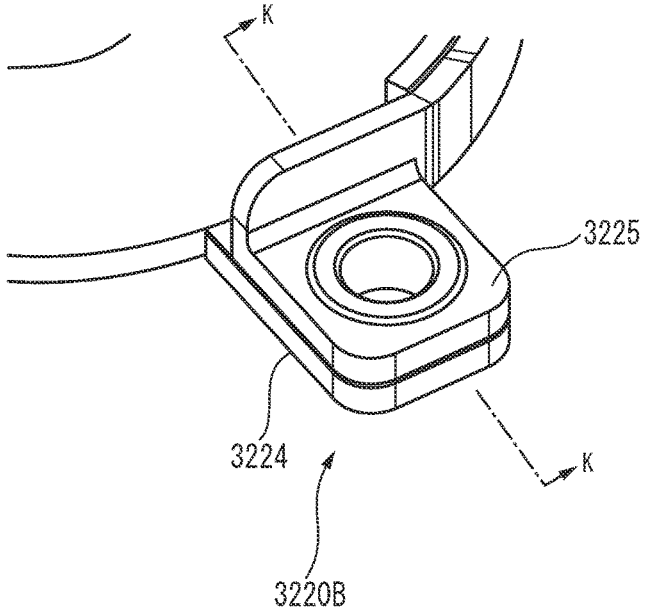
Figure 33B:
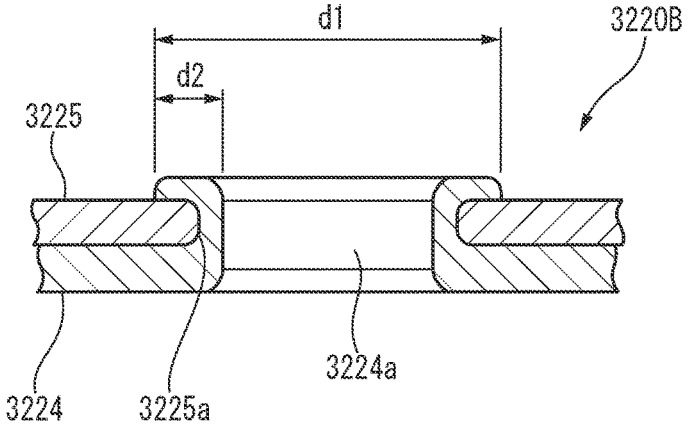

FIGS. 32A and 32B are diagrams explaining a terminal fitting and a connection structure therefor according to Embodiment 3-2, in which FIG. 32A is a perspective view of the terminal fitting connected to a ground wire, and FIG. 32B is a plan view of the terminal fitting connected to the ground wire. FIGS. 33A and 33B are diagrams illustrating a linking portion of the terminal fitting, in which FIG. 33A is a perspective view of the linking portion, and FIG. 33B is a cross-sectional view taken on line K-K of FIG. 33A.

As illustrated in FIGS. 32A and 32B, also in the terminal fitting 3200B of Embodiment 3-2, a terminal body 3211 to be fastened to a body of a vehicle and a wire connecting body 3219 connected to a plurality of ground wires D are linked to each other through a plurality of linking portions 3220A and 3220B. In the terminal fitting 3200B, a portion integrally linked between the terminal body 3211 and the wire connecting body 3219 corresponds to a linking portion 3220A.

Besides, in this terminal fitting 3200B, in a fixing plate 3212 of the terminal body 3211 and a connecting plate 3214 of the wire connecting body 3219, crimping pieces 3224 and 3225 extending sideward are respectively formed.

As illustrated in FIG. 33A, these crimping pieces 3224 and 3225 are stacked to be fastened by burring crimping. Specifically, as illustrated in FIG. 33B, a hole 3225*a* is formed in one of the crimping pieces, that is, the crimping piece 3225, and the other of the crimping pieces, that is, the crimping piece 3224, is subjected to the burring crimping to form a cylindrical burring 3224*a*, and the burring 3224*a* is inserted into the hole 3225*a* of the crimping piece 3225 and folded to the outer peripheral side. Thus, the crimping pieces 3224 and 3225 are fastened to each other through the burring 3224*a*. In the terminal fitting 3200B, a portion where the crimping pieces 3224 and 3225 are thus fastened by the burring crimping corresponds to the linking portion 3220B.

In other words, the terminal fitting 3200B has a plurality of linking portions 3220A and 3220B, and the terminal body 3211 and the wire connecting body 3219 are linked to each other through the plural linking portions 3220A and 3220B.

In the linking portion 3220B linking the terminal body 3211 and the wire connecting body 3219 to each other with the fastening force working between the crimping pieces 3224 and 3225, the linking strength can be adjusted by adjusting the fastening force through adjustment of a burring diameter d1 and a crimping margin d2 in the burring crimped portion between the crimping pieces 3224 and 3225. In other words, in the terminal fitting 3200B, among the linking portions 3220A and 3220B linking the terminal body 3211 and the wire connecting body 3219 to each other, the linking portion 3220B has the linking strength adjusting function.

Also in this terminal fitting 3200B, if ground wires D are grabbed and pulled in the disassembly of the vehicle, the linkage through the linking portion 3220B between the terminal body 3211 and the wire connecting body 3219 is eliminated and the linking portion 3220A is broken when the pulling force reaches a prescribed value (of, for example, 500 N). Thus, the terminal body 3211 fastened to the body of the vehicle and the wire connecting body 3219 connected to the plural ground wires D are separated from each other.

Also in Embodiment 3-2, when the linking strength of the linking portion 3220B, which has the linking strength adjusting function among the linking portions 3220A and 3220B linking the terminal body 3211 and the wire connecting body 3219 to each other, is adjusted in accordance with the wiring conditions such as the diameter and the number of ground wires D to be connected, a good separation property can be definitely obtained in the disassembly while definitely obtaining the connection strength in the wiring, and thus, both the durability and the recyclability can be attained.

In addition, when the fastening force is adjusted by adjusting the burring diameter d1 and the crimping margin d2 in the burring crimped portion between the crimping pieces 3224 and 3225, the linking strength between the terminal body 3211 and the wire connecting body 3219 can be very easily adjusted.

Besides, in the terminal fitting 3200B, the crimping pieces 3224 and 3225 extending sideward respectively from the fixing plate 3212 of the terminal body 3211 and the connecting plate 3214 of the wire connecting body 3219 are crimped for fastening. Accordingly, strength of a force working in a direction crossing the plane of the fixing plate 3212 can be increased in this terminal fitting 3200B.

It is noted that the positions of the crimping pieces 3224 and 3225 may be changed in accordance with a direction in which the strength is desired to be increased in the linking portion 3220B.

Modification of Embodiment 3-2

Figure 34:
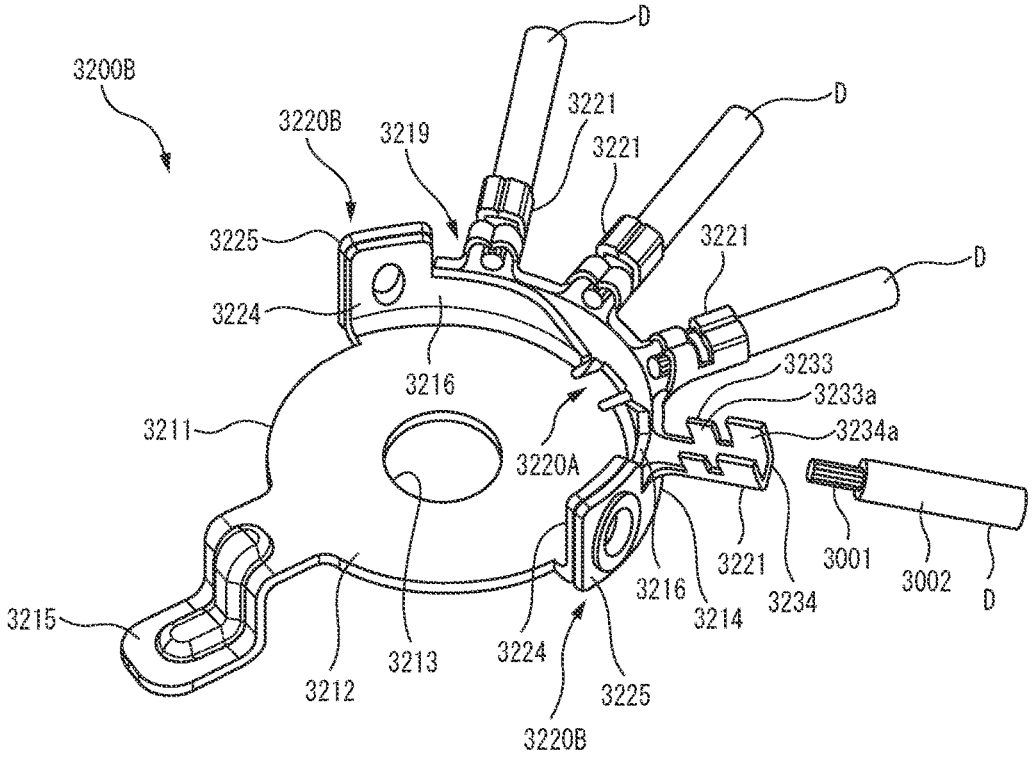
FIG. 34 is a perspective view of a terminal fitting connected to a ground wire according to a modification of Embodiment 3-2.

FIG. 34 is a perspective view of a terminal fitting connected to a ground wire according to a modification of the terminal fitting of Embodiment 3-2.

As illustrated in FIG. 34, in this terminal fitting 3200B, a part of a supporting wall 3216 of a terminal body 3211 and a part of a connecting plate 3214 of a wire connecting body 3219 are used respectively as crimping pieces 3224 and 3225, and these crimping pieces 3224 and 3225 are fastened through crimping by the burring crimping. In this terminal fitting 3200B, a portion where the crimping pieces 3224 and 3225 are fastened by crimping corresponds to a linking portion 3220B having a linking strength adjusting function. In other words, also this terminal fitting 3200B has a plurality of linking portions 3220A and 3220B, and the terminal body 3211 and the wire connecting body 3219 are linked to each other through the plural linking portions 3220A and 3220B.

In this terminal fitting 3200B, the crimping pieces 3224 and 3225 of the supporting wall 3216 and the connecting plate 3214 provided to rise on a fixing plate 3212 of the terminal body 3211 are fastened to each other, and as a result, the strength of a force working in a direction along the plane of the fixing plate 3212 can be increased.

Embodiment 3-3

Next, a connection structure for a terminal fitting according to Embodiment 3-3 will be described. It is noted that like reference signs are used to refer to like elements used in the first and second embodiments described above to omit the description.

Figure 35:
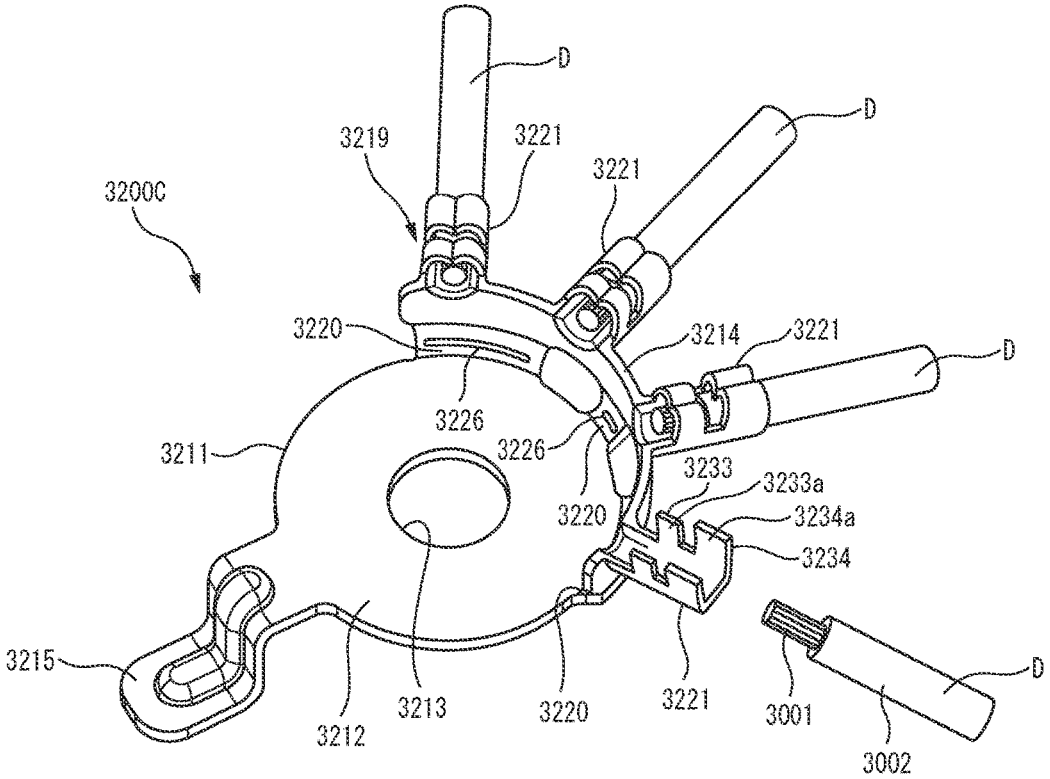
FIG. 35 is a perspective view of a terminal fitting connected to a ground wire for illustrating a terminal fitting and a connection structure therefor according to Embodiment 3-3.
Figure 36A:
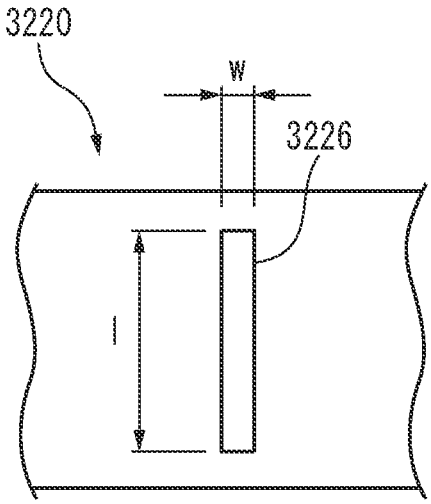
Figure 36B:
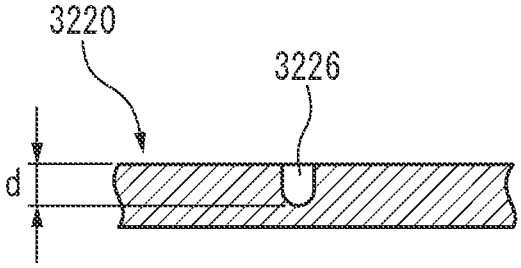

FIG. 35 is a perspective view of the terminal fitting connected to a ground wire for illustrating the terminal fitting and the connection structure therefor according to Embodiment 3-3. FIGS. 36A and 36B are diagrams illustrating a linking portion of the terminal fitting, in which FIG. 36A is a plan view of the linking portion, and FIG. 36B is a cross-sectional view of the linking portion.

As illustrated in FIG. 35, in the terminal fitting 3200C of Embodiment 3-3, a terminal body 3211 to be fastened to a body of a vehicle and a wire connecting body 3219 connected to a plurality of ground wires D are linked to each other through a plurality of linking portions 3220. In the terminal fitting 3200C, plate portions integrally linked between the terminal body 3211 and the wire connecting body 3219 correspond to the linking portions 3220.

As illustrated in FIGS. 36A and 36B, in the terminal fitting 3200C, a notch 3226 is formed, in each linking portion 3220 formed as the plate portion, as a groove extending in a width direction, that is, a direction crossing the linking direction of the terminal body 3211 and the wire connecting body 3219. In employing the linking portion 3220 having the notch 3226, the tensile force and the shear force in the linking portion 3220 can be adjusted by adjusting the depth d, the length l and the width w of the notch 3226. In other words, the linking portion 3220 having the notch 3226 has a linking strength adjusting function with which the linking strength between the terminal body 3211 and the wire connecting body 3219 can be adjusted. It is noted that the adjustment of the linking strength in the linking portion 3220 can be also performed by using the width and the thickness of the linking portion 3220.

In this terminal fitting 3200C, when the ground wires D are grabbed and pulled in disassembling the vehicle, the linking portions 3220 between the terminal body 3211 and the wire connecting body 3219 are broken if the pulling force reaches a prescribed value (of, for example, 500 N). Thus, the terminal body 3211 fastened to the body of the vehicle and the wire connecting body 3219 connected to the plural ground wires D are separated from each other.

Also in Embodiment 3-3, when the linking strength of the linking portion 3220, which links the terminal body 3211 and the wire connecting body 3219 to each other, and has the linking strength adjusting function, is adjusted in accordance with the wiring conditions such as the diameter and the number of ground wires D to be connected, a good separation property can be definitely obtained in the disassembly while definitely obtaining the connection strength in the wiring, and thus, both the durability and the recyclability can be attained.

Besides, when the depth d, the length l and the width w of the notch 3226 formed in the plate portion corresponding to the linking portion 3220 are adjusted, the linking strength between the terminal body 3211 and the wire connecting body 3219 can be very easily adjusted.

In addition, although the ground wires D are grounded all together by connecting the ground wires D of the in-vehicle circuit (the auxiliary device) to the terminal fitting 3200A, 3200B or 3200C in Embodiments 3-1 to 3-3, a wire to be connected to the terminal fitting 3200A, 3200B or 3200C is not limited to a wire for grounding.

Besides, instead of providing the rotation stopper piece 3215 to the terminal body 3211 of the terminal fitting 3200A, 3200B or 3200C, a step or a rotation stopper piece to be brought into contact with and stop rotation of the terminal fitting 3200A, 3200B or 3200C when the terminal fitting 3200A, 3200B or 3200C is attached onto the grounding surface may be provided on the side of the grounding surface.

Although the plural ground wires D are directly connected to the terminal fitting 3200A, 3200B or 3200C in the structures exemplified in Embodiments 3-1 to 3-3, the plural ground wires D may be connected to the terminal fitting 3200A, 3200B or 3200C via connection terminals.

If the plural ground wires D are connected to the terminal fitting 3200A, 3200B or 3200C via the connection terminals, the plural ground wires D can be electrically connected all together to the terminal fitting 3200A, 3200B or 3200C by fastening, to the wire connecting body 3219, the connection terminals connected to the ground wires D.

Embodiment 3-4

Next, a connection structure for connecting a plurality of wires to a terminal fitting via connection terminals will be described as Embodiment 3-4 and Embodiment 3-5.

Figure 37A:
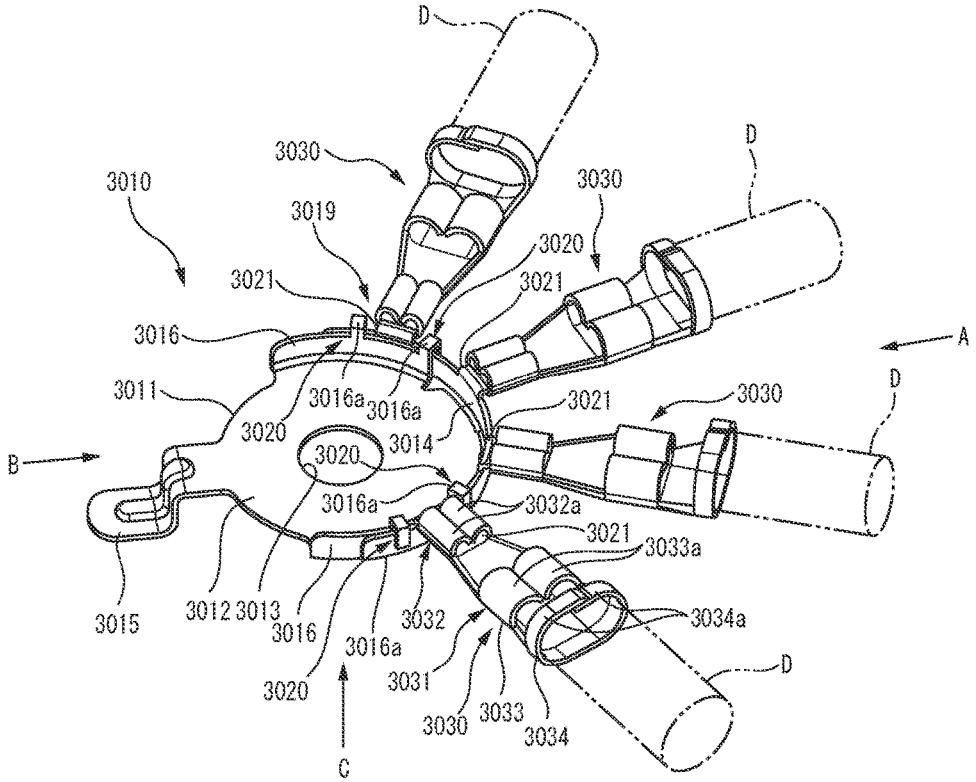
Figure 37B:
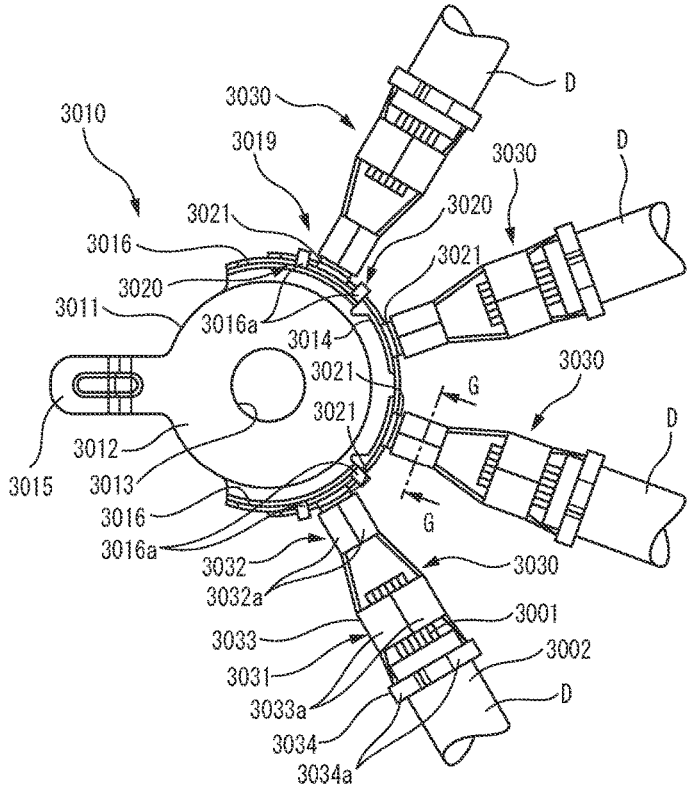

FIGS. 37A and 37B are diagrams explaining a connection structure for a terminal fitting according to Embodiment 3-4, in which FIG. 37A is a perspective view of a terminal fitting connected to a ground wire, and FIG. 37B is a plan view of the terminal fitting connected to the ground wire.

As illustrated in FIGS. 37A and 37B, in the connection structure for a terminal fitting of Embodiment 3-4, a terminal fitting 3010 is connected to connection terminals 3030. The terminal fitting 3010 is electrically connected to a grounding surface such as a body of a vehicle. Each connection terminal 3030 connected to this terminal fitting 3010 is provided at an end of a ground wire (a wire) D of an in-vehicle circuit (an auxiliary device). The ground wire D includes a conductor portion 3001 and a sheath 3002 covering the conductor portion 3001, and the conductor portion 3001 is exposed from the sheath 3002 at an end thereof to be connected to the connection terminal 3030. The conductor portion 3001 of the ground wire D is electrically connected to the connection terminal 3030. Thus, the ground wire D of the in-vehicle circuit is electrically connected to the grounding surface such as a body of a vehicle via the terminal fitting 3010.

Figure 38:
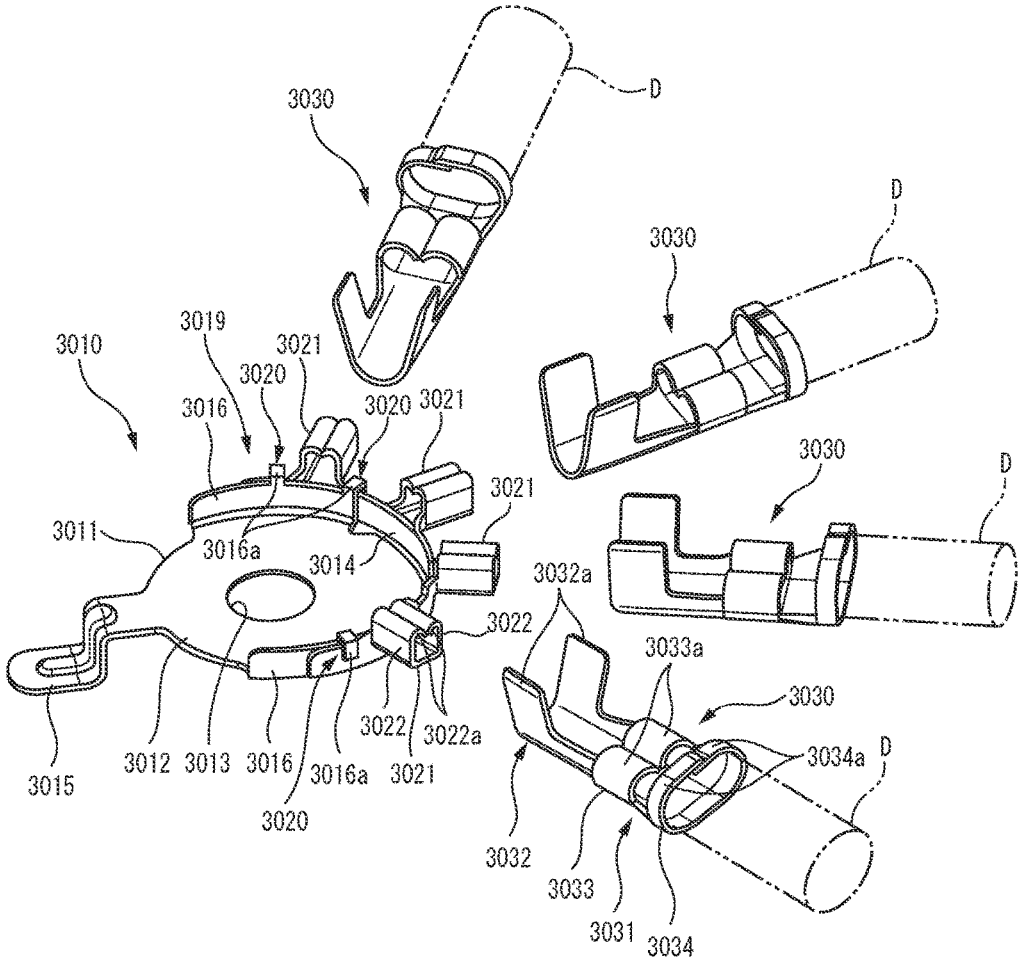
FIG. 38 is a perspective view of a terminal fitting and a connection terminal for explaining the connection structure for a terminal fitting according to Embodiment 3-4.
Figure 39A:
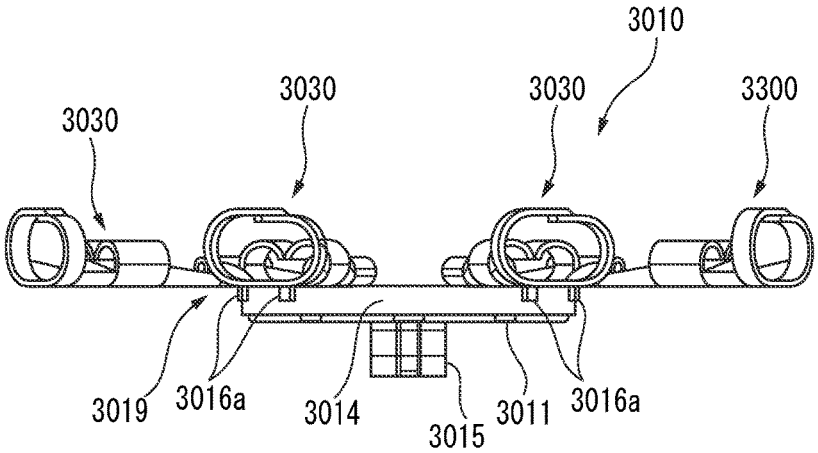
Figure 39B:
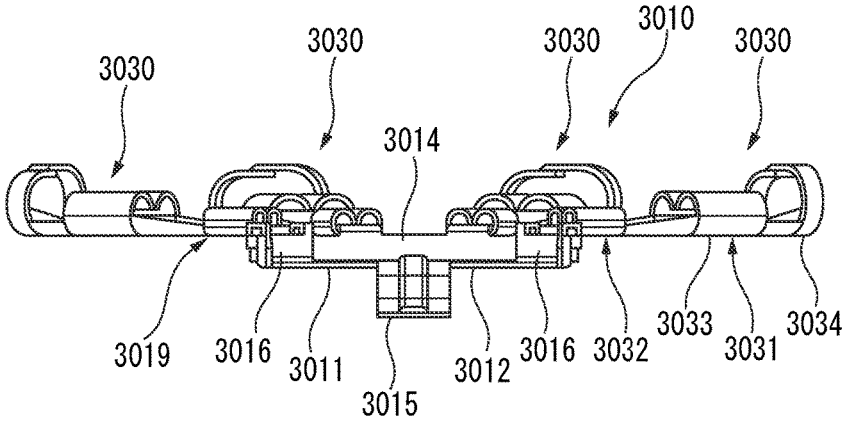
Figure 39C:
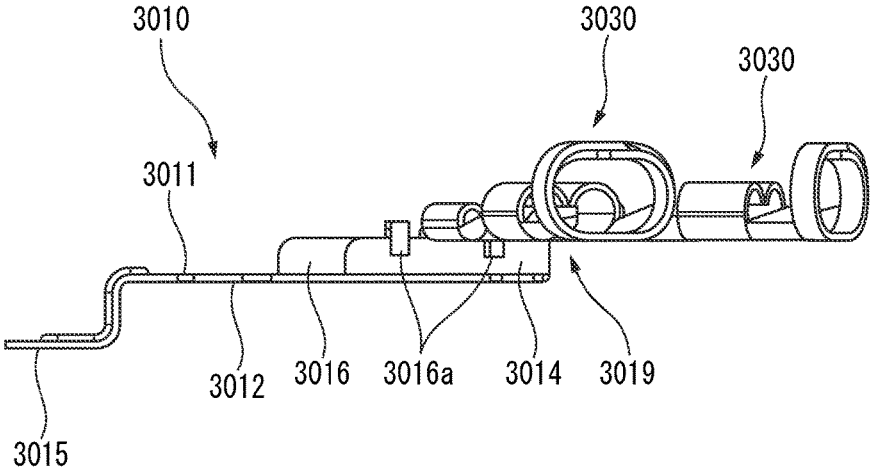
Figure 40:
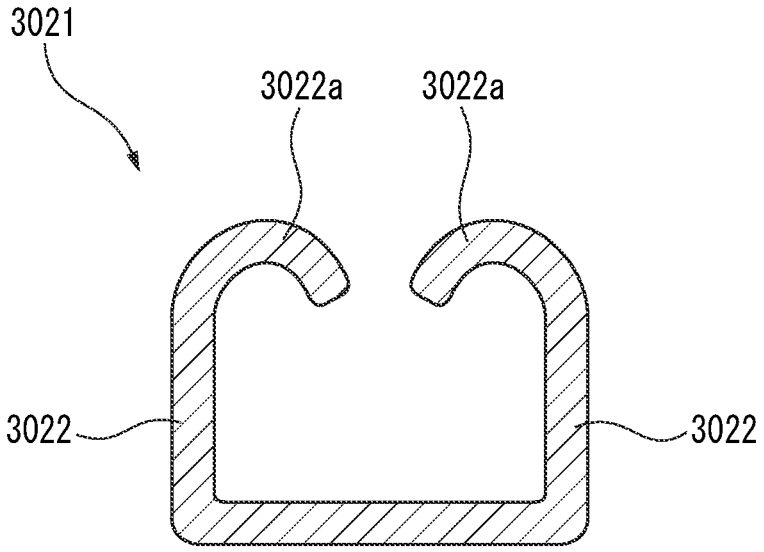
FIG. 40 is a cross-sectional view of a terminal connecting portion of the terminal fitting.

FIG. 38 is a perspective view of the terminal fitting and the connection terminal for explaining the connection structure for a terminal fitting of Embodiment 3-4. FIGS. 39A to 39C are diagrams explaining the connection structure for a terminal fitting according to Embodiment 3-4, in which FIG. 39A is a view taken on arrow A of FIG. 37A, FIG. 39B is a view taken on arrow B of FIG. 37A, and FIG. 39C is a view taken on arrow C of FIG. 37A. FIG. 40 is a cross-sectional view of a terminal connecting portion of the terminal fitting.

As illustrated in FIGS. 38 and 39A to 39C, the terminal fitting 3010 includes a terminal body 3011 and a wire connecting body 3019 including a plurality of terminal connecting portions 3021. The terminal fitting 3010 is a pressed product of a conductive metal plate. The terminal body 3011 has a fixing plate 3012 in a circular shape in a plan view. This fixing plate 3012 has a circular attaching hole 3013 formed at the center thereof. The terminal body 3011 is fixed to the grounding surface such as a body of a vehicle with a bolt (not illustrated) inserted through the attaching hole 3013 of the fixing plate 3012. It is noted that the attaching hole 3013 may be provided eccentrically instead of at the center of the fixing plate 3012.

A rotation stopper piece 3015 is formed in a part of the fixing plate 3012. The rotation stopper piece 3015 is a folded portion to be engaged with a step or a hole formed around the grounding surface to which the terminal body 3011 is fastened with the bolt, and the rotation of the terminal fitting 3010 on the grounding surface is restricted with this rotation stopper piece 3215 engaged with the step or the hole formed around the grounding surface.

The fixing plate 3012 has, on its periphery, two supporting walls 3016 each in an arc shape in a plan view. These supporting walls 3016 are provided to rise toward one surface side, namely, toward the upper surface side, of the fixing plate 3012. Besides, the wire connecting body 3019 has, in substantially a half of the periphery of the fixing plate 3012, a connecting plate 3014 in an arc shape in a plan view. The connecting plate 3014 is provided to rise toward one surface side, namely, toward the upper surface side, of the fixing plate 3012. The connecting plate 3014 is disposed along the outer circumferences of the supporting walls 3016.

Each supporting wall 3016 has a plurality of catching pieces 3016*a* formed at the upper edge thereof. These catching pieces 3016*a* are folded toward the connecting plate 3014, and thus, the connecting plate 3014 is caught by the catching pieces 3016*a* to be supported by the supporting walls 3016.

Thus, in the terminal fitting 3010, portions where the connecting plate 3014 is caught by the catching pieces 3016*a* of the supporting walls 3016 correspond to linking portions 3020. In other words, the terminal fitting 3010 has a plurality of linking portions 3020, and the plural linking portions 3020 link the terminal body 3011 and the wire connecting body 3019 to each other.

The terminal connecting portions 3021 are formed integrally with the connecting plate 3014 of the terminal body 3011. The plural terminal connecting portions 3021 are provided at the upper edge of the connecting plate 3014. Specifically, four terminal connecting portions 3021 are formed in the connecting plate 3014. These terminal connecting portions 3021 are extended, on the same plane, to radially protrude from a peripheral portion of the fixing plate 3012.

As illustrated in FIG. 40, each terminal connecting portion 3021 has, as both sides thereof, engagement walls 3022 protruding toward one surface side, namely, the upper surface side. Thus, each terminal connecting portion 3021 is formed in a recessed shape in a front view. Besides, each of these engagement walls 3022 has, at an upper end thereof, an engaging piece 3022*a* curved and folded inward in an arc shape.

Figure 41:
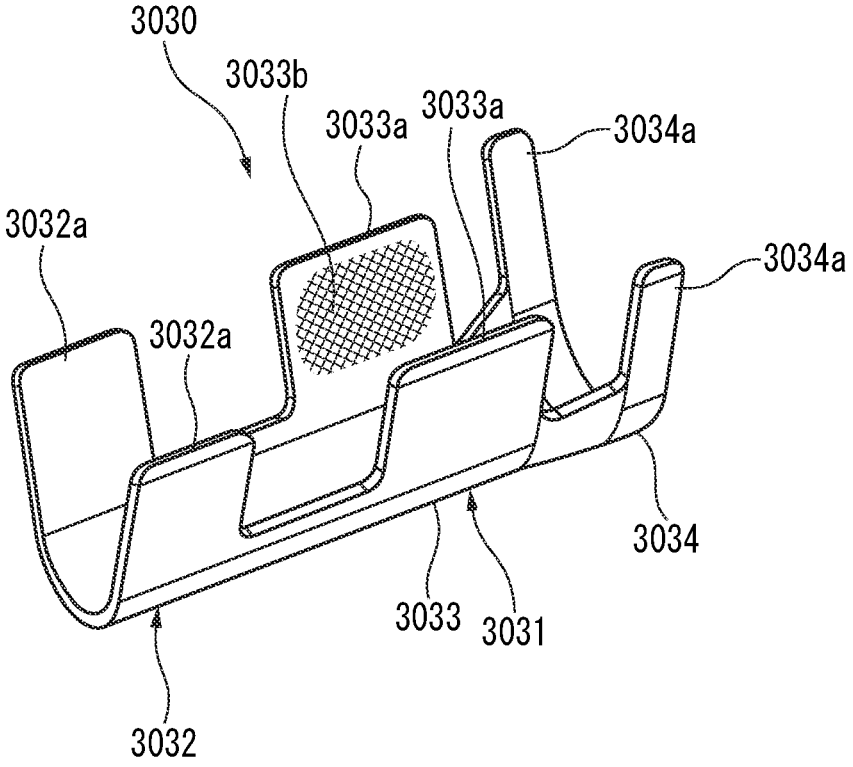
FIG. 41 is a perspective view of a connection terminal for explaining the connection terminal.
Figure 42:
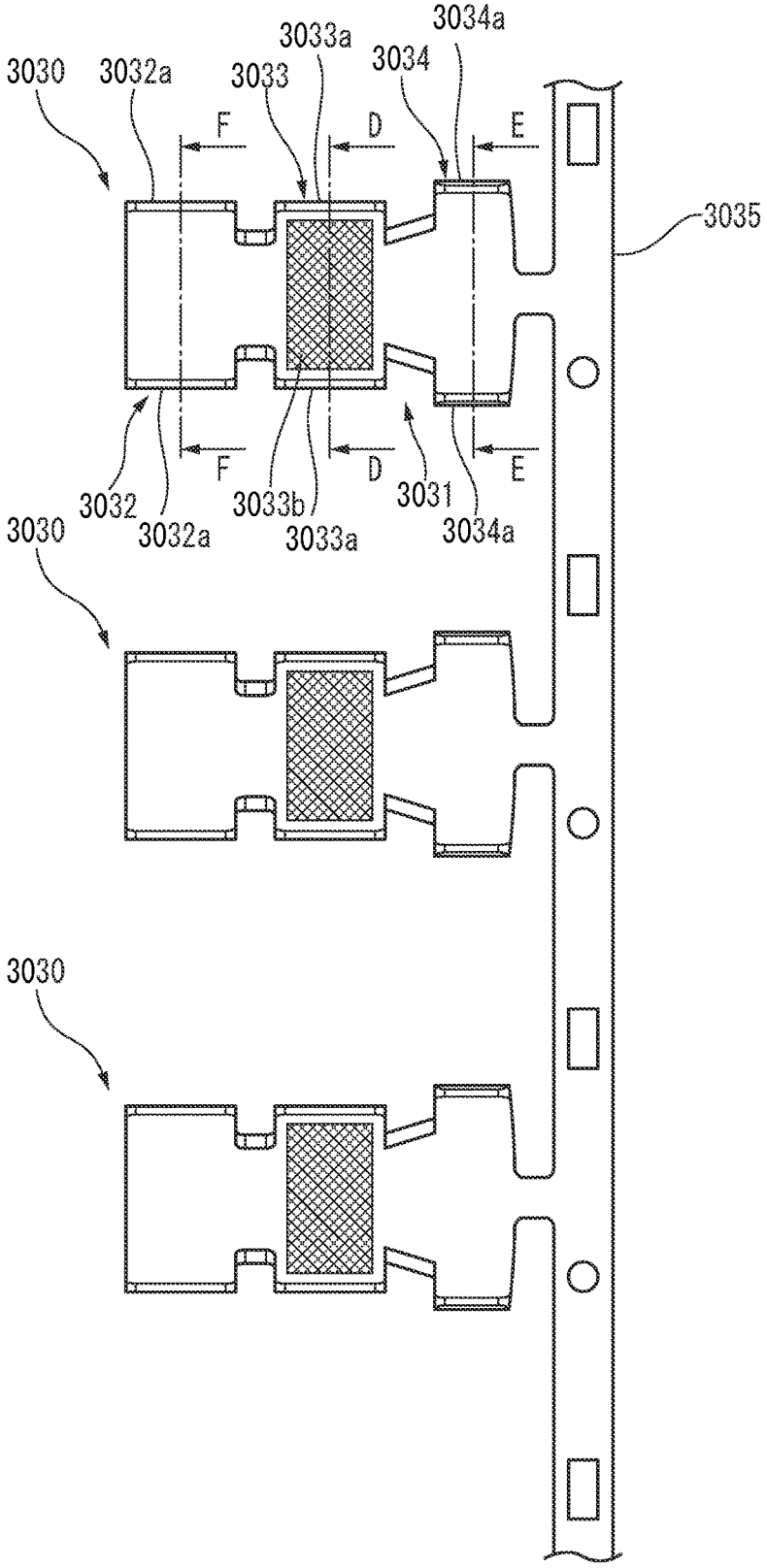
FIG. 42 is a plan view of the connection terminal linked to a carrier.
Figure 43A:
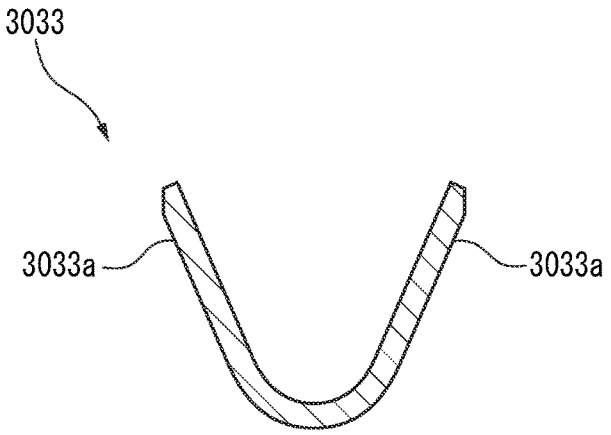
Figure 43B:
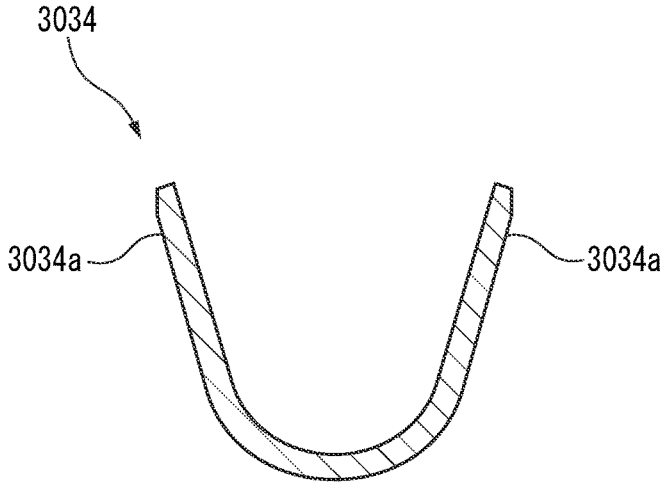
Figure 43C:
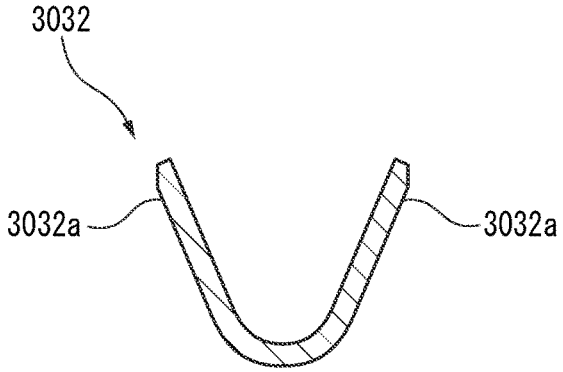
Figure 44A:
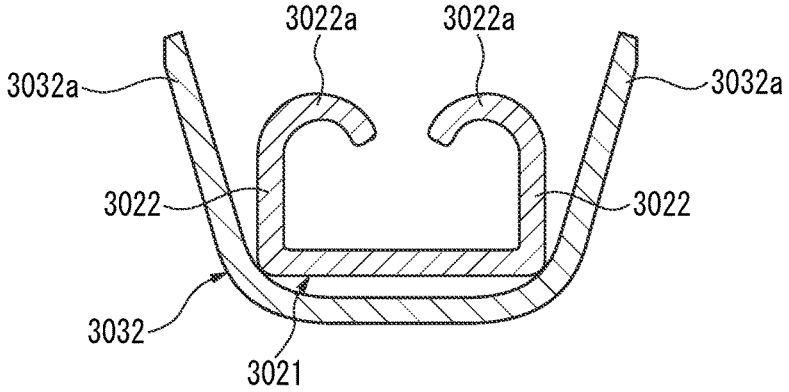
Figure 44B:
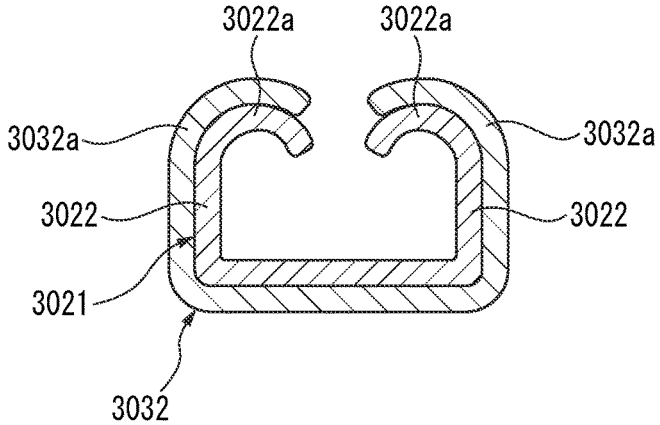
Figure 44C:
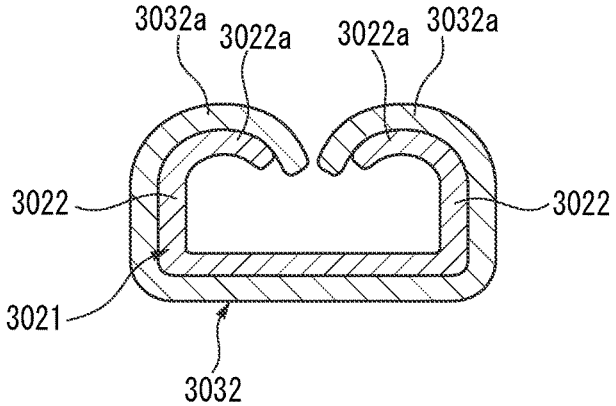
Figure 44D:
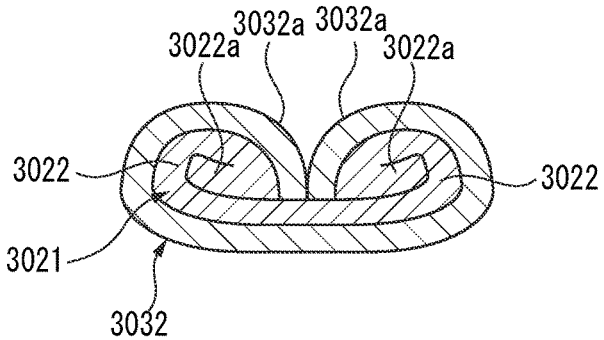

FIG. 41 is a perspective view of the connection terminal for explaining the connection terminal. FIG. 42 is a plan view of the connection terminal linked to a carrier. FIGS. 43A to 43C are diagrams explaining the connection terminal, in which FIG. 43A is a cross-sectional view taken on line D-D of FIG. 42, FIG. 43B is a cross-sectional view taken on line E-E of FIG. 42, and FIG. 43C is a cross-sectional view taken on line F-F of FIG. 42. FIGS. 44A to 44D are diagrams illustrating fastening states of crimping pieces of a fastening connecting portion to a terminal connecting portion of the terminal fitting, in which FIG. 44A is a cross-sectional view taken on line G-G of FIG. 37B before fastening with the crimping pieces, FIG. 44B is a cross-sectional view taken on line G-G of FIG. 37B at the beginning of the fastening with the crimping pieces, FIG. 44C is a cross-sectional view taken on line G-G of FIG. 37B during the fastening with the crimping pieces, and FIG. 44D is a cross-sectional view taken on line G-G of FIG. 37B after the fastening with the crimping pieces.

As illustrated in FIG. 41, the connection terminal 3030 has a wire connecting portion 3031 and a fastening connecting portion 3032. The ground wire D is connected to the wire connecting portion 3031. The connection terminal 3030 provided on the ground wire D is a pressed product made of a conductive metal plate. The fastening connecting portion 3032 is fastened to the terminal connecting portion 3021 of the terminal fitting 3010.

As illustrated in FIG. 42, the connection terminal 3030 is supplied in a state where it is linked, on the side of the wire connecting portion 3031, to a belt-shaped carrier 3035, and is used in a state where it is separated from the carrier 3035. The wire connecting portion 3031 has a conductor crimping portion 3033 and a sheath crimping portion 3034.

As illustrated in FIG. 43A, the conductor crimping portion 3033 is formed in the shape of U having a pair of conductor crimping pieces 3033*a*, and when the conductor crimping pieces 3033*a* are crimped, the conductor portion 3001 of the ground wire D is crimped and fixed in the conductor crimping portion 3033. Thus, the conductor portion 3001 of the ground wire D and the connection terminal 3030 are electrically connected to each other. Besides, on an inner surface of the conductor crimping portion 3033, a rough surface portion (a serration) 3033*b* roughened by machining is provided. Thus, the conductor portion 3001 of the ground wire D calked in the conductor crimping portion 3033 is definitely electrically connected to the connection terminal 3030.

As illustrated in FIG. 43B, the sheath calking portion 3034 is formed in the shape of U having a pair of sheath crimping pieces 3034*a*, and when the sheath crimping pieces 3034*a* are crimped, a tip portion of the sheath 3002 of the ground wire D is crimped and fixed in the sheath crimping portion 3034.

As illustrated in FIG. 43C, the fastening connecting portion 3032 of the connection terminal 3030 is formed in the shape of U having a pair of crimping pieces 3032*a*.

If the crimping pieces 3032*a* are crimped, as illustrated in FIG. 44A, with the terminal connecting portion 3021 of the terminal fitting 3010 disposed within the U-shaped fastening connecting portion 3032 of the connection terminal 3030, the crimping pieces 3032*a* roll up the both sides of the terminal connecting portion 3021 of the terminal body 3011 at the beginning of the crimping as illustrated in FIG. 44B. Thereafter, as illustrated in FIG. 44C, the crimping pieces 3032*a* are crimped so as to externally roll up the engagement walls 3022 of the terminal connecting portion 3021 and the engaging pieces 3022*a* provided at the upper ends thereof, and thus, the engagement walls 3022 having the engaging pieces 3022*a* are curled up to be tightly held inside the crimping pieces 3032*a* as illustrated in FIG. 44D, and the terminal connecting portion 3021 is filled within the fastening connecting portion 3032. Accordingly, the fastening connecting portion 3032 is firmly fastened to the terminal connecting portion 3021 at high contact pressure, and the terminal fitting 3010 and the connection terminal 3030 are definitely electrically connected to each other.

Besides, the crimping pieces 3032*a* may be precedently bent into a curved shape as illustrated in FIG. 44B in a separate step before crimping the crimping pieces 3032*a*, and then the crimping pieces 3032*a* may be crimped with the terminal connecting portion 3021 disposed in the crimping pieces 3032*a* in this state.

For connecting the ground wire D to the terminal fitting 3010, the sheath 3002 is first removed at the end of the ground wire D to expose the conductor portion 3001. Then, with the end of the ground wire D disposed on the wire connecting portion 3031 of the connection terminal 3030 having been separated from the carrier 3035, the conductor crimping portion 3033 is crimped and the sheath crimping portion 3034 is crimped. Thus, the ground wire D is connected to the connection terminal 3030.

Subsequently, the fastening connecting portion 3032 of the connection terminal 3030 having been connected to the ground wire D is placed on the rear surface of the terminal connecting portion 3021 of the terminal fitting 3010, and the crimping pieces 3032*a* are crimped. Thus, the connection terminal 3030 is firmly fastened to the terminal fitting 3010, and the conductor portion 3001 of the ground wire D is electrically connected to the terminal fitting 3010.

The connection terminal 3030 is fastened to each of the terminal connecting portions 3021 of the terminal fitting 3010 as described above. Thus, a plurality of ground wires D are electrically connected all together to the terminal fitting 3010. Then, the terminal fitting 3010 is fixed to the grounding surface of the vehicle, and thus, the plural ground wires D are grounded.

As described so far, according to the connection structure for a terminal fitting of Embodiment 3-4, when the crimping pieces 3032*a* of the connection terminal 3030 connected to a plurality of ground wires D are crimped to each of the plural terminal connecting portions 3021 of the terminal fitting 3010, the connection terminal 3030 can be fastened to the terminal fitting 3010 to electrically connect a plurality of ground wires D all together to the terminal fitting 3010. As a result, as compared with a structure in which terminal fittings connected to respective wires are stacked and fastened for electrical connection, there is no need to stack the terminal fittings 3010, and hence, the weight increase of the terminal fitting can be suppressed even if the number of wires is increased. Besides, since there is no need to stack terminal fittings, even if the number of wires to be electrically connected is increased, the thickness increase can be avoided, and hence the space can be saved. In addition, since the connection terminal 3030 is fastened to the terminal connecting portion 3021 of the terminal fitting 3010, there is no need to provide a special mechanism for holding the connection terminal 3030. Thus, as compared with a joint connector that needs to have a holding mechanism for holding a terminal in a housing, the size and the cost can be reduced.

Besides, since the connection terminal 3030 separately provided is fastened and connected to the terminal fitting 3010 in this structure, connection terminals 3030 respectively connected ground wires D of different sizes can be fastened and electrically connected to the terminal connecting portions 3021. In other words, this structure is applicable to ground wires D of various sizes without changing the connection form between the terminal connecting portion 3021 of the terminal fitting 3010 and the fastening connecting portion 3032 of the connection terminal 3030. Besides, if terminal fittings 3010 respectively having different numbers of terminal connecting portions 3021 are prepared, the structure can easily deal with the increase/decrease of the number of ground wires D to be electrically connected.

Here, a plurality of ground wires D can be electrically connected all together by using, for example, a terminal fitting in which a plurality of connecting portions connectable to ground wires D are integrally formed. If such a terminal fitting is used, however, it is necessary to prepare terminal fittings in accordance with the number of ground wires D to be connected. Besides, for dealing with size change of the ground wire D, it is necessary to prepare a terminal fitting having a connecting portion according with each size of the ground wire D.

On the contrary, according to the connection structure for a terminal fitting of Embodiment 3-4, the change in the number or the size of ground wires D to be electrically connected can be dealt with by minimum variations of the terminal fitting 3010.

In addition, since the connection terminal 3030 is fastened to each of the plural terminal connecting portions 3021 of the terminal fitting 3010 in this structure, the connection terminals 3030 can be fastened to the terminal connecting portions 3021 as needed, and as a result, the number of ground wires D to be electrically connected all together can be easily increased/decreased within the limit of the number of the terminal connecting portions 3021.

Besides, the engagement walls 3022 to be engaged with the crimping pieces 3032*a* are formed as the both sides of the terminal connecting portion 3021. Accordingly, when the crimping pieces 3032*a* of the connection terminal 3030 are crimped to the terminal connecting portion 3021, the crimping pieces 3032*a* are engaged with the engagement walls 3022 of the terminal connecting portion 3021. Thus, the crimping pieces 3032*a* are definitely crimped to the terminal connecting portion 3021, so as to further increase the connection strength of the terminal connecting portion 3021 to the connection terminal 3030, and the electrical resistance in the connection portion can be stabilized to attain good electrical connection.

In particular, the engaging pieces 3022*a* folded inward are formed at the upper ends of the engagement walls 3022 of the terminal connecting portion 3021, the crimping pieces 3032*a* can be definitely crimped to the terminal connecting portion 3021 so as to further increase engagement force with the crimping piece 3032*a* of the connection terminal 3030, and hence, high connection strength can be definitely obtained. Thus, the electrical resistance in the connection portion can be stabilized to attain good electrical connection.

In addition, the terminal connecting portions 3021 are extended radially on the same plane. Accordingly, with the area occupied by the terminal fitting 3010 suppressed to be as small as possible, a large number of terminal connecting portions 3021 can be provided, and hence, a large number of ground wires D can be connected all together.

Besides, also in the connection structure for a terminal fitting of Embodiment 3-4, in the disassembly, the plural ground wires D can be separated all together from the terminal body 3011 by separating the wire connecting body 3019 linked to the terminal body 3011 through the liking portions 3020, and hence, good recyclability can be obtained.

In addition, when the linking strength is adjusted by adjusting the engagement force of the catching pieces 3016*a* of the linking portion 3020, which links the terminal body 3011 and the wire connecting body 3019 to each other, in accordance with the wiring conditions such as the diameter and the number of the ground wires D to be connected, a good separation property can be obtained in the disassembly while definitely obtaining the connection strength in the wiring, and thus, both the durability and the recyclability can be attained. The linking strength between the terminal body 3011 and the wire connecting body 3019 can be adjusted, for example, in a range from strength necessary for the connection to strength realizing a good separation property (for example, from 100 N to 500 N).

In addition, the terminal connecting portion 3021 is formed in the recessed cross-sectional shape by providing the engagement walls 3022 as the both sides, and the engaging piece 3022*a* curved and folded inward in an arc shape is formed at the upper end of each engagement wall 3022 in the above-described embodiment, but the cross-sectional shape of the terminal connecting portion 3021 is not limited to that described above.

Modification of Embodiment 3-4

Figure 45:
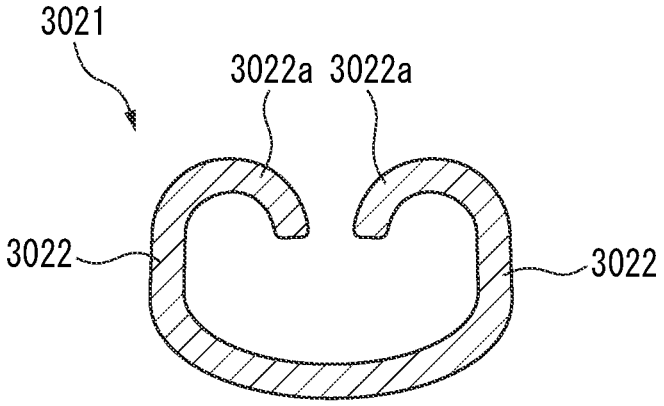
FIG. 45 is a cross-sectional view of the terminal connecting portion in another shape.
Figure 46:
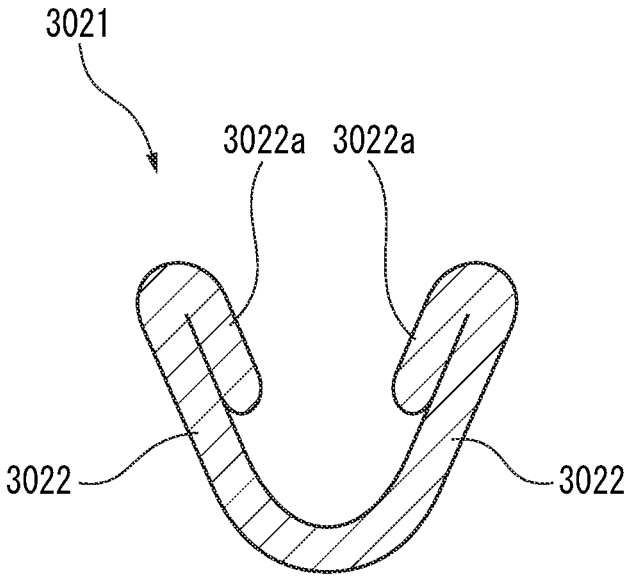
FIG. 46 is a cross-sectional view of the terminal connecting portion in still another shape.
Figure 47:
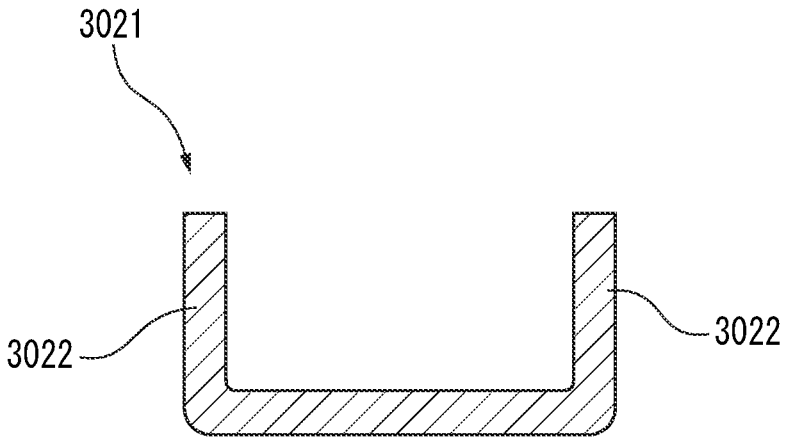
FIG. 47 is a cross-sectional view of the terminal connecting portion in still another shape.

FIGS. 45 to 47 are cross-sectional views of the terminal connecting portion in different shapes.

As illustrated in FIG. 45, the terminal connecting portion 3021 may have a bottom curved to be swollen outward. If the bottom of the terminal connecting portion 3021 is thus swollen outward, the terminal connecting portion 3021 can be more smoothly rolled up to be satisfactorily crimped in crimping the crimping pieces 3032*a*.

Alternatively, as illustrated in FIG. 46, the engagement walls 3022 of the both sides of the terminal connecting portion 3021 may be in the shape of V spreading upward in a cross-sectional view, and the engaging piece 3022*a* curved and folded inward may be formed at the upper end of each engagement wall 3022. Also in employing this shape, high connection strength can be obtained because the crimping pieces 3032*a* can be firmly engaged with the engaging pieces 3022*a* at the upper ends of the engagement walls 3022 of the terminal connecting portion 3021.

In addition, if large proof tensile strength is not required between the terminal connecting portion 3021 and the connection terminal 3030, the terminal connecting portion 3021 may be in a recessed cross-sectional shape having no engaging piece 3022*a* at the upper end of each engagement wall 3022 as illustrated in FIG. 47.

In addition, although the terminal fitting 3010 of Embodiment 3-4 described above uses four terminal connecting portions 3021, the number of the terminal connecting portions 3021 of the terminal fitting 3010 is not limited to four as long as it is plural.

Embodiment 3-5

Next, a connection structure for a terminal fitting according to Embodiment 3-5 will be described. It is noted that this structure is substantially the same as that of Embodiment 3-4 except for a terminal fitting, and hence like reference signs are used to omit the description.

Figure 48A:
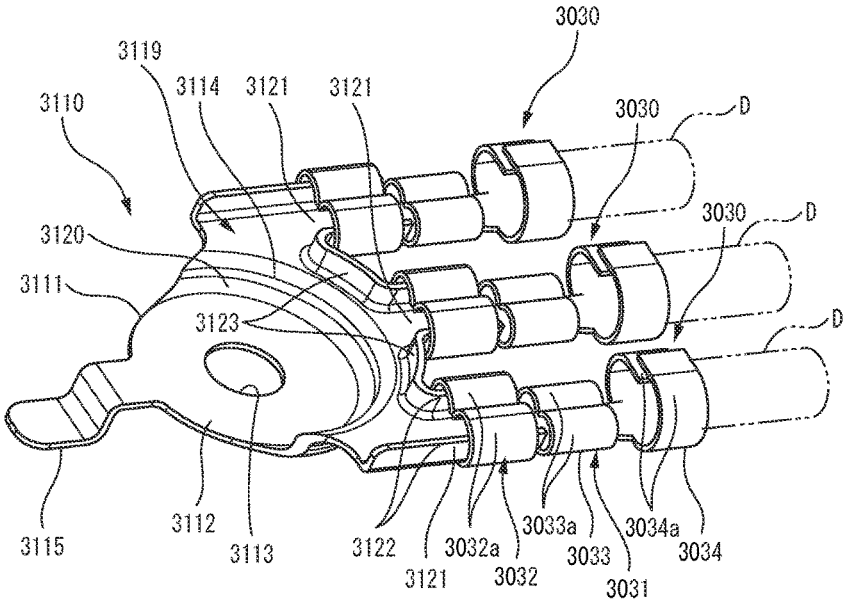
Figure 48B:
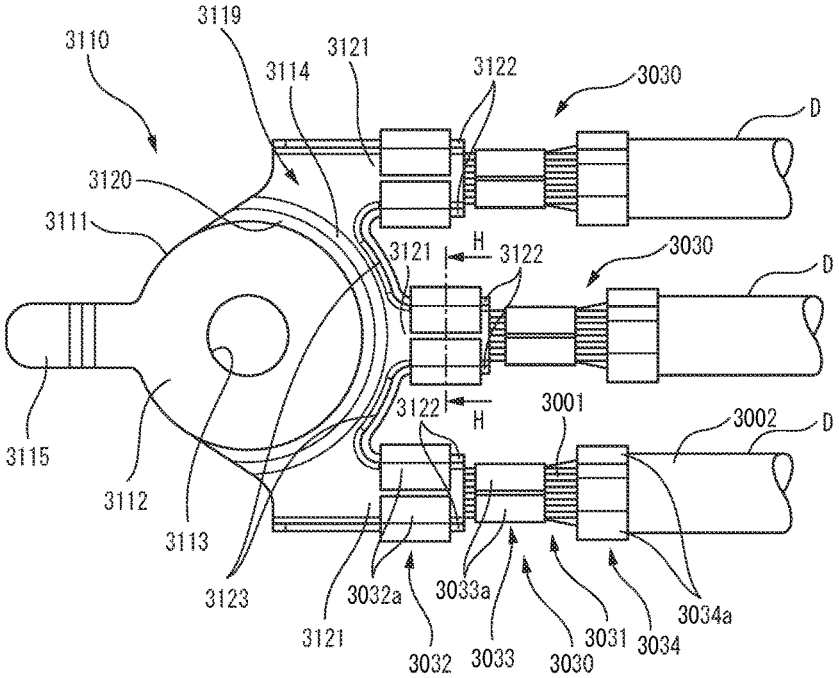
Figure 49A:
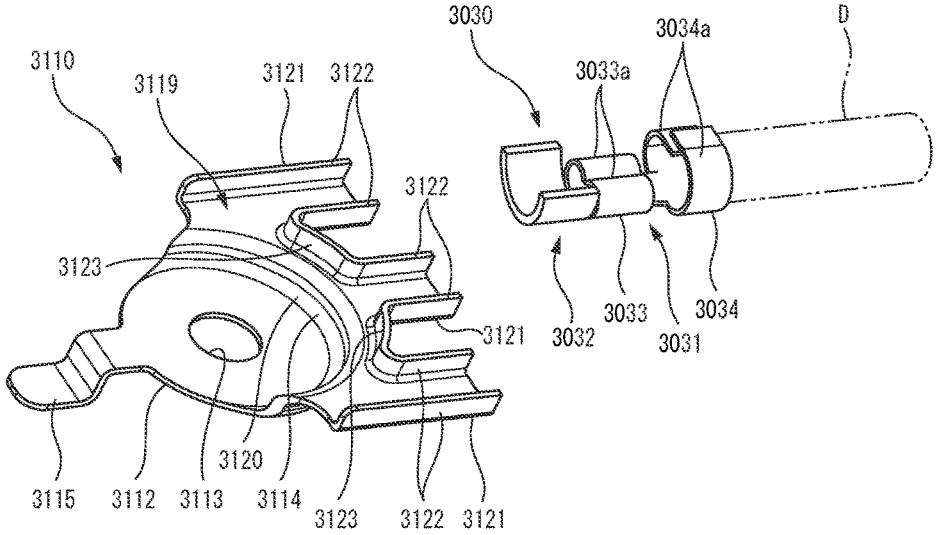
Figure 49B:
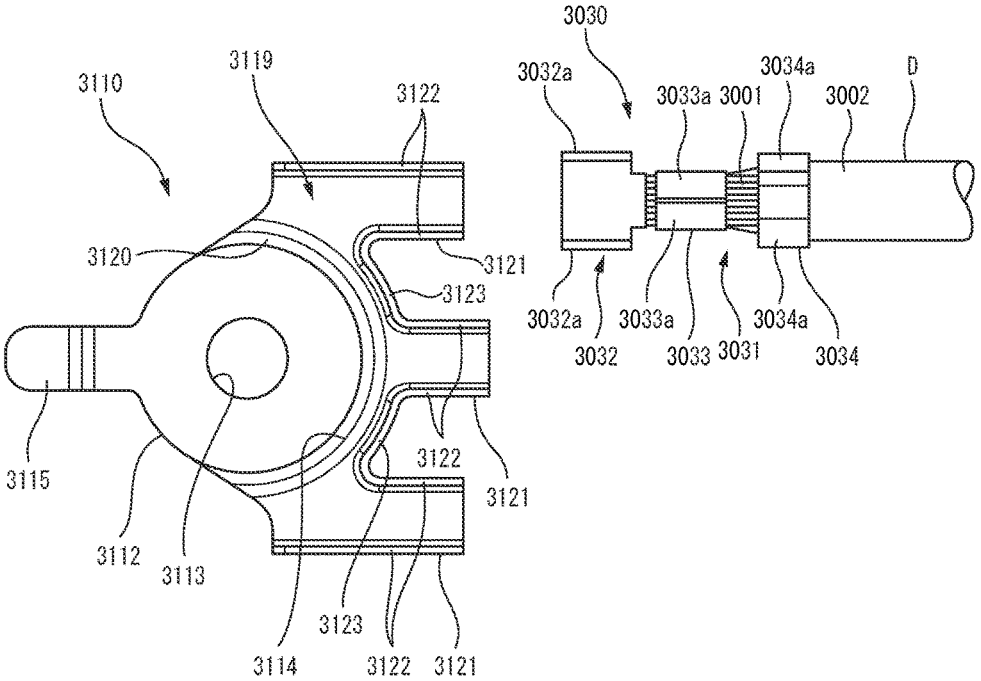

FIGS. 48A and 48B are diagrams explaining the connection structure for a terminal fitting according to Embodiment 3-5, in which FIG. 48A is a perspective view of a terminal fitting connected to a ground wire, and FIG. 48B is a plan view of the terminal fitting connected to the ground wire. FIGS. 49A and 49B are diagrams explaining the connection structure for a terminal fitting according to Embodiment 3-5, in which FIG. 49A is a perspective view of the terminal fitting and a connection terminal, and FIG. 49B is a plan view of the terminal fitting and the connection terminal.

As illustrated in FIGS. 48A, 48B, 49A and 49B, in the connection structure for a terminal fitting of the present embodiment, a terminal fitting 3110 is connected to connection terminals 3030. The terminal fitting 3110 is also electrically connected to a grounding surface such as a body of a vehicle. Thus, a ground wire D of an in-vehicle circuit is electrically connected to the grounding surface such as a body of a vehicle via the terminal fitting 3110. The connection terminal 3030 is connected to a ground wire D of a size of, for example, 8 sq.

Figure 50A:
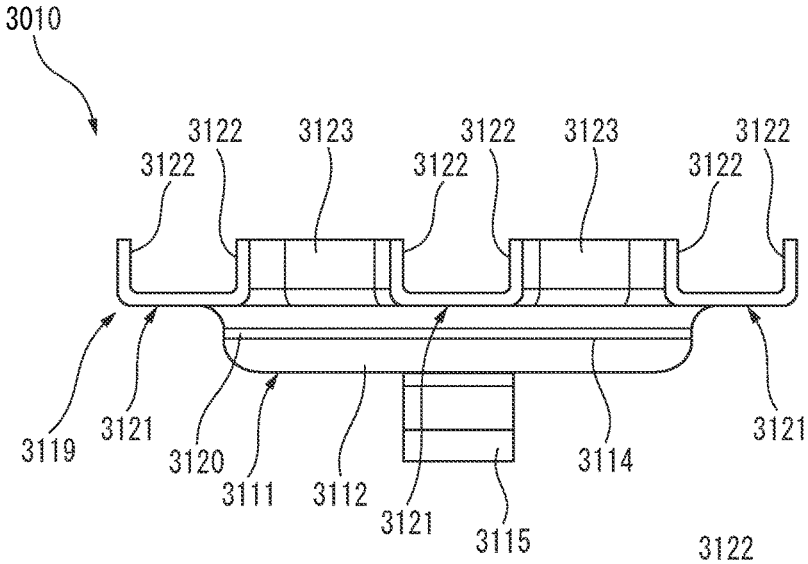
Figure 50B:
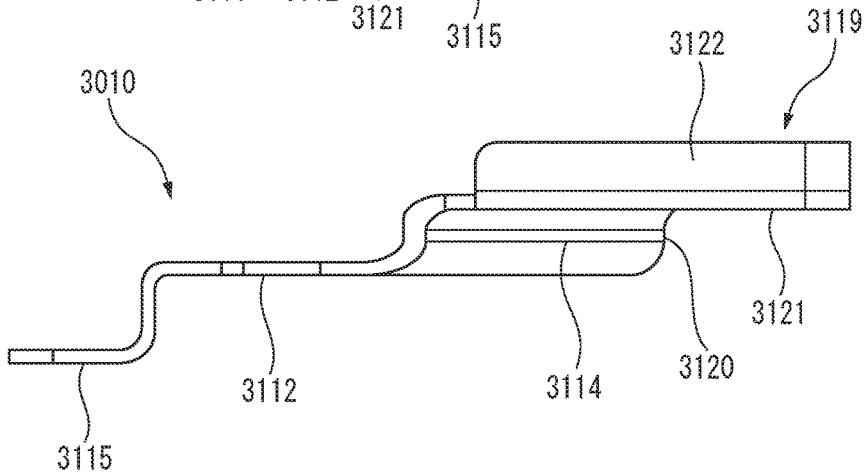
Figure 50C:
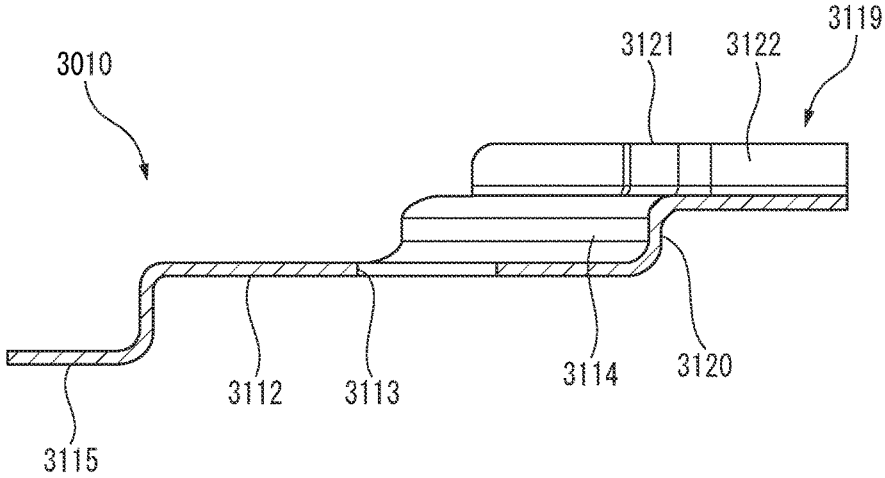
Figure 51A:
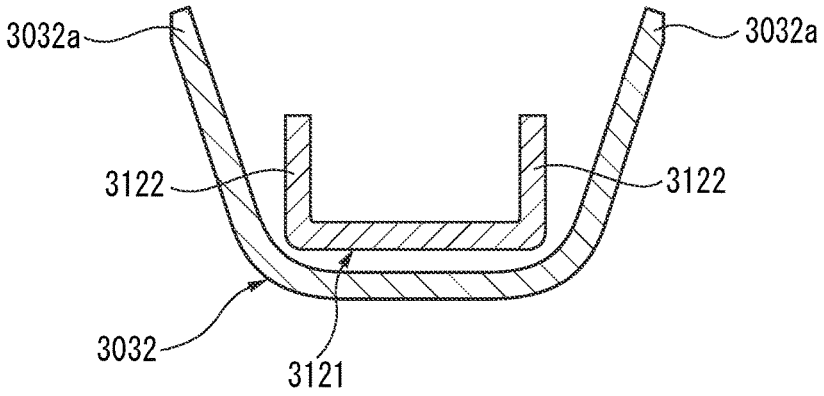
Figure 51B:
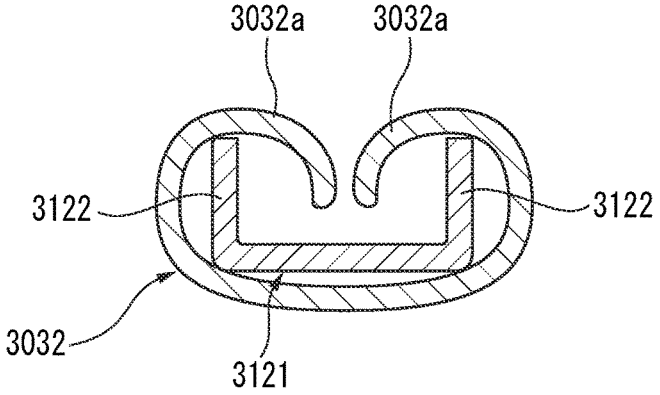
Figure 51C:
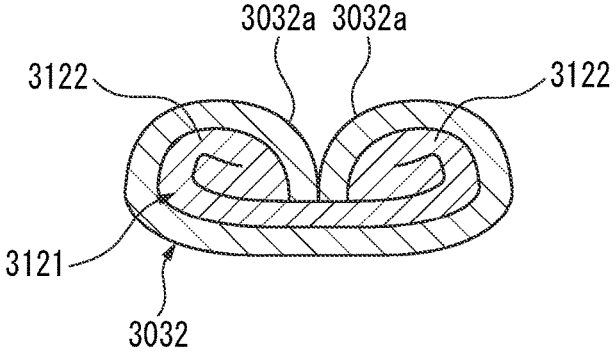

FIGS. 50A to 50C are diagrams explaining the terminal fitting, in which FIG. 50A is a front view thereof, FIG. 50B is a side view thereof, and FIG. 50C is a cross-sectional view thereof. FIGS. 51A to 51C are diagrams illustrating fastening states of crimping pieces of a fastening connecting portion to a terminal connecting portion of the terminal fitting, in which FIG. 51A is a cross-sectional view taken on line H-H of FIG. 48B before fastening with the crimping pieces, FIG. 51B is a cross-sectional view taken on line H-H of FIG. 48B during the fastening with the crimping pieces, and FIG. 51C is a cross-sectional view taken on line H-H of FIG. 48B after the fastening with the crimping pieces.

As illustrated in FIGS. 50A to 50C, the terminal fitting 3110 includes a terminal body 3111 and a wire connecting body 3119 including a plurality of terminal connecting portions 3121. The terminal fitting 3110 is a pressed product of a conductive metal plate. The terminal body 3111 has a fixing plate 3112 in a circular shape in a plan view. This fixing plate 3112 has a circular attaching hole 3113 formed at the center thereof. The terminal body 3111 is fixed to the grounding surface such as a body of a vehicle with a bolt (not illustrated) inserted through the attaching hole 3113 of the fixing plate 3112. It is noted that the attaching hole 3113 may be provided eccentrically instead of at the center of the fixing plate 3112.

Between the terminal body 3111 and the wire connecting body 3119, in substantially a half of the periphery, a connecting plate 3114 is formed, and the terminal body 3111 and the wire connecting body 3119 are linked to each other via the connecting plate 3114. In other words, in this terminal fitting 3110, the connecting plate 3114 corresponds to a linking portion 3120 between the terminal body 3111 and the wire connecting body 3119. The connecting plate 3114 projects toward one surface side, namely, toward the upper surface side. Thus, a step is formed between the fixing plate 3112 and the connecting plate 3114. Besides, in a portion of the fixing plate 3112 where the connecting plate 3114 is not provided, a rotation stopper piece 3115 is formed in a center position in the peripheral direction. The rotation stopper piece 3115 is a folded portion to be engaged with a step or a hole formed around the grounding surface to which the terminal body 3111 is fastened with the bolt, and the rotation of the terminal fitting 3110 on the grounding surface is restricted with this rotation stopper piece 3115 engaged with the step or the hole formed around the grounding surface.

The terminal connecting portions 3121 are formed integrally with the wire connecting body 3119. The plural terminal connecting portions 3121 are provided in the wire connecting body 3119. Specifically, three terminal connecting portions 3121 are formed in the wire connecting body 3119. These terminal connecting portions 3121 are extended, on the same plane, to protrude in the same direction from a peripheral portion of the fixing plate 3112 and are disposed at intervals in the width direction. It is noted that the center terminal connecting portion 3121 is protruded in the extending direction beyond the terminal connecting portions 3121 disposed on the both sides.

Each terminal connecting portion 3121 has, as both sides thereof, engagement walls 3122 protruding toward one surface side, namely, the upper surface side. Thus, each terminal connecting portion 3121 is formed in a recessed shape in a front view. It is noted that the engagement walls 3122 of the terminal connecting portions 3121 adjacent to each other are formed continuously to a peripheral wall 3123 formed on the side of the fixing plate 3112.

For connecting the ground wire D to the terminal fitting 3110, the sheath 3002 is first removed at the end of the ground wire D to expose the conductor portion 3001. Then, with the end of the ground wire D disposed on the wire connecting portion 3031 of the connection terminal 3030 having been separated from the carrier 3035, the conductor crimping portion 3033 is crimped and the sheath crimping portion 3034 is crimped. Thus, the ground wire D is connected to the connection terminal 3030.

Subsequently, the fastening connecting portion 3032 of the connection terminal 3030 having been connected to the ground wire D is placed on the rear surface of the terminal connecting portion 3121 of the wire connecting body 3119, and the crimping pieces 3032*a* are crimped.

Here, if the crimping pieces 3032*a* are crimped, as illustrated in FIG. 51A, with the terminal connecting portion 3121 of the wire connecting body 3119 disposed within the U-shaped fastening connecting portion 3032 of the connection terminal 3030, the crimping pieces 3032*a* roll up the both sides of the terminal connecting portion 3121 of the wire connecting body 3119 at the beginning of the crimping as illustrated in FIG. 51B. Thereafter, as illustrated in FIG. 51C, the crimping pieces 3032*a* are crimped so as to externally roll up the engagement walls 3122 of the terminal connecting portion 3121, and thus, the engagement walls 3122 are curled up to be tightly held inside the crimping pieces 3032*a*, and the terminal connecting portion 3121 is filled within the fastening connecting portion 3032. Accordingly, the fastening connecting portion 3032 is firmly fastened to the terminal connecting portion 3121 at high contact pressure, and the terminal fitting 3110 and the connection terminal 3030 are definitely electrically connected to each other.

Besides, the crimping pieces 3032*a* may be precedently bent into a curved shape as illustrated in FIG. 51B in a separate step before crimping the crimping pieces 3032*a*, and then the crimping pieces 3032*a* may be crimped with the terminal connecting portion 3121 disposed in the crimping pieces 3032*a* in this state.

The connection terminal 3030 is fastened to each of the terminal connecting portions 3121 of the wire connecting body 3119 of the terminal fitting 3110 in the above-described manner. Thus, the plural ground wires D are electrically connected all together to the terminal fitting 3110. Then, the terminal fitting 3110 is fixed to the grounding surface of a vehicle with a bolt so as to ground the plural ground wires D.

As described so far, also in the connection structure for a terminal fitting of Embodiment 3-5, when the crimping pieces 3032*a* of the connection terminal 3030 connected to a plurality of ground wires D are crimped to the plural terminal connecting portions 3121 of the terminal fitting 3010, the connection terminal 3030 can be fastened to the terminal fitting 3010, and the plural ground wires D can be electrically connected all together to the terminal fitting 3010 in the same manner as in Embodiment 3-4. As a result, as compared with a structure in which terminal fittings connected to respective wires are stacked and fastened for electrical connection, there is no need to stack the terminal fittings 3110, the weight increase of the terminal fitting can be suppressed even if the number of wires is increased. Besides, since there is no need to stack terminal fittings, even if the number of wires to be electrically connected is increased, the thickness increase can be avoided, and hence the space can be saved. In addition, since the connection terminal 3030 is fastened to the terminal connecting portion 3121 of the terminal fitting 3110, there is no need to provide a special mechanism for holding the connection terminal 3030. Thus, as compared with a joint connector that needs to have a holding mechanism for holding a terminal in a housing, the size and the cost can be reduced.

Besides, since the connection terminal 3030 separately provided is fastened and connected to the terminal fitting 3110 in this structure, connection terminals 3030 respectively connected ground wires D of different sizes can be fastened and electrically connected to the terminal connecting portions 3121. In other words, this structure is applicable to ground wires D of various sizes without changing the connection form between the terminal connecting portion 3121 of the terminal fitting 3110 and the fastening connecting portion 3132 of the connection terminal 3030. Besides, if terminal fittings 3110 respectively having different numbers of terminal connecting portions 3121 are prepared, this structure can easily deal with the increase/decrease of the number of ground wires D to be electrically connected.

In other words, also in employing the connection structure for a terminal fitting according to Embodiment 3-5, change in the number or the size of ground wires D to be electrically connected can be dealt with by minimum variations of the terminal fitting 3110.

In addition, since the connection terminals 3030 are fastened to the plural terminal connecting portions 3121 of the wire connecting body 3119 of the terminal fitting 3110 in this structure, the connection terminals 3030 can be fastened to the terminal connecting portions 3121 as needed, and as a result, the number of ground wires D to be electrically connected all together can be easily increased/decreased within the limit of the number of the terminal connecting portions 3121.

Besides, the engagement walls 3122 to be engaged with the crimping pieces 3032*a* are formed as the both sides of the terminal connecting portion 3121. Accordingly, when the crimping pieces 3032*a* of the connection terminal 3030 are crimped to the terminal connecting portion 3121, the crimping pieces 3032*a* are engaged with the engagement walls 3122 of the terminal connecting portion 3121. Thus, the crimping pieces 3032*a* are definitely crimped to the terminal connecting portion 3121, so as to further increase the connection strength of the terminal connecting portion 3121 to the connection terminal 3030, and the electrical resistance in the connection portion can be stabilized to attain good electrical connection.

In addition, the terminal connecting portions 3121 are extended on the same plane in the same direction at intervals. Accordingly, a direction for connecting the connection terminal 3030 to the terminal fitting 3110 and a wiring direction of the ground wire D can be the same, and hence, the workability in fastening the connection terminal 3030 to the terminal connecting portion 3121 of the terminal fitting 3110 can be improved. Besides, the wiring directions of the ground wires D can be aligned in the same direction along a trunk line, and in addition, unwanted spread of the ground wires D and bending of the ground wire D in the vicinity of the connection terminal 3030 can be minimized.

Besides, also in the connection structure for a terminal fitting of Embodiment 3-5, in the disassembly, the plural ground wires D can be separated all together from the terminal body 3111 by separating the wire connecting body 3119 linked to the terminal body 3111 through the liking portion 3120, and hence, good recyclability can be obtained.

In addition, when the linking strength is adjusted by adjusting the thickness of or forming a notch in the linking portion 3120 corresponding to the connecting plate 3114, which links the terminal body 3111 and the wire connecting body 3119 to each other, in accordance with the wiring conditions such as the diameter and the number of the ground wires D to be connected, a good separation property can be obtained in the disassembly while definitely obtaining the connection strength in the wiring, and thus, both the durability and the recyclability can be attained. The linking strength between the terminal body 3111 and the wire connecting body 3119 can be adjusted, for example, in a range from strength necessary for the connection to strength realizing a good separation property (for example, from 100 N to 500 N).

Furthermore, also in the terminal connecting portion 3121 of the terminal fitting 3010 of Embodiment 3-5, an engaging piece may be formed at the upper end of each engagement wall 3122 as in Embodiment 3-4, and the cross-sectional shape of the engagement walls may be in the shape of V.

Although the terminal fitting 3010 has three terminal connecting portions 3121 in the above-described exemplified case, the number of the terminal connecting portions 3121 of the wire connecting body 3119 of the terminal fitting 3110 is not limited to three as long as it is plural.

Modification of Embodiment 3-5

Next, as a modification of Embodiment 3-5, a connection structure for a terminal fitting including a different number of terminal connecting portions 3121 will be described. It is noted that like reference signs are used to refer to like elements used in the exemplified structure described above to omit the description.

Figure 52A:
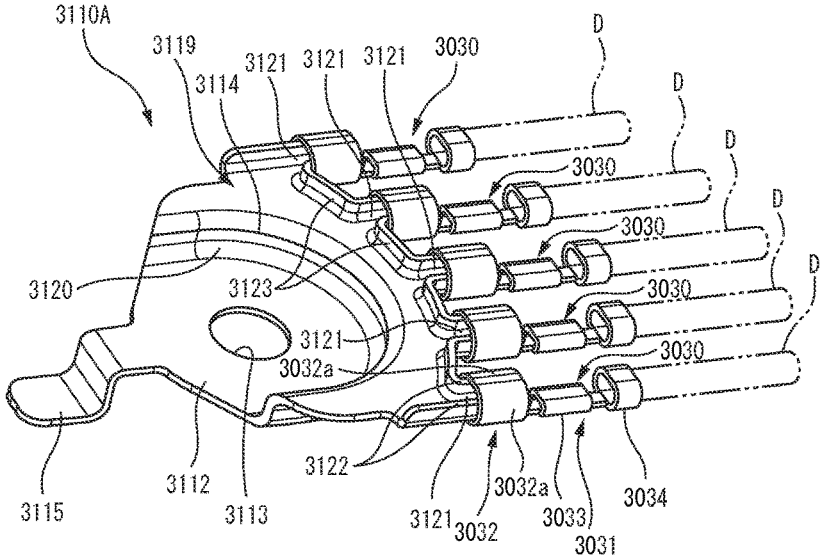
Figure 52B:
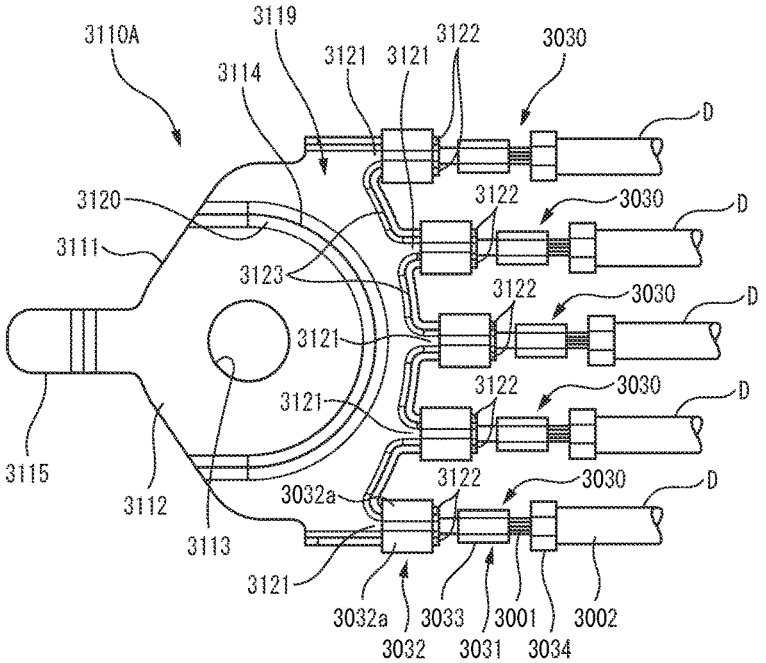
Figure 53A:
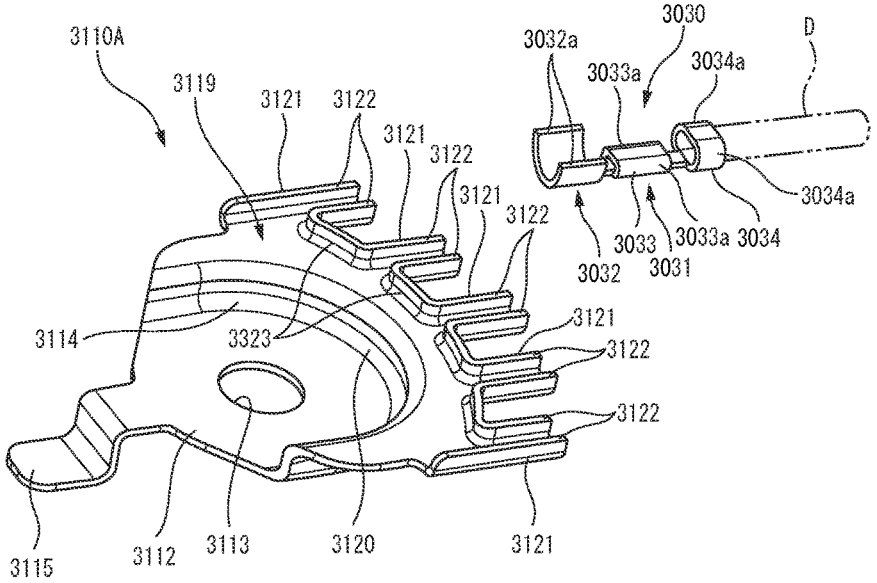
Figure 53B:
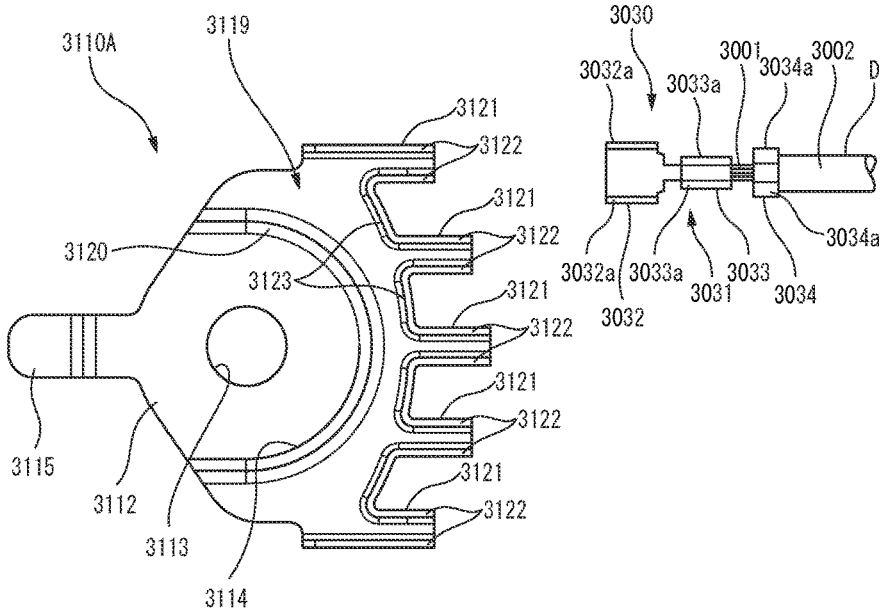

FIGS. 52A and 52B are diagrams explaining a connection structure for a terminal fitting according to a modification of Embodiment 3-5, in which FIG. 52A is a perspective view of a terminal fitting connected to a ground wire, and FIG. 52B is a plan view of the terminal fitting connected to the ground wire. FIGS. 53A and 53B are diagrams explaining the connection structure for a terminal fitting according to the modification of Embodiment 3-5, in which FIG. 53A is a perspective view of the terminal fitting and a connection terminal, and FIG. 53B is a plan view of the terminal fitting and the connection terminal.

As illustrated in FIGS. 52A, 52B, 53A and 53B, the terminal fitting 3110A includes five terminal connecting portions 3121 in a wire connecting body 3119. These terminal connecting portions 3121 are also extended in the same direction and are disposed at intervals in the width direction. In addition, a connection terminal 3030 is fastened to each of the terminal connecting portions 3121 of the wire connecting body 3119 of this terminal fitting 3110A for connection to the ground wire D. The connection terminal 3030 is connected to the ground wire D of a size smaller than 8 sq., for example, a size of 0.5 sq.

Thus, when the terminal fitting 3110A having five terminal connecting portions 3121 is used, a larger number of ground wires D of a smaller size can be electrically connected all together to be grounded.

In addition, in Embodiments 4 and 3-5 described above, the ground wire D of the in-vehicle circuit (the auxiliary device) is connected to the terminal fitting 3010, 3110 or 3110A to be grounded all together, but a wire to be connected to the terminal fitting 3010, 3110 or 3110A is not limited to a wire for grounding.

Besides, instead of providing the rotation stopper piece 3015 or 3115 to the terminal body 3011 or 3111 of the terminal fitting 3010, 3110 or 3110A, a step or a rotation stopper piece to be brought into contact with and stop rotation of the terminal fitting 3010, 3110 or 3110A when the terminal fitting 3010, 3110 or 3110A is attached onto the grounding surface may be provided on the side of the grounding surface.

Embodiment 4-1

In the case where a connecting portion of a terminal fitting and a connecting member made of conductive metal materials are connected to each other for electrical connection, if an oxide coating film is formed on the surfaces of the connecting portion and the connecting member, connection reliability may be degraded after the connection.

In such a case, high connection reliability can be obtained if the connecting portion and the connecting member are connected to each other by the thermal welding. In connection between different metals such as connection between copper or copper alloy and aluminum, however, it is difficult to perform the thermal welding.

In consideration of these circumstances, a connection structure for a terminal fitting according to this embodiment of the present invention may be configured so that terminals made of conductive metal materials can be easily connected to each other to obtain high connection reliability.

Figure 54A:
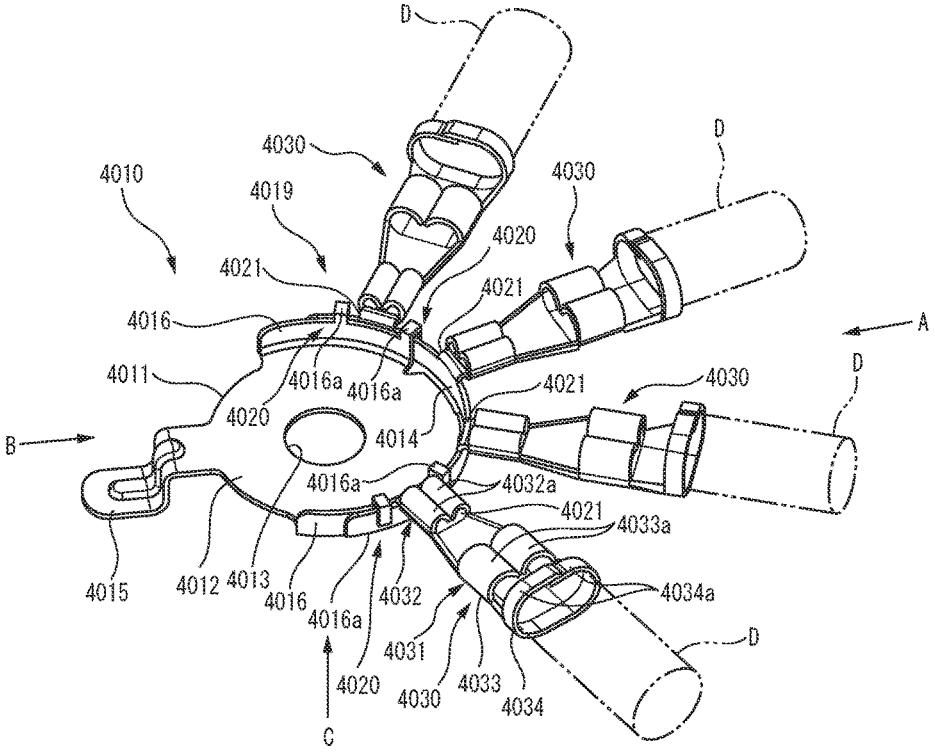
Figure 54B:
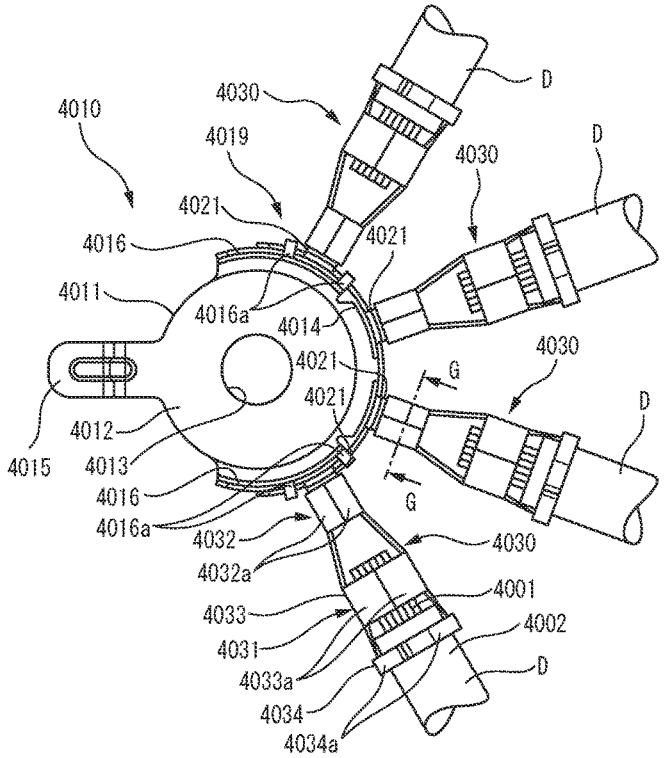

Specifically, FIGS. 54A and 54B are diagrams explaining a connection structure for terminals according to Embodiment 4-1, in which FIG. 54A is a perspective view of a terminal fitting connected to a ground wire, and FIG. 54B is a plan view of the terminal fitting connected to the ground wire.

As illustrated in FIGS. 54A and 54B, in the connection structure for terminals of Embodiment 4-1, a terminal connecting portion (a terminal) 4021 of a terminal fitting 4010 and a connection terminal (a terminal) 4030 are connected to each other. The terminal fitting 4010 is electrically connected to a grounding surface such as a body of a vehicle. The connection terminal 4030 connected to the terminal fitting 4010 is provided at an end of a ground wire (a wire) D of an in-vehicle circuit (an auxiliary device). The ground wire D has a conductor portion 4001 and a sheath 4002 covering the conductor portion 4001, and the conductor portion 4001 is exposed from the sheath 4002 at its end to be connected to the connection terminal 4030. The conductor portion 4001 of the ground wire D is electrically connected to the connection terminal 4030. Thus, the ground wire D of the in-vehicle circuit and the grounding surface such as a body of a vehicle are electrically connected to each other via the terminal fitting 4010.

Figure 55:
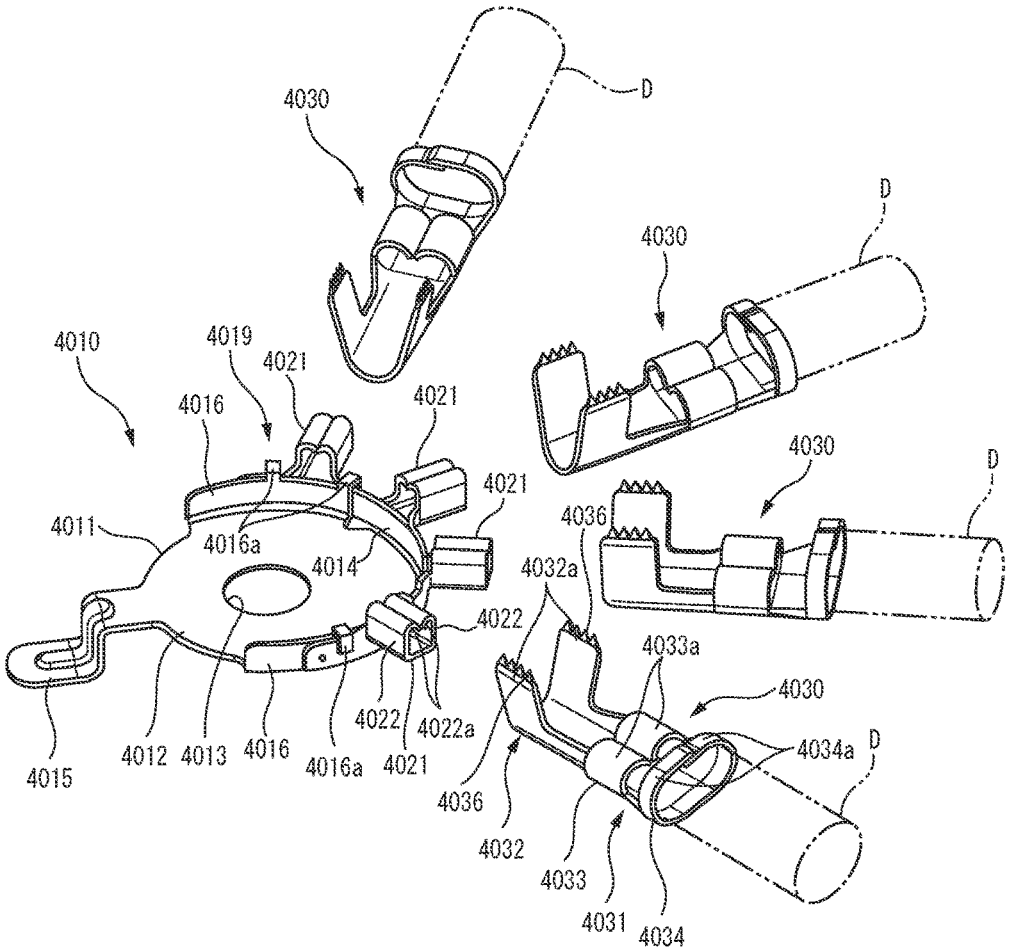
FIG. 55 is a perspective view of the terminal fitting and a connection terminal for explaining the connection structure for terminals according to Embodiment 4-1.
Figure 56A:
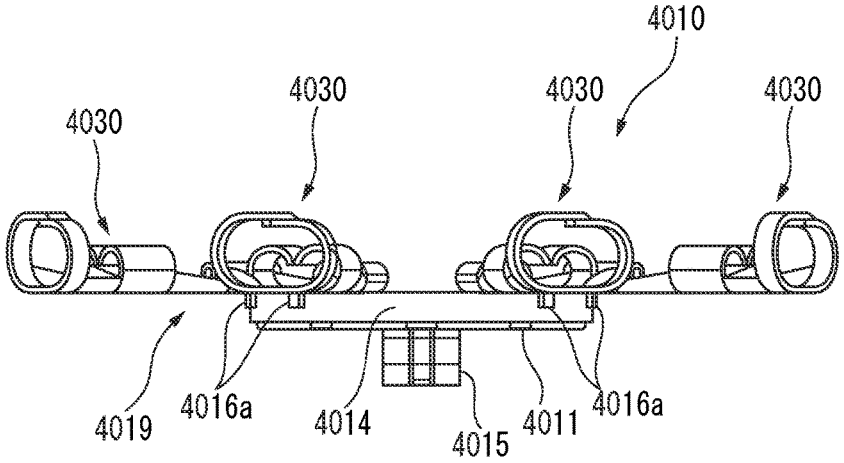
Figure 56B:
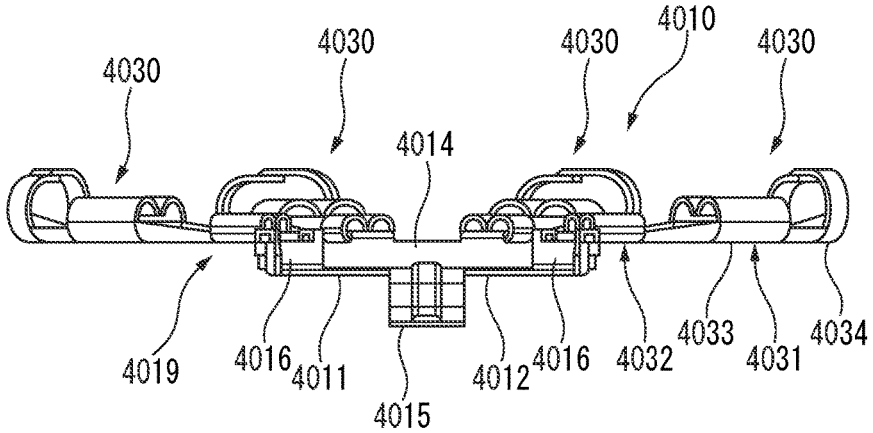
Figure 56C:
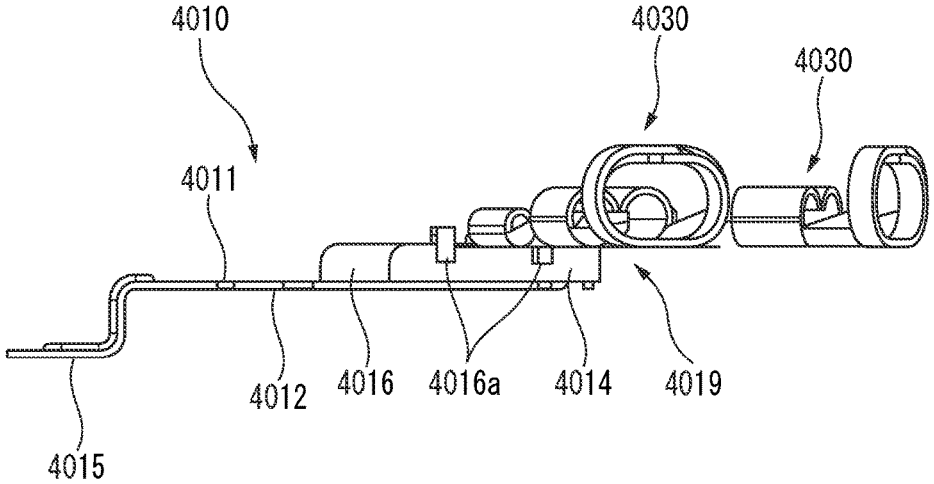
Figure 57:
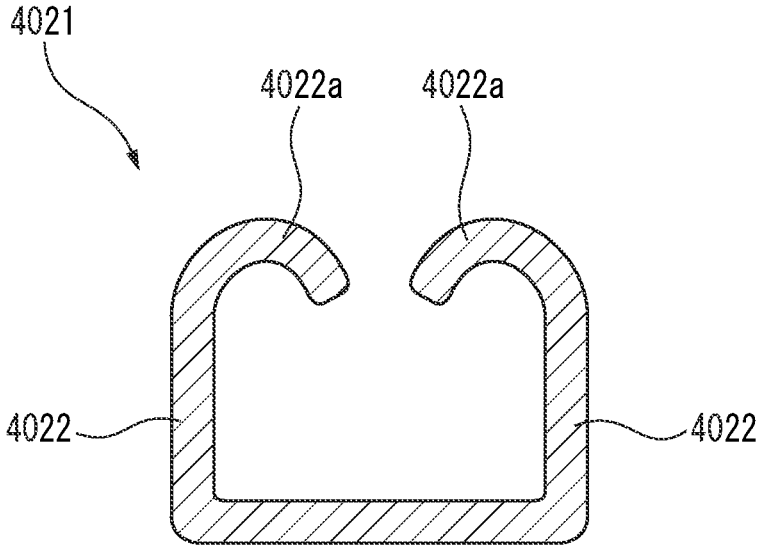
FIG. 57 is a cross-sectional view of a terminal connecting portion of the terminal fitting.

FIG. 55 is a perspective view illustrating the terminal fitting and the connection terminal for explaining the connection structure for terminals according to Embodiment 4-1. FIGS. 56A to 56C are diagrams explaining the connection structure for terminals according to Embodiment 4-1, in which FIG. 56A is a view taken on arrow A of FIG. 54A, FIG. 56B is a view taken on arrow B of FIG. 54A, and FIG. 56C is a view taken on arrow C of FIG. 54A. FIG. 57 is a cross-sectional view of the terminal connecting portion of the terminal fitting.

As illustrated in FIGS. 55 and 56A to 56C, the terminal fitting 4010 includes a terminal body 4011 and a wire connecting body 4019 having a plurality of terminal connecting portions 4021. The terminal fitting 4010 is a pressed product of a conductive metal plate. The terminal body 4011 has a fixing plate 4012 in a circular shape in a plan view. The fixing plate 4012 has a circular attaching hole 4013 formed at the center thereof. The terminal body 4011 is fixed to the grounding surface such as a body of a vehicle with a bolt (not illustrated) inserted through the attaching hole 4013 of the fixing plate 4012. It is noted that the attaching hole 4013 may be provided eccentrically instead of at the center of the fixing plate 4012.

A rotation stopper piece 4015 is formed in a part of the fixing plate 4012. The rotation stopper piece 4015 is a folded portion to be engaged with a step or a hole formed around the grounding surface to which the terminal body 4011 is fastened with the bolt, and the rotation of the terminal fitting 4010 on the grounding surface is restricted with this rotation stopper piece 4015 engaged with the step or the hole formed around the grounding surface.

The fixing plate 4012 has, on its periphery, two supporting walls 4016 each in an arc shape in a plan view. These supporting walls 4016 are provided to rise toward one surface side, namely, toward the upper surface side, of the fixing plate 4012. Besides, the wire connecting body 4019 has, in substantially a half of the periphery of the fixing plate 4012, a connecting plate 4014 in an arc shape in a plan view. The connecting plate 4014 is provided to rise toward one surface side, namely, toward the upper surface side, of the fixing plate 4012. The connecting plate 4014 is disposed along the outer circumferences of the supporting walls 4016.

Each supporting wall 4016 has a plurality of catching pieces 4016*a* formed at the upper edge thereof. These catching pieces 4016*a* are folded toward an outer surface of the connecting plate 4014, and thus, the connecting plate 4014 is supported by the supporting walls 4016 with both ends thereof caught by the catching pieces 4016*a*.

Thus, in the terminal fitting 4010, portions where the connecting plate 4014 is caught by the catching pieces 4016*a* of the supporting walls 4016 correspond to linking portions 4020. In other words, the terminal fitting 4010 has a plurality of linking portions 4020, and the plural linking portions 4020 link the terminal body 4011 and the wire connecting body 4019 to each other.

The terminal connecting portions 4021 are formed integrally with the connecting plate 4014 of the terminal body 4011. The plural terminal connecting portions 4021 are provided in an upper edge portion of the connecting plate 4014. Specifically, four terminal connecting portions 4021 are formed in the connecting plate 4014. These terminal connecting portions 4021 are extended, on the same plane, to radially protrude from a peripheral portion of the fixing plate 4012.

As illustrated in FIG. 57, each terminal connecting portion 4021 has, as both sides thereof, engagement walls (side walls) 4022 protruding toward one surface side, namely, the upper surface side. Thus, each terminal connecting portion 4021 is formed in a recessed shape in a front view. Besides, each of these engagement walls 4022 has, at an upper end thereof, an engaging piece 4022*a* curved and folded inward in an arc shape.

Figure 58:
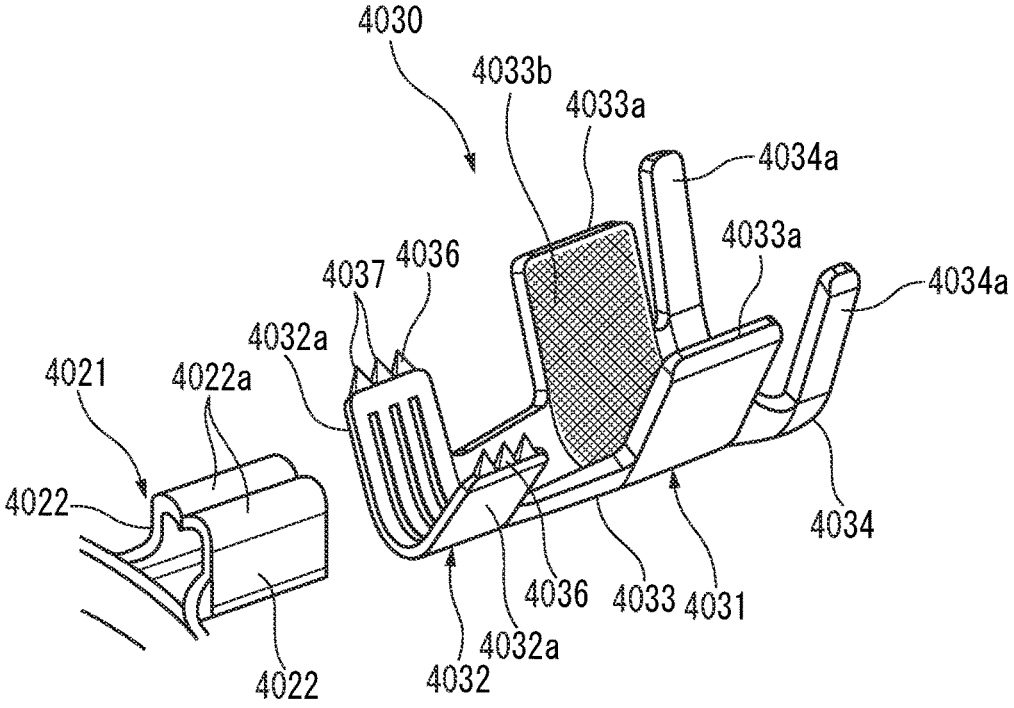
FIG. 58 is a perspective view of the terminal connecting portion and the connection terminal.
Figure 59:
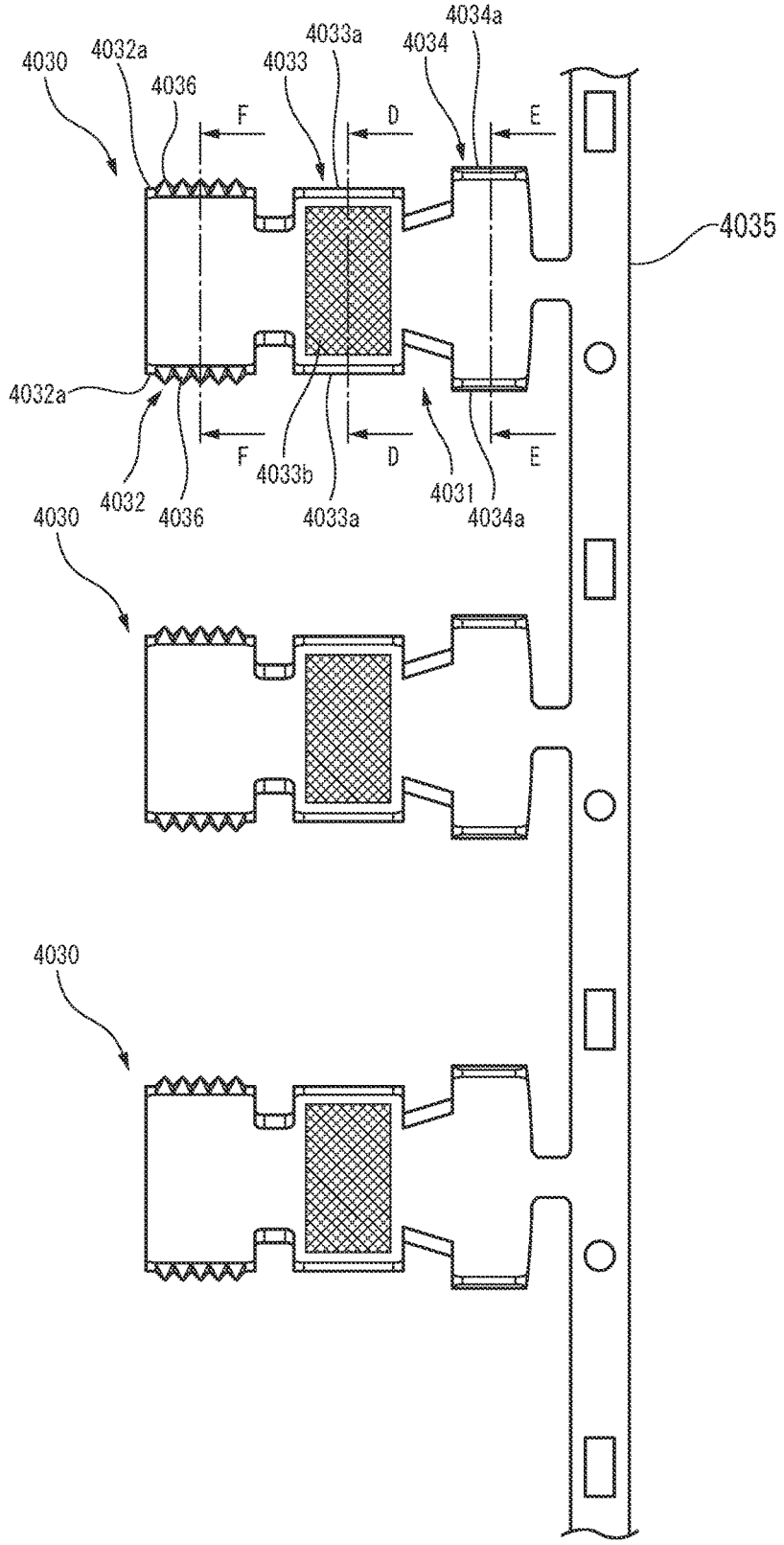
FIG. 59 is a plan view of the connection terminal linked to a carrier.
Figure 60A:
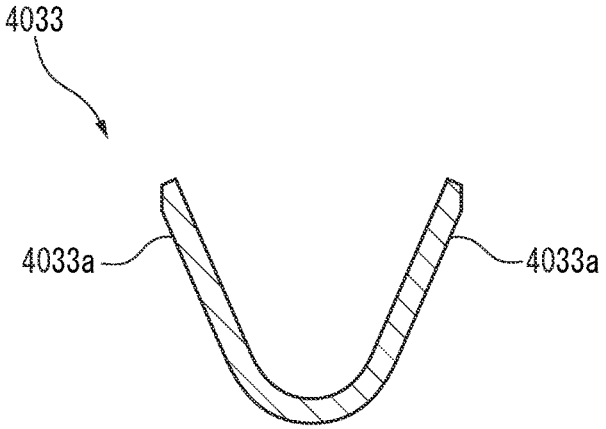
Figure 60B:
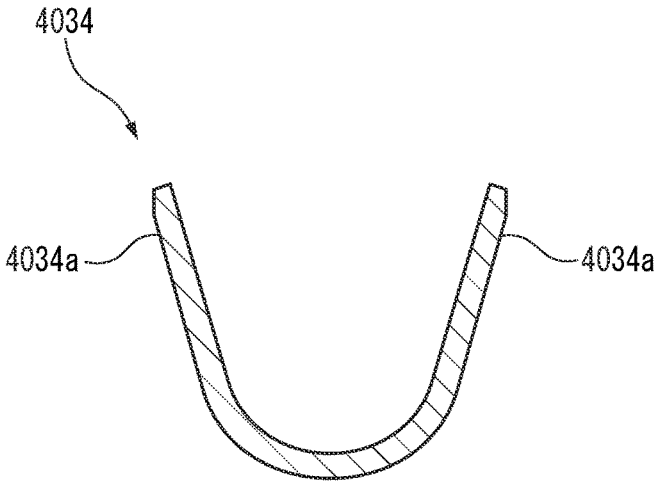
Figure 60C:
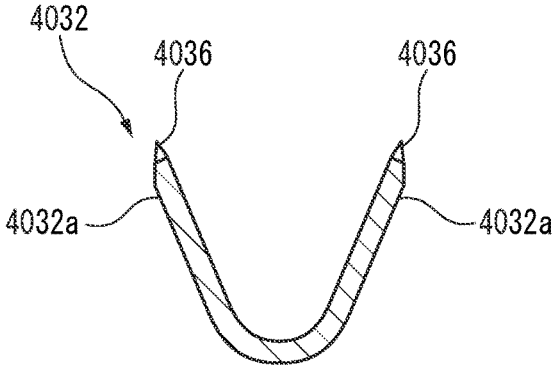
Figure 61A:
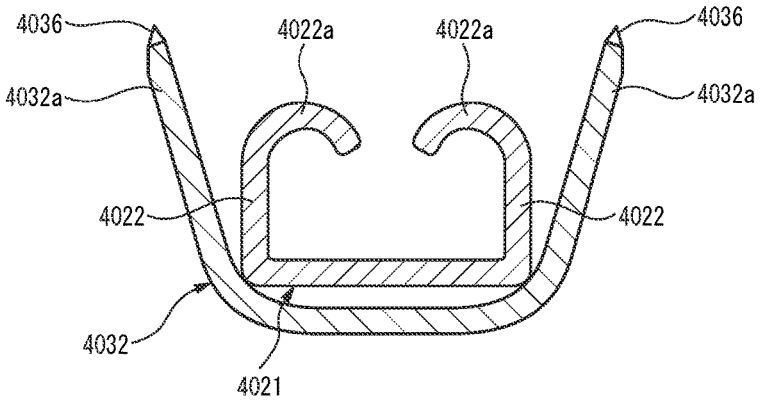
Figure 61B:
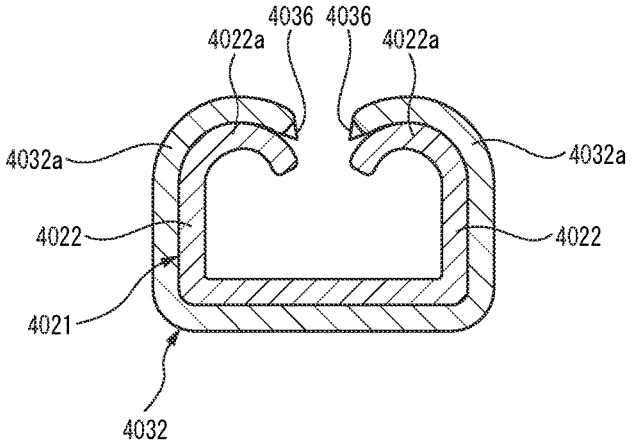
Figure 61C:
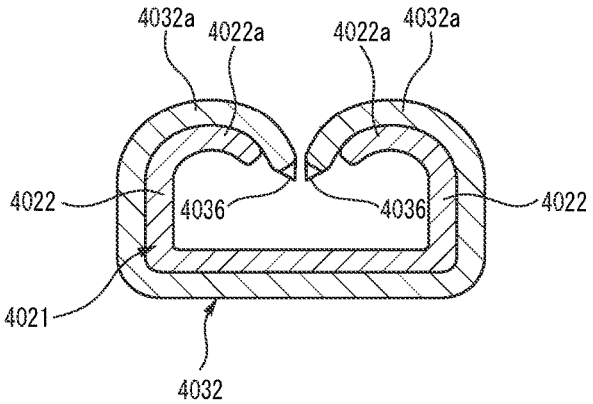
Figure 61D:
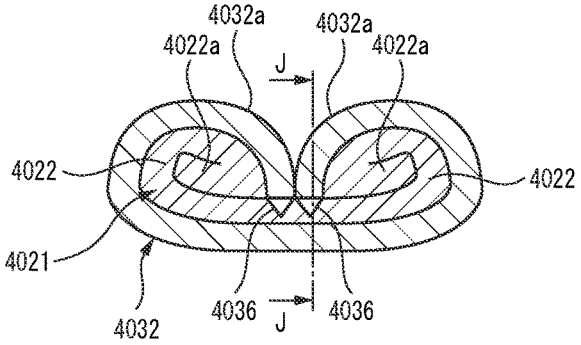
Figure 62:
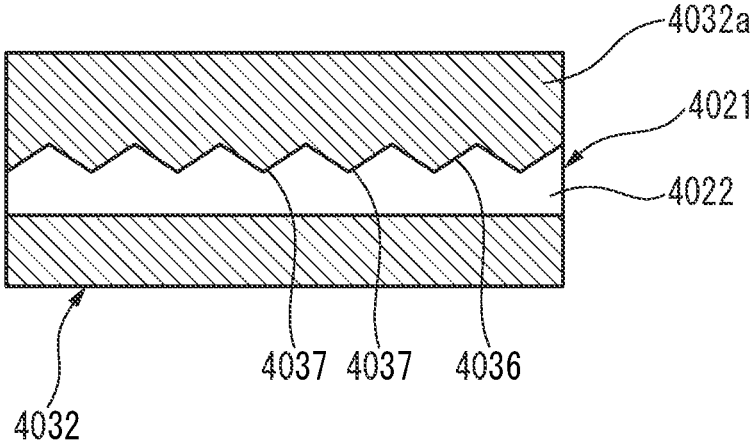
FIG. 62 is a cross-sectional view taken on line J-J of FIG. 61D.

FIG. 58 is a perspective view of the terminal connecting portion and the connection terminal. FIG. 59 is a plan view of the connection terminal linked to a carrier. FIGS. 60A to 60C are diagrams explaining the connection terminal, in which FIG. 60A is a cross-sectional view taken on line D-D of FIG. 59, FIG. 60B is a cross-sectional view taken on line E-E of FIG. 59, and FIG. 60C is a cross-sectional view taken on line F-F of FIG. 59. FIGS. 61A to 61D are diagrams illustrating fastening states of crimping pieces of a fastening connecting portion to the terminal connecting portion of the terminal fitting, in which FIG. 61A is a cross-sectional view taken on line G-G of FIG. 54B before fastening with the crimping pieces, FIG. 61B is a cross-sectional view taken online G-G of FIG. 54B at the beginning of the fastening with the crimping pieces, FIG. 61C is a cross-sectional view taken online G-G of FIG. 54B during the fastening with the crimping pieces, and FIG. 61D is a cross-sectional view taken on line G-G of FIG. 54B after the fastening with the crimping pieces. FIG. 62 is a cross-sectional view taken on line J-J of FIG. 61D.

As illustrated in FIG. 58, the connection terminal 4030 has a wire connecting portion 4031 and a fastening connecting portion 4032. The ground wire D is connected to the wire connecting portion 4031. The connection terminal 4030 provided on the ground wire D is a pressed product made of a conductive metal plate. The fastening connecting portion 4032 is fastened to the terminal connecting portion 4021 of the terminal fitting 4010.

As illustrated in FIG. 59, the connection terminal 4030 is supplied in a state where it is linked, on the side of the wire connecting portion 4031, to a belt-shaped carrier 4035, and is used in a state where it is separated from the carrier 4035.

The wire connecting portion 4031 has a conductor crimping portion 4033 and a sheath crimping portion 4034.

As illustrated in FIGS. 58 and 60A, the conductor crimping portion 4033 is formed in the shape of U having a pair of conductor crimping pieces 4033*a*, and when the conductor crimping pieces 4033*a* are crimped, the conductor portion 4001 of the ground wire D is crimped and fixed in the conductor crimping portion 4033. Thus, the conductor portion 4001 of the ground wire D and the connection terminal 4030 are electrically connected to each other. Besides, on an inner surface of the conductor crimping portion 4033, a rough surface portion (a serration) 4033*b* roughened by machining is provided. Thus, the conductor portion 4001 of the ground wire D calked in the conductor crimping portion 4033 is definitely electrically connected to the connection terminal 4030.

As illustrated in FIGS. 58 and 60B, the sheath calking portion 4034 is formed in the shape of U having a pair of sheath crimping pieces 4034*a*, and when the sheath crimping pieces 4034*a* are crimped, a tip portion of the sheath 4002 of the ground wire D is crimped and fixed in the sheath crimping portion 4034.

As illustrated in FIGS. 58 and 60C, the fastening connecting portion 4032 of the connection terminal 4030 is formed in the shape of U having a pair of crimping pieces 4032*a*. Each of the crimping pieces 4032*a* of the fastening connecting portion 4032 has biting teeth 4036 formed in an upper edge portion thereof. The biting teeth 4036 are formed in an irregular shape of a plurality of pointed V-shaped projections 4037 arranged in a line. The biting teeth 4036 are formed in pressing the connection terminal 4030.

If the crimping pieces 4032*a* are crimped, as illustrated in FIG. 61A, with the terminal connecting portion 4021 of the terminal fitting 4010 disposed within the U-shaped fastening connecting portion 4032 of the connection terminal 4030, the crimping pieces 4032*a* roll up the both sides of the terminal connecting portion 4021 of the terminal body 4011 at the beginning of the crimping as illustrated in FIG. 61B. Thereafter, as illustrated in FIG. 61C, the crimping pieces 4032*a* are crimped so as to externally roll up the engagement walls 4022 of the terminal connecting portion 4021 and the engaging pieces 4022*a* provided at the upper ends thereof, and thus, the engagement walls 4022 having the engaging pieces 4022*a* are curled up to be tightly held inside the crimping pieces 4032*a* as illustrated in FIG. 61D, and the terminal connecting portion 4021 is filled within the fastening connecting portion 4032. Accordingly, the fastening connecting portion 4032 is firmly fastened to the terminal connecting portion 4021 at high contact pressure, and the terminal fitting 4010 and the connection terminal 4030 are definitely electrically connected to each other.

As illustrated in FIGS. 61D and 62, when the fastening connecting portion 4032 of the connection terminal 4030 is crimped to the terminal connecting portion 4021 of the terminal fitting 4010, the crimping pieces 4032*a* of the fastening connecting portion 4032 are pressed against the terminal connecting portion 4021, and the biting teeth 4036 formed in the upper edge portions of the crimping pieces 4032*a* bite into the terminal connecting portion 4021. Thus, even if an impurity such as an oxide coating film is formed on the surface of the terminal connecting portion 4021 of the terminal fitting 4010, since the biting teeth 4036 of the crimping pieces 4032*a* bite into the terminal connecting portion 4021 at the time of the crimping, the biting teeth 4036 come into contact with a new surface of the terminal connecting portion 4021.

Thus, the connection terminal 4030 is firmly fastened at high contact pressure, and in addition, the biting teeth 4036 of the crimping pieces 4032*a* bite into the terminal connecting portion 4021, and as a result, the terminal connecting portion 4021 and the connection terminal 4030 are electrically connected to each other definitely and with high connection reliability.

In addition, the crimping pieces 4032*a* may be precedently bent into a curved shape as illustrated in FIG. 61B in a separate step before crimping the crimping pieces 4032*a*, and then the crimping pieces 4032*a* may be crimped with the terminal connecting portion 4021 disposed in the crimping pieces 4032*a* in this state.

For connecting the ground wire D to the terminal fitting 4010, the sheath 4002 is first removed at the end of the ground wire D to expose the conductor portion 4001. Then, with the end of the ground wire D disposed on the wire connecting portion 4031 of the connection terminal 4030 having been separated from the carrier 4035, the conductor crimping portion 4033 is crimped and the sheath crimping portion 4034 is crimped. Thus, the ground wire D is connected to the connection terminal 4030.

Subsequently, the fastening connecting portion 4032 of the connection terminal 4030 having been connected to the ground wire D is placed on the rear surface of the terminal connecting portion 4021 of the terminal fitting 4010, and the crimping pieces 4032*a* are crimped. Thus, the connection terminal 4030 is firmly fastened to the terminal fitting 4010, and the conductor portion 4001 of the ground wire D is electrically connected to the terminal fitting 4010.

The connection terminal 4030 is fastened to each of the terminal connecting portions 4021 of the terminal fitting 4010 as described above. Thus, a plurality of ground wires D are electrically connected all together to the terminal fitting 4010. Then, the terminal fitting 4010 is fixed to the grounding surface of the vehicle with the bolt, and thus, the plural ground wires D are grounded.

As described so far, according to the connection structure for terminals of Embodiment 4-1, when the crimping pieces 4032*a* of the connection terminal 4030 are crimped to be fastened to the terminal connecting portion 4021, the biting teeth 4036 bite into a pressure contacting part in the pressure contacting position. Thus, even if an impurity such as an oxide coating film is formed on the surface of the pressure contacting part, the biting teeth 4036 come into contact with a new surface of the pressure contacting part. Accordingly, the connection terminal 4030 can be electrically connected to the terminal connecting portion 4021 definitely and with high connection reliability without performing the connection by troublesome thermal welding or the like. Besides, even in connection between, for example, copper or copper alloy and aluminum, which are difficult to connect by the thermal welding, the electrical connection can be obtained definitely and with high connection reliability.

In addition, since the biting teeth 4036 have a plurality of V-shaped projections 4037, when the crimping pieces 4032*a* of the connection terminal 4030 are crimped, the tips of the plural V-shaped projections 4037 of the biting teeth 4036 can be definitely caused to bite into the pressure contacting part so as to obtain good electrical connection.

Besides, according to the connection structure for terminals of the present embodiment, the connection terminal 4030 connected to the ground wire D is fastened by crimping to each of the connecting portions 4021 of the terminal fitting 4010, and thus, a plurality of ground wires D are electrically connected all together to the terminal fitting 4010 definitely and with high connection reliability.

Besides, since a plurality of ground wires D can be electrically connected all together to the terminal fitting 4010 by connecting the plural ground wires D to the terminal fitting 4010, and as a result, as compared with a structure in which terminal fittings connected to respective wires are stacked and fastened for electrical connection, there is no need to stack the terminal fittings 4010, and hence, the weight increase of the terminal fitting 4010 can be suppressed even if the number of wires D is increased. Besides, since there is no need to stack terminal fittings 4010, even if the number of wires D to be electrically connected is increased, the thickness increase of the terminal fitting 4010 can be avoided, and hence the space can be saved. In addition, since the connection terminal 4030 is fastened to the terminal connecting portion 4021 of the terminal fitting 4010, there is no need to provide a special mechanism for holding the connection terminal 4030. Thus, as compared with a joint connector that needs to have a holding mechanism for holding a terminal in a housing, the size and the cost can be reduced.

Besides, since the connection terminal 4030 separately provided is fastened and connected to the terminal fitting 4010 in this structure, connection terminals 4030 respectively connected ground wires D of different sizes can be fastened and electrically connected to the terminal connecting portions 4021. In other words, this structure is applicable to ground wires D of various sizes without changing the connection form between the terminal connecting portion 4021 of the terminal fitting 4010 and the fastening connecting portion 4032 of the connection terminal 4030. Besides, if terminal fittings 4010 respectively having different numbers of terminal connecting portions 4021 are prepared, this structure can easily deal with the increase/decrease of the number of ground wires D to be electrically connected.

Here, a plurality of ground wires D can be electrically connected all together by using, for example, a terminal fitting in which a plurality of connecting portions connectable to ground wires D are integrally formed. If such a terminal fitting is used, however, it is necessary to prepare terminal fittings in accordance with the number of ground wires D to be connected. Besides, for dealing with size change of the ground wires D, it is necessary to prepare a terminal fitting having a connecting portion according with each size of the ground wire D.

On the contrary, according to the connection structure for terminals of Embodiment 4-1, the change in the number or the size of ground wires D to be electrically connected can be dealt with by minimum variations of the terminal fitting 4010.

In addition, since the connection terminal 4030 is fastened to each of the plural terminal connecting portions 4021 of the terminal fitting 4010 in this structure, the connection terminals 4030 can be fastened to the terminal connecting portions 4021 as needed, and as a result, the number of ground wires D to be electrically connected all together can be easily increased/decreased within the limit of the number of the terminal connecting portions 4021.

Besides, the engagement walls 4022 to be engaged with the crimping pieces 4032*a* are formed as the both sides of the terminal connecting portion 4021. Accordingly, when the crimping pieces 4032*a* of the connection terminal 4030 are crimped to the terminal connecting portion 4021, the crimping pieces 4032*a* are engaged with the engagement walls 4022 of the terminal connecting portion 4021. Thus, the crimping pieces 4032*a* are definitely crimped to the terminal connecting portion 4021, so as to further increase the connection strength of the terminal connecting portion 4021 to the connection terminal 4030, and the electrical resistance in the connection portion can be stabilized to attain good electrical connection.

In particular, the engaging piece 4022*a* folded inward is formed at the upper end of each engagement wall 4022 of the terminal connecting portion 4021, the crimping piece 4032*a* can be definitely crimped to the terminal connecting portion 4021 so as to further increase the engagement force with the crimping piece 4032*a* of the connection terminal 4030, and hence, high connection strength can be definitely obtained. Thus, the electrical resistance in the connection portion can be stabilized to attain good electrical connection.

In addition, the terminal connecting portions 4021 are extended radially on the same plane. Accordingly, with the area occupied by the terminal fitting 4010 suppressed to be as small as possible, a large number of terminal connecting portions 4021 can be provided, and hence, a large number of ground wires D can be connected all together.

Besides, in the connection structure for terminals of the present embodiment, in the disassembly, the plural ground wires D can be separated all together from the terminal body 4011 by separating the wire connecting body 4019 linked to the terminal body 4011 through the liking portion 4020, and hence, good recyclability can be obtained.

In addition, when the linking strength is adjusted by adjusting the engagement force of the catching pieces 4016*a* of the linking portion 4020, which links the terminal body 4011 and the wire connecting body 4019 to each other, in accordance with the wiring conditions such as the diameter and the number of the ground wires D to be connected, a good separation property can be obtained in the disassembly while definitely obtaining the connection strength in the wiring, and thus, both the durability and the recyclability can be attained. The linking strength between the terminal body 4011 and the wire connecting body 4019 can be adjusted, for example, in a range from strength necessary for the connection to strength realizing a good separation property (for example, from 100 N to 500 N).

In addition, the biting teeth 4036 formed in the crimping pieces 4032*a* of the connection terminal 4030 are not limited to the irregular shape of a plurality of V-shaped projections 4037 arranged in a line. Besides, although the biting teeth 4036 are formed on the side of the connection terminal 4030 in the present embodiment, the biting teeth 4036 may be formed on the side of the terminal connecting portion 4021, or may be formed on both the sides of the connection terminal 4030 and the terminal connecting portion 4021.

Modification 4-1

Next, various modifications will be described.

Figure 63:
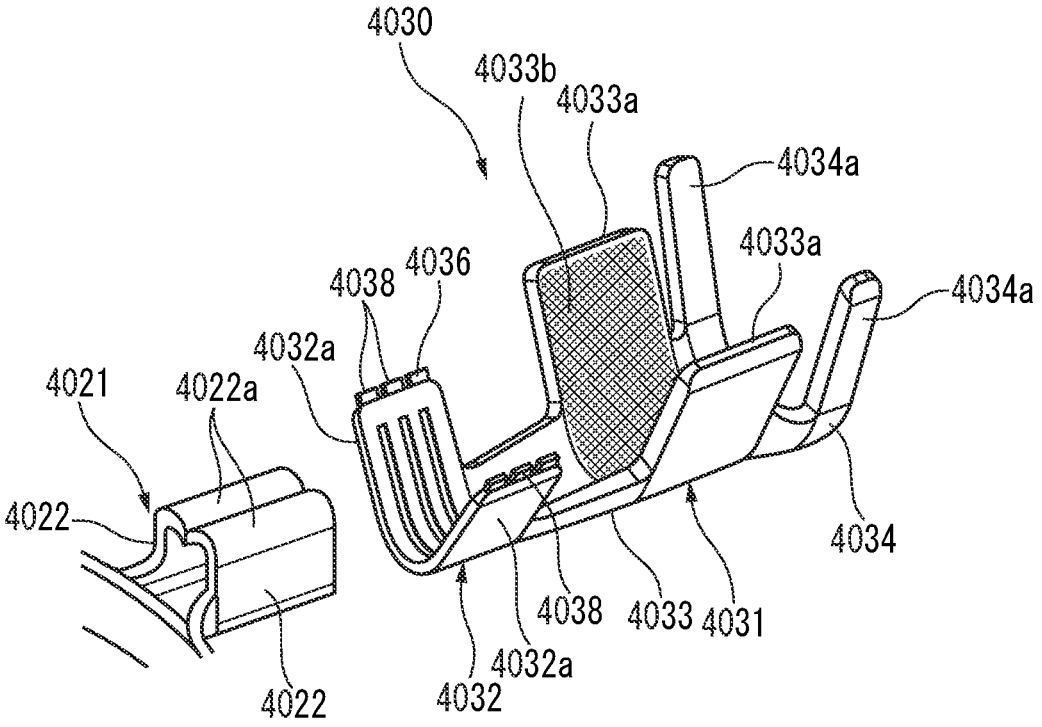
FIG. 63 is a perspective view of a terminal connecting portion and a connection terminal for explaining Modification 4-1.

FIG. 63 is a perspective view of a terminal connecting portion and a connection terminal for explaining Modification 4-1.

As illustrated in FIG. 63, in Modification 4-1, biting teeth 4036 formed in crimping pieces 4032*a* of the connection terminal 4030 are in an irregular shape of a plurality of rectangular projections 4038 arranged in a line.

Also in this Modification 4-1, when the crimping pieces 4032*a* of a fastening connecting portion 4032 of the connection terminal 4030 are crimped to the terminal connecting portion 4021 of a terminal fitting 4010, the biting teeth 4036 of a plurality of rectangular projections 4038 arranged in a line bite into the terminal connecting portion 4021. Thus, the biting teeth 4036 are brought into contact with a new surface of the terminal connecting portion 4021, so that the terminal connecting portion 4021 and the connection terminal 4030 can be electrically connected to each other with high connection reliability.

Besides, since the biting teeth 4036 include a plurality of rectangular projections 4038, when the crimping pieces 4032*a* of the connection terminal 4030 are crimped, the corners of the plural rectangular projections 4038 of the biting teeth 4036 can be definitely caused to bite into a pressure contacting part so as to obtain good electrical connection.

Modification 4-2

Figure 64:
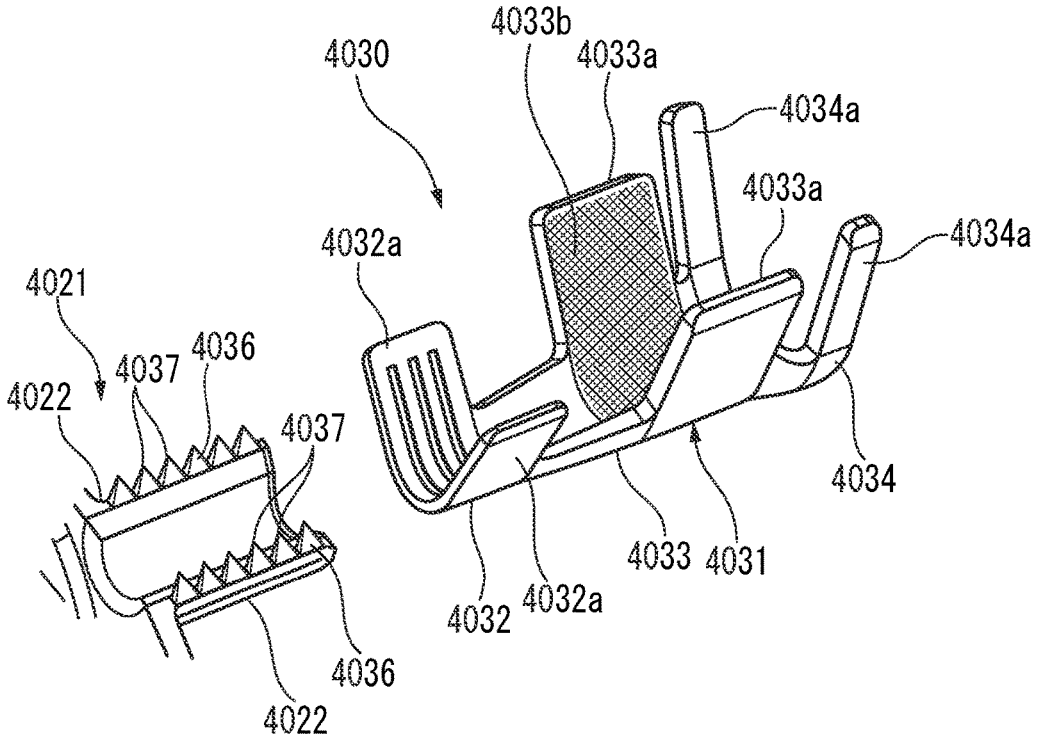
FIG. 64 is a perspective view of a terminal connecting portion and a connection terminal for explaining Modification 4-2.

FIG. 64 is a perspective view of a terminal connecting portion and a connection terminal for explaining Modification 4-2.

As illustrated in FIG. 64, in Modification 4-2, the terminal connecting portion 4021 is in a recessed cross-sectional shape including engagement walls 4022 having no engaging pieces 4022*a* at upper ends thereof. In addition, biting teeth 4036 in an irregular shape of a plurality of V-shaped projections 4037 arranged in a line are formed in upper edge portions of the engagement walls 4022 of the terminal connecting portion 4021.

In this Modification 4-2, when crimping pieces 4032*a* of a fastening connecting portion 4032 of the connection terminal 4030 are crimped to the terminal connecting portion 4021, the biting teeth 4036 of a plurality of V-shaped projections 4037 arranged in a line formed in the terminal connecting portion 4021 bite into inner surfaces of the crimping pieces 4032*a*. Thus, the biting teeth 4036 are brought into contact with a new surface of the connection terminal 4030, so that the terminal connecting portion 4021 and the connection terminal 4030 can be electrically connected to each other with high connection reliability.

In addition, since the biting teeth 4036 have the plural V-shaped projections 4037, when the crimping pieces 4032*a* of the connection terminal 4030 are crimped, the tips of the plural V-shaped projections 4037 of the biting teeth 4036 can be definitely caused to bite into the pressure contacting part so as to obtain good electrical connection.

Modification 4-3

Figure 65:
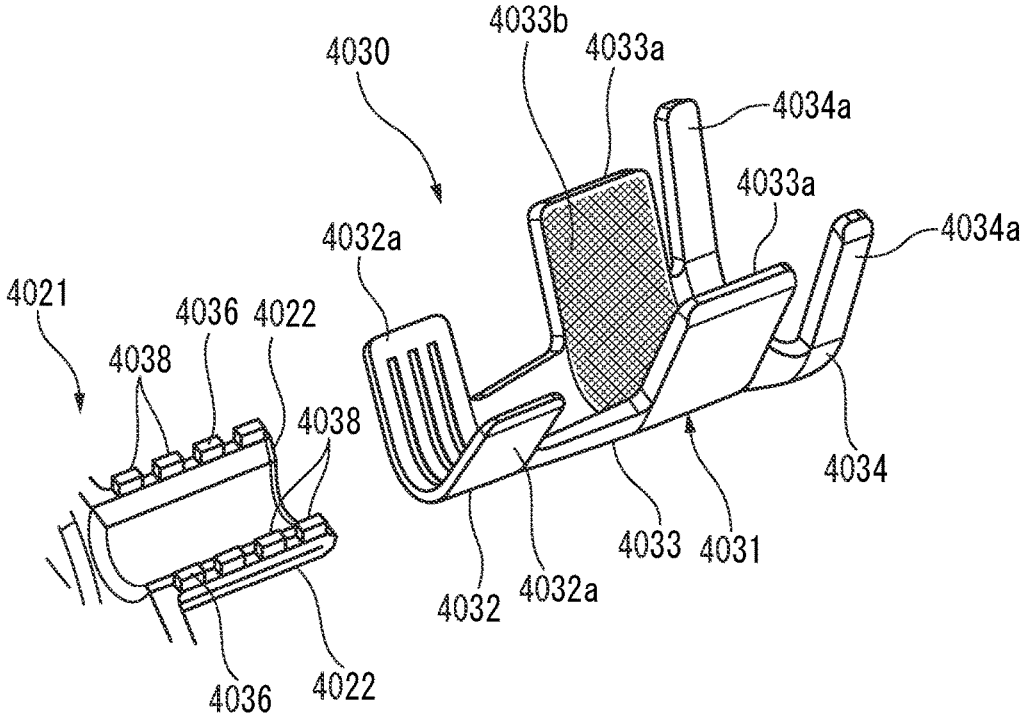
FIG. 65 is a perspective view of a terminal connecting portion and a connection terminal for explaining Modification 4-3.

FIG. 65 is a perspective view of a terminal connecting portion and a connection terminal for explaining Modification 4-3.

As illustrated in FIG. 65, also in Modification 4-3, the terminal connecting portion 4021 is in a recessed cross-sectional shape including engagement walls 4022 having no engaging pieces 4022*a* at upper ends thereof. In addition, biting teeth 4036 in an irregular shape of a plurality of rectangular projections 4038 arranged in a line are formed in upper edge portions of the engagement walls 4022 of the terminal connecting portion 4021.

In this Modification 4-3, when crimping pieces 4032*a* of a fastening connecting portion 4032 of the connection terminal 4030 are crimped to the terminal connecting portion 4021, the biting teeth 4036 of a plurality of rectangular projections 4038 arranged in a line formed in the terminal connecting portion 4021 bite into inner surfaces of the crimping pieces 4032*a*. Thus, the biting teeth 4036 are brought into contact with a new surface of the connection terminal 4030, so that the terminal connecting portion 4021 and the connection terminal 4030 can be electrically connected to each other with high connection reliability.

In addition, since the biting teeth 4036 have the plural rectangular projections 4038, when the crimping pieces 4032*a* of the connection terminal 4030 are crimped, the corners of the plural rectangular projections 4038 of the biting teeth 4036 can be definitely caused to bite into the pressure contacting part so as to obtain good electrical connection.

Modification 4-4

Figure 66:
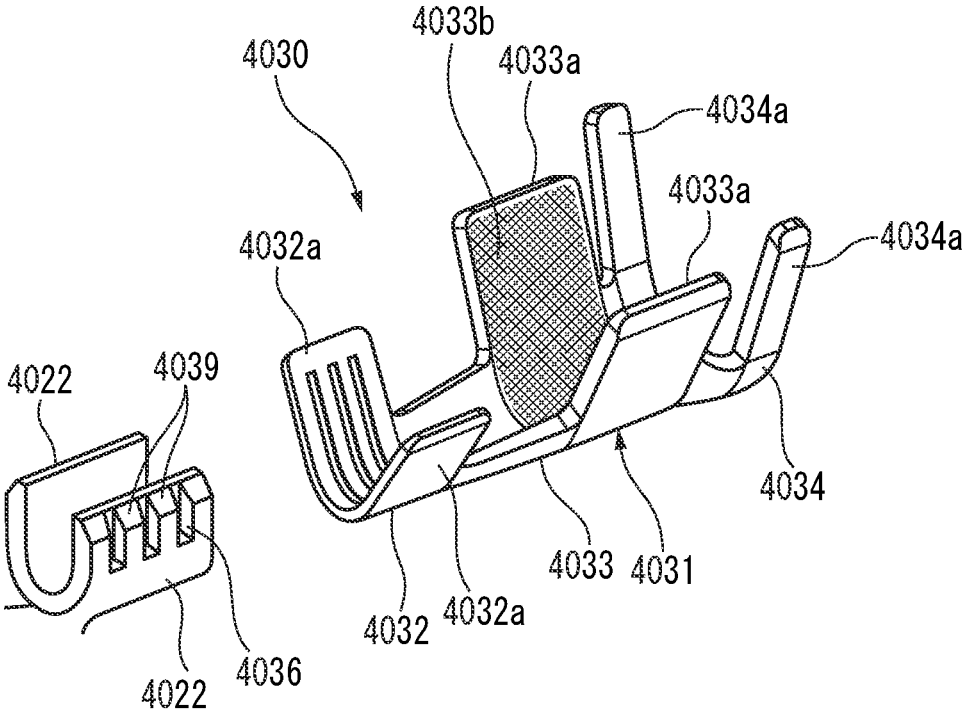
FIG. 66 is a perspective view of a terminal connecting portion and a connection terminal for explaining Modification 4-4.

FIG. 66 is a perspective view of a terminal connecting portion and a connection terminal for explaining Modification 4-4.

As illustrated in FIG. 66, also in Modification 4-4, the terminal connecting portion 4021 is in a recessed cross-sectional shape including engagement walls 4022 having no engaging pieces 4022*a* at upper ends thereof. In Modification 4-4, a plurality of grooves 4039 are formed on an outer surface in the vicinity of an upper edge portion of the terminal connecting portion 4021. These grooves 4039 are formed along a direction in which they slide while pressing against each other in crimping the crimping pieces 4032*a* to the terminal connecting portion 4021. Specifically, the grooves 4039 are formed in a direction perpendicular to the direction of connecting the terminal connecting portion 4021 and the connection terminal 4030 to each other. These grooves 4039 work as biting teeth 4036.

In Modification 4-4, when the crimping pieces 4032*a* of a fastening connecting portion 4032 of the connection terminal 4030 are crimped to the terminal connecting portion 4021, the outer surface of the terminal connecting portion 4021 is pressed against the inner surfaces of the crimping pieces 4032*a*, and hence, the biting teeth 4036 of the plural grooves 4039 formed in the terminal connecting portion 4021 bite into the inner surfaces of the crimping pieces 4032*a*. Thus, the biting teeth 4036 are brought into contact with a new surface of the connection terminal 4030, so that the terminal connecting portion 4021 and the connection terminal 4030 can be electrically connected to each other with high connection reliability.

In addition, since the biting teeth 4036 have the plural grooves 4039, when the crimping pieces 4032*a* of the connection terminal 4030 are crimped, the edges of the plural grooves 4039 of the biting teeth 4036 can be definitely caused to bite into the pressure contacting part, and hence, good electrical connection can be obtained.

In addition, although the connection terminal 4030 connected to the ground wire D is fastened to the terminal connecting portion 4021 of the terminal fitting 4010 in Embodiment 4-1 described above, it goes without saying that the present invention is applicable also to a case where terminals respectively connected to wires are fastened to be connected to each other.

Besides, in the above-described embodiment, the terminal connecting portion 4021 is in a recessed shape in a cross-sectional view having the engagement walls 4022 as the both sides, and the engaging pieces 4022*a* curved and folded inward in an arc shape are formed in the upper end portions of the engagement walls 4022, but the cross-sectional structure of the terminal connecting portion 4021 is not limited to that described above.

Figure 67:
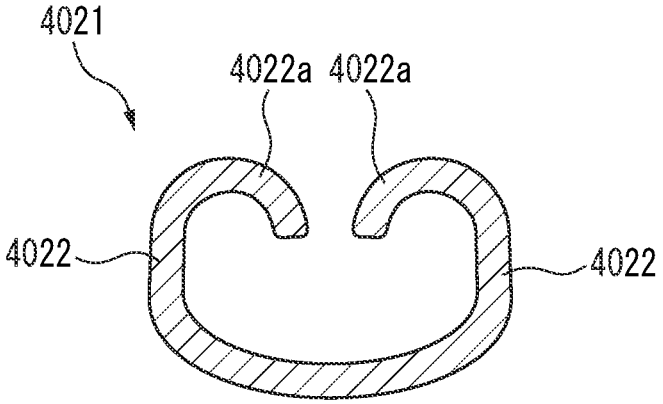
FIG. 67 is a cross-sectional view of the terminal connecting portion in another shape.
Figure 68:
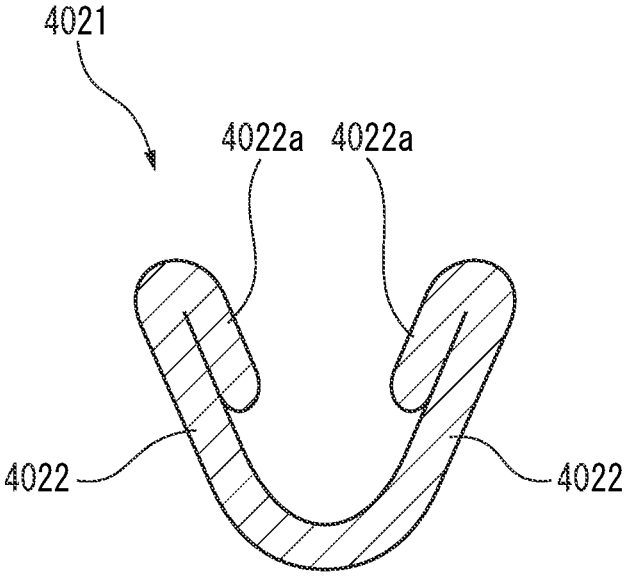
FIG. 68 is a cross-sectional view of the terminal connecting portion in still another shape.
Figure 69:
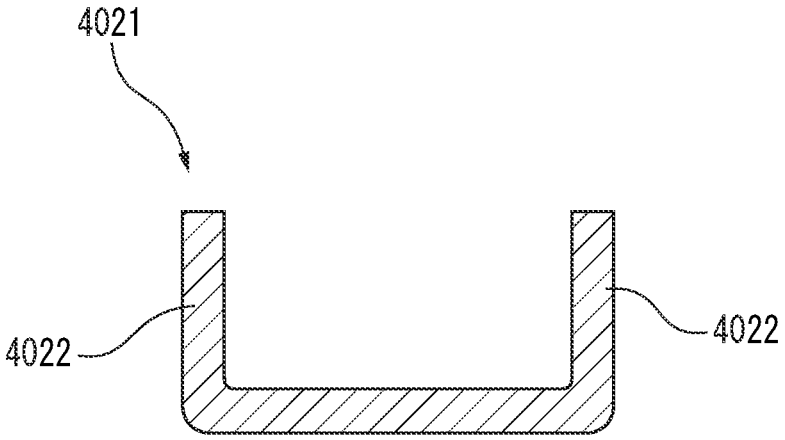
FIG. 69 is a cross-sectional view of the terminal connecting portion in still another shape.

FIGS. 67 to 69 are cross-sectional views of the terminal connecting portion in different shapes.

As illustrated in FIG. 67, the terminal connecting portion 4021 may have a bottom curved to be swollen outward. If the bottom of the terminal connecting portion 4021 is thus swollen outward, the terminal connecting portion 4021 can be more smoothly rolled up to be satisfactorily crimped in crimping the crimping pieces 4032*a*.

Alternatively, as illustrated in FIG. 68, the engagement walls 4022 of the both sides of the terminal connecting portion 4021 may be in the shape of V spreading upward in a cross-sectional view, and the engaging piece 4022*a* curved and folded inward may be formed at the upper end of each engagement wall 4022. Also in employing this shape, high connection strength can be obtained because the crimping pieces 4032*a* can be firmly engaged with the engaging pieces 4022*a* disposed at the upper ends of the engagement walls 4022 of the terminal connecting portion 4021.

In addition, if large proof tensile strength is not required between the terminal connecting portion 4021 and the connection terminal 4030, the terminal connecting portion 4021 may be in a cross-sectional structure having no engaging piece 4022*a* at the upper end of each engagement wall 4022 as illustrated in FIG. 69.

In addition, although the terminal fitting 4010 of Embodiment 4-1 described above includes four terminal connecting portions 4021, the number of the terminal connecting portions 4021 of the terminal fitting 4010 is not limited to four as long as it is plural.

Embodiment 4-2

Next, another embodiment of the connection structure for terminals will be described. It is noted that like reference signs are used to refer to like elements to omit the description because the structure is substantially the same as that of Embodiment 4-1 except for a terminal fitting.

Figure 70A:
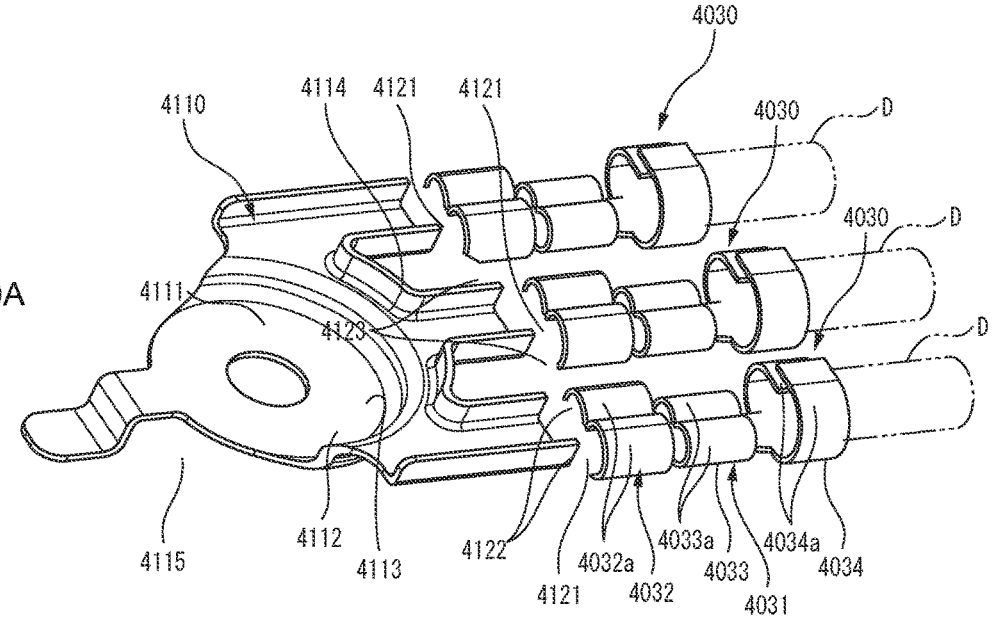
Figure 70B:
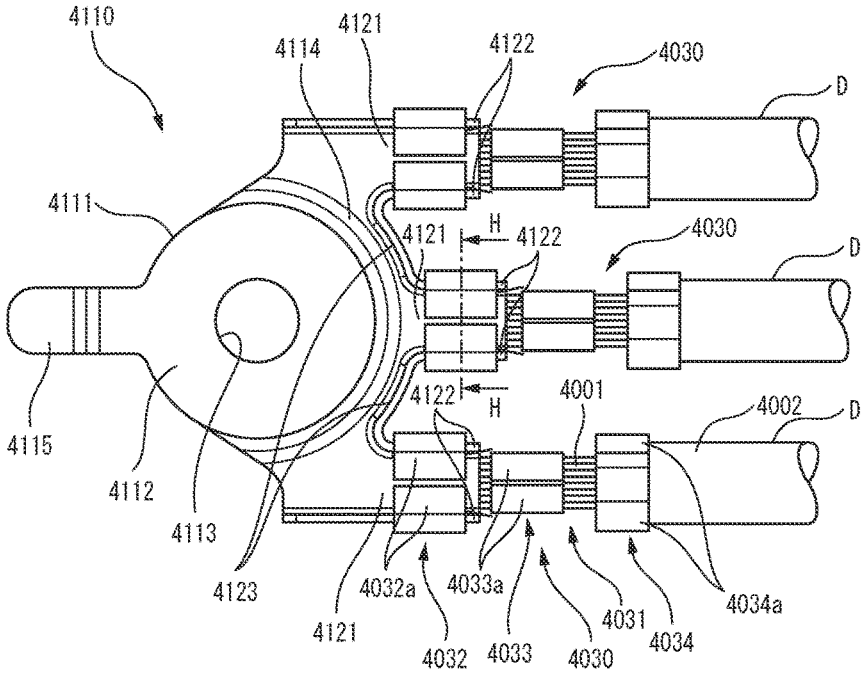
Figure 71A:
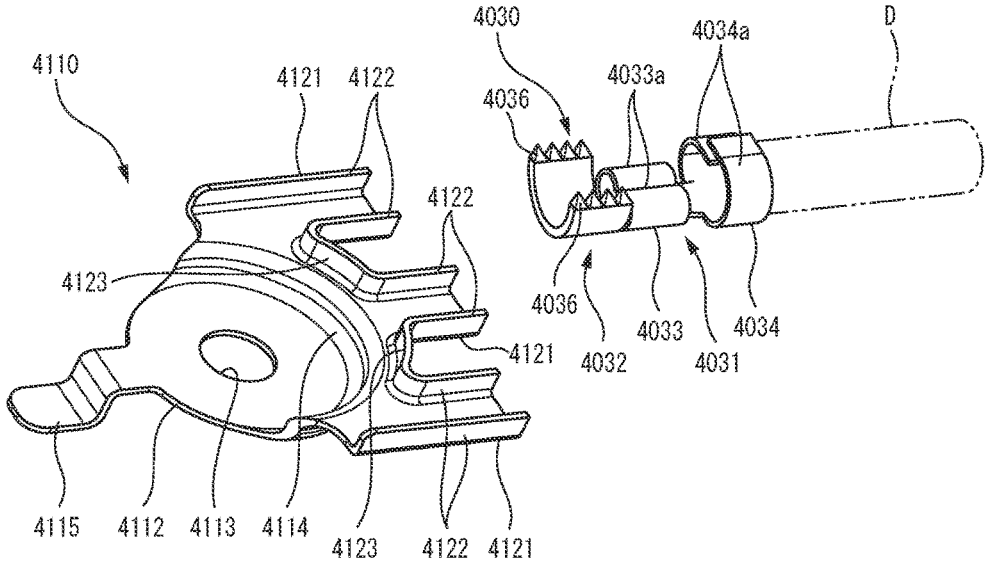
Figure 71B:
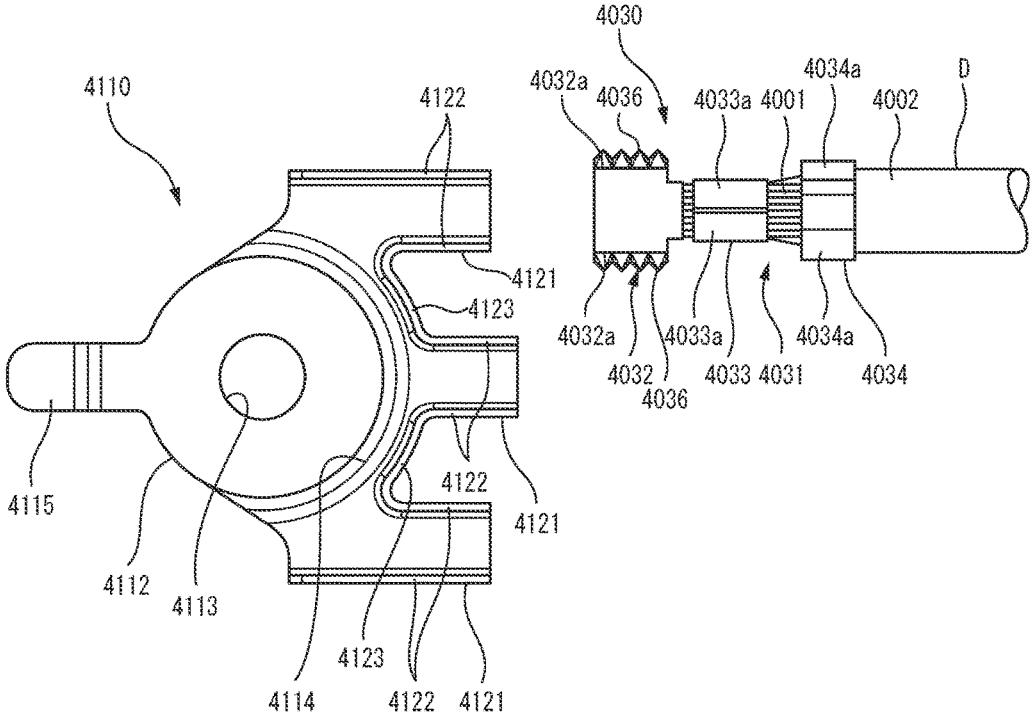

FIGS. 70A and 70B are diagrams explaining a connection structure for terminals according to Embodiment 4-2, in which FIG. 70A is a perspective view of a terminal fitting connected to a ground wire, and FIG. 70B is a plan view of the terminal fitting connected to the ground wire. FIGS. 71A and 71B are diagrams explaining the connection structure for terminals according to Embodiment 4-2, in which FIG. 71A is a perspective view of the terminal fitting and a connection terminal, and FIG. 71B is a plan view of the terminal fitting and the connection terminal.

As illustrated in FIGS. 70A, 70B, 71A and 71B, in the connection structure for terminals of the present embodiment, a terminal fitting 4110 is connected to connection terminals 4030. The terminal fitting 4110 is also electrically connected to a grounding surface such as a body of a vehicle. Thus, a ground wire D of an in-vehicle circuit is electrically connected to a grounding surface such as a body of a vehicle via the terminal fitting 4110. The connection terminal 4030 is connected to a ground wire D of a size of, for example, 8 sq.

Figure 72A:
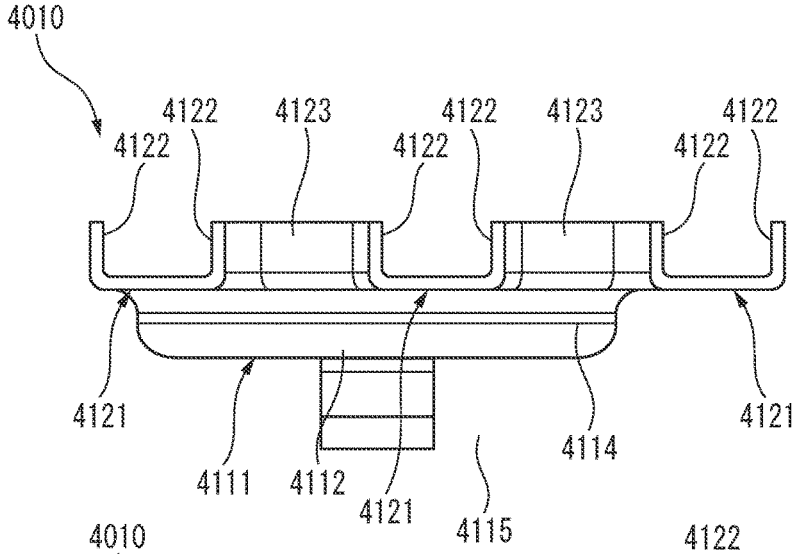
Figure 72B:
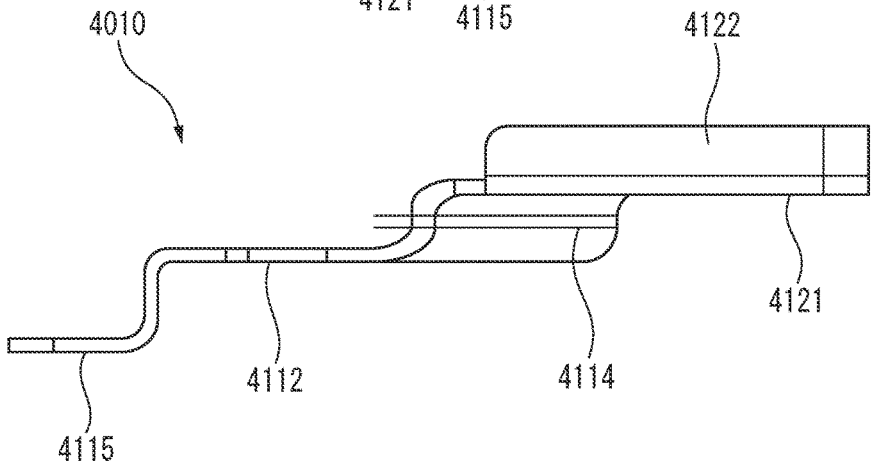
Figure 72C:
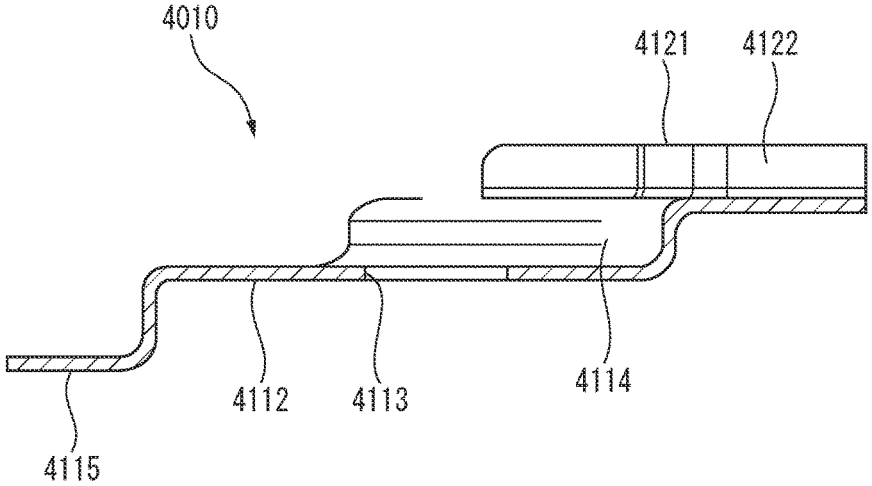
Figure 73A:
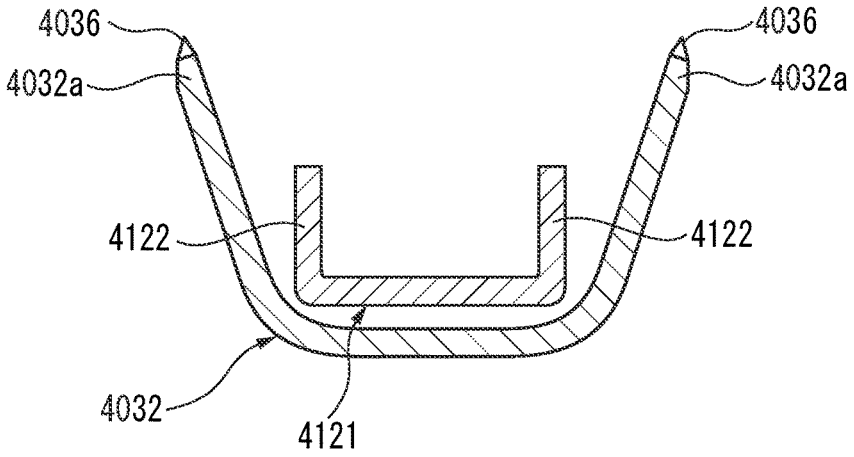
Figure 73B:
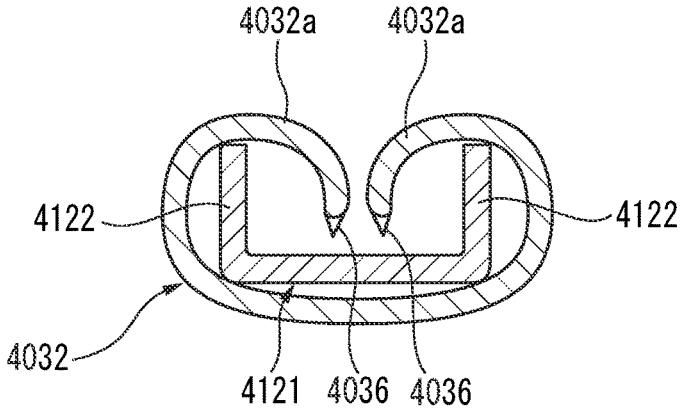
Figure 73C:
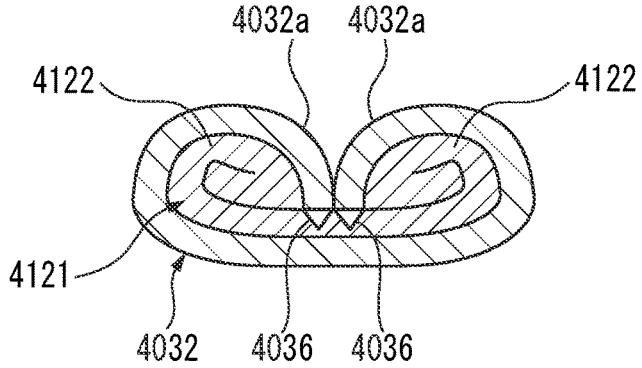

FIGS. 72A to 72C are diagrams explaining the terminal fitting, in which FIG. 72A is a front view thereof, FIG. 72B is a side view thereof, and FIG. 72C is a cross-sectional view thereof. FIGS. 73A to 73C are diagrams illustrating fastening states of crimping pieces of a fastening connecting portion to a terminal connecting portion of the terminal fitting, in which FIG. 73A is a cross-sectional view taken on line H-H of FIG. 70B before fastening with the crimping pieces, FIG. 73B is a cross-sectional view taken on line H-H of FIG. 70B during the fastening with the crimping pieces, and FIG. 70C is a cross-sectional view taken on line H-H of FIG. 70B after the fastening with the crimping pieces.

As illustrated in FIGS. 72A to 72C, the terminal fitting 4110 includes a terminal body 4111 and a terminal connecting portion (a terminal) 4121. The terminal fitting 4110 is a pressed product of a conductive metal plate. The terminal body 4111 has a fixing plate 4112 in a circular shape in a plan view. The fixing plate 4112 has a circular attaching hole 4113 formed at the center thereof. The terminal body 4111 is fixed to the grounding surface such as a body of a vehicle with a bolt (not illustrated) inserted through the attaching hole 4113 of the fixing plate 4112. It is noted that the attaching hole 4113 may be provided eccentrically instead of at the center of the fixing plate 4112.

In substantially a half of the periphery of the fixing plate 4112, a connecting plate 4114 is formed. The connecting plate 4114 projects toward one surface side, namely, the upper surface side. Thus, a step is formed between the fixing plate 4112 and the connecting plate 4114. Besides, in a portion of the fixing plate 4112 where the connecting plate 4114 is not provided, a rotation stopper piece 4115 is formed in a center position in the peripheral direction. The rotation stopper piece 4115 is a folded portion to be engaged with a step or a hole formed around the grounding surface to which the terminal body 4111 is fastened with the bolt, and the rotation of the terminal fitting 4110 on the grounding surface is restricted with this rotation stopper piece 4115 engaged with the step or the hole formed around the grounding surface.

The terminal connecting portions 4121 are formed integrally with the connecting plate 4114 of the terminal body 4111. The plural terminal connecting portions 4121 are provided in the terminal connecting portion 4114. Specifically, three terminal connecting portions 4121 are formed in the connecting plate 4114. These terminal connecting portions 4121 are extended to protrude, on the same plane, from the periphery of the fixing plate 4112 in the same direction, and are disposed at intervals in the width direction. It is noted that the center terminal connecting portion 4121 is protruded in the extending direction beyond the terminal connecting portions 4121 disposed on the both sides.

Each terminal connecting portion 4121 has, as both sides thereof, engagement walls (side walls) 4122 protruding toward one surface side, namely, the upper surface side. Thus, each terminal connecting portion 4121 is formed in a recessed shape in a front view. It is noted that the engagement walls 4122 of the terminal connecting portions 4121 adjacent to each other are formed continuously to a peripheral wall 4123 formed on the side of the fixing plate 4112.

For connecting the ground wire D to the terminal fitting 4110, the sheath 4002 is first removed at the end of the ground wire D to expose the conductor portion 4001. Then, with the end of the ground wire D disposed on the wire connecting portion 4031 of the connection terminal 4030 having been separated from the carrier 4035, the conductor crimping portion 4033 is crimped and the sheath crimping portion 4034 is crimped. Thus, the ground wire D is connected to the connection terminal 4030.

Subsequently, the fastening connecting portion 4032 of the connection terminal 4030 having been connected to the ground wire D is placed on the rear surface of the terminal connecting portion 4121 of the terminal fitting 4110, and the crimping pieces 4032*a* are crimped.

Here, if the crimping pieces 4032*a* are crimped, as illustrated in FIG. 73A, with the terminal connecting portion 4121 of the terminal fitting 4110 disposed within the U-shaped fastening connecting portion 4032 of the connection terminal 4030, the crimping pieces 4032*a* roll up the both sides of the terminal connecting portion 4121 of the terminal body 4111 at the beginning of the crimping as illustrated in FIG. 73B. Thereafter, as illustrated in FIG. 73C, the crimping pieces 4032*a* are crimped so as to externally roll up the engagement walls 4122 of the terminal connecting portion 4121, and thus, the engagement walls 4122 are curled up to be tightly held inside the crimping pieces 4032*a*, and thus, the terminal connecting portion 4121 is filled within the fastening connecting portion 4032. Accordingly, the fastening connecting portion 4032 is firmly fastened to the terminal connecting portion 4121 at high contact pressure, and the terminal fitting 4110 and the connection terminal 4030 are definitely electrically connected to each other.

As illustrated in FIG. 73C, when the fastening connecting portion 4032 of the connection terminal 4030 is crimped to the terminal connecting portion 4121 of the terminal fitting 4110, the upper edges of the crimping pieces 4032*a* of the fastening connecting portion 4032 are pressed against the terminal connecting portion 4121, and the biting teeth 4036 formed in the upper edge portions of the crimping pieces 4032*a* bite into the terminal connecting portion 4121. Thus, even if an impurity such as an oxide coating film is formed on the surface of the terminal connecting portion 4121 of the terminal fitting 4110, since the biting teeth 4036 of the crimping pieces 4032*a* bite into the terminal connecting portion 4121 at the time of the crimping, the biting teeth 4036 come into contact with a new surface of the terminal connecting portion 4121.

Thus, the connection terminal 4030 is firmly fastened at high contact pressure, and in addition, the biting teeth 4036 of the crimping pieces 4032*a* bite into the terminal connecting portion 4121, and as a result, the terminal connecting portion 4121 and the connection terminal 4030 are electrically connected to each other definitely and with high reliability.

In addition, the crimping pieces 4032*a* may be precedently bent into a curved shape as illustrated in FIG. 73B in a separate step before crimping the crimping pieces 4032*a*, and then the crimping pieces 4032*a* may be crimped with the terminal connecting portion 4121 disposed in the crimping pieces 4032*a* in this state.

The connection terminal 4030 is fastened to each of the terminal connecting portions 4121 of the terminal fitting 4110 as described above. Thus, a plurality of ground wires D are electrically connected all together to the terminal fitting 4110. Then, the terminal fitting 4110 is fixed to the grounding surface of the vehicle, and thus, the plural ground wires D are grounded.

As described so far, also according to the connection structure for terminals of Embodiment 4-2, when the crimping pieces 4032*a* of the connection terminal 4030 are crimped to be fastened to the terminal connecting portion 4121, the biting teeth 4036 bite into a pressure contacting part in the pressure contacting position. Thus, even if an impurity such as an oxide coating film is formed on the surface of the pressure contacting part, the biting teeth 4036 come into contact with a new surface of the pressure contacting part. Accordingly, the connection terminal 4030 can be electrically connected to the terminal connecting portion 4121 definitely and with high connection reliability without performing the connection by troublesome thermal welding or the like. Besides, even in connection between, for example, copper or copper alloy and aluminum, which are difficult to connect by the thermal welding, the electrical connection can be obtained definitely and with high connection reliability.

Besides, also in employing the connection structure for terminals according to Embodiment 4-2, when the connection terminal 4030 connected a ground wire D is crimped and fastened to each terminal connecting portion 4121 of the terminal fitting 4110, a plurality of ground wires D can be electrically connected all together to the terminal fitting 4110 definitely and with high connection reliability.

Furthermore, in the same manner as in Embodiment 4-1, when the crimping pieces 4032*a* of the connection terminals 4030 connected to the plural ground wires D are crimped to the plural terminal connecting portions 4121 of the terminal fitting 4110, the connection terminals 4030 are fastened to the terminal fitting 4110 and a plurality of ground wires D can be electrically connected all together to the terminal fitting 4110. Thus, as compared with a structure in which terminal fittings connected to respective ground wires are stacked and fastened for electrical connection, since there is no need to stack the terminal fittings 4110, increase in weight of the terminal fitting can be suppressed even when the number of ground wires is increased. Besides, since there is no need to stack the terminal fittings, even if the number of ground wires to be electrically connected is increased, the thickness is not increased, and hence the space can be saved. In addition, since the connection terminal 4030 is fastened to the terminal connecting portion 4121 of the terminal fitting 4110, there is no need to provide a special holding mechanism for holding the junction terminal 4030. Thus, as compared with a joint connector that needs to have a holding mechanism for holding a terminal in a housing, the size and the cost can be reduced.

Besides, the connection terminal 4030 separately provided is fastened and connected to the terminal fitting 4110 in this structure, and as a result, the connection terminals 4030 connected to ground wires D of different sizes can be fastened to be electrically connected to the terminal connecting portions 4121. In other words, this structure is applicable to ground wires D of various sizes without changing the connection form between the terminal connecting portion 4121 of the terminal fitting 4110 and the fastening connecting portion 4032 of the connection terminal 4030. Besides, if terminal fittings 4110 having different numbers of terminal connecting portions 4121 are prepared, the structure can easily deal with the increase/decrease of the number of ground wires D to be electrically connected.

In other words, also in employing the connection structure for terminals according to Embodiment 4-2, the change in the number or the size of ground wires D to be electrically connected can be dealt with by minimum variations of the terminal fitting 4110.

In addition, since the connection terminals 4030 are fastened to the plural terminal connecting portions 4121 of the terminal fitting 4110 in this structure, the connection terminals 4030 can be fastened to the terminal connecting portions 4121 as needed, and as a result, the number of ground wires D to be electrically connected all together can be easily increased/decreased within the limit of the number of the terminal connecting portions 4121.

Besides, the engagement walls 4122 to be engaged with the crimping pieces 4032*a* are formed as the both sides of the terminal connecting portion 4121. Accordingly, when the crimping pieces 4032*a* of the connection terminal 4030 are crimped to the terminal connecting portion 4121, the crimping pieces 4032*a* are engaged with the engagement walls 4122 of the terminal connecting portion 4121. Thus, the crimping pieces 4032*a* are definitely crimped to the terminal connecting portion 4121, so as to further increase the connection strength of the terminal connecting portion 4121 to the connection terminal 4030, and the electrical resistance in the connection portion can be stabilized to attain good electrical connection.

In addition, the terminal connecting portions 4121 are extended on the same plane in the same direction at intervals. Accordingly, a direction for connecting the connection terminal 4030 to the terminal fitting 4110 and a wiring direction of the ground wire D can be the same, and hence, the workability in fastening the connection terminal 4030 to the terminal connecting portion 4121 of the terminal fitting 4110 can be improved. Besides, the wiring directions of the ground wires D can be aligned in the same direction along a trunk line, and in addition, unwanted spread of the ground wires D and bending of the ground wire D in the vicinity of the connection terminal 4030 can be minimized.

Furthermore, also in the terminal connecting portion 4121 of the terminal fitting 4010 of Embodiment 4-2, an engaging piece may be formed at the upper end of each engagement wall 4122 as in Embodiment 4-1, and the cross-sectional shape of the engagement walls may be in the shape of V.

Although the terminal fitting 4010 has three terminal connecting portions 4121 in the above-described exemplified case, the number of the terminal connecting portions 4121 of the terminal fitting 4110 is not limited to three as long as it is plural.

Modification of Embodiment 4-2

Next, as a modification of Embodiment 4-2, a connection structure for terminals including a different number of terminal connecting portions 4121 will be described. It is noted that like reference signs are used to refer to like elements used in the above-described embodiment to omit the description.

Figure 74A:
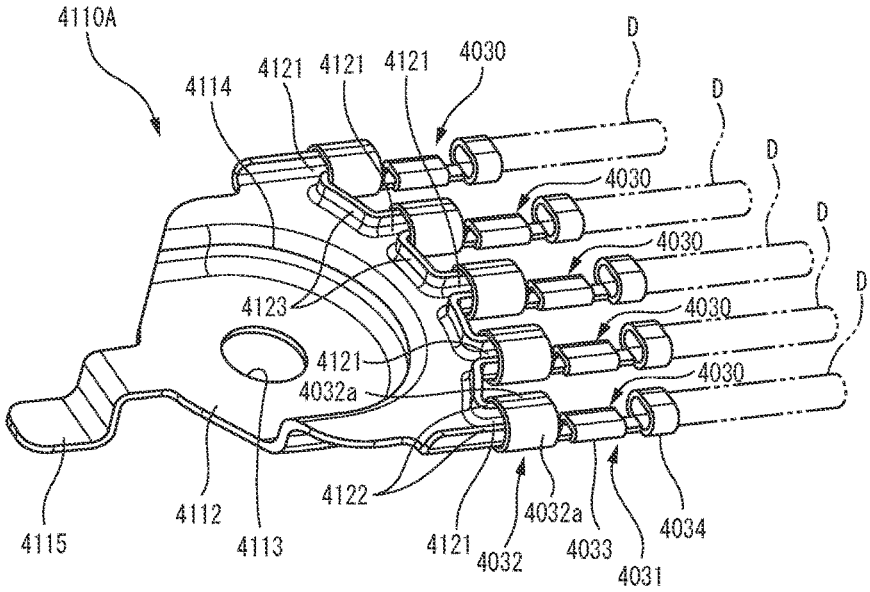
Figure 74B:
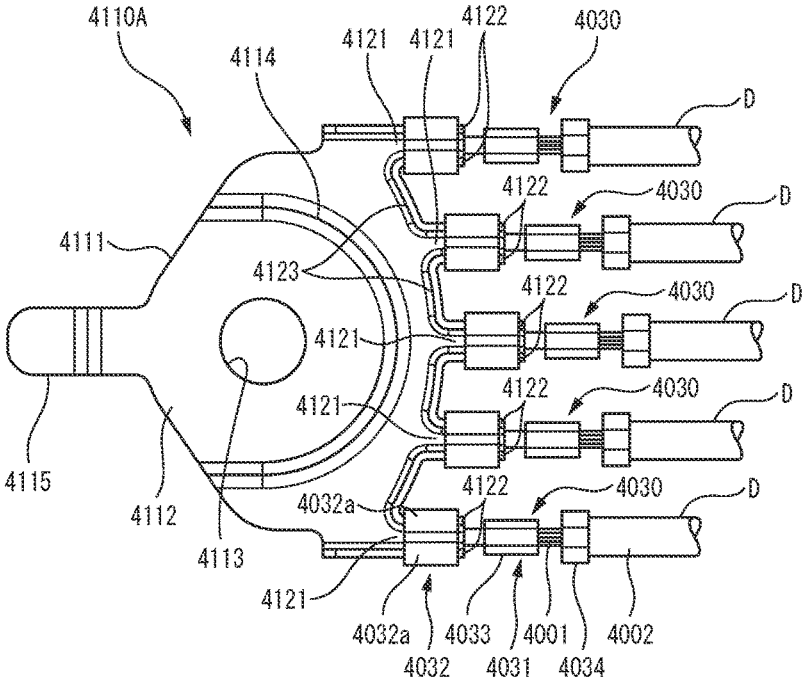
Figure 75A:
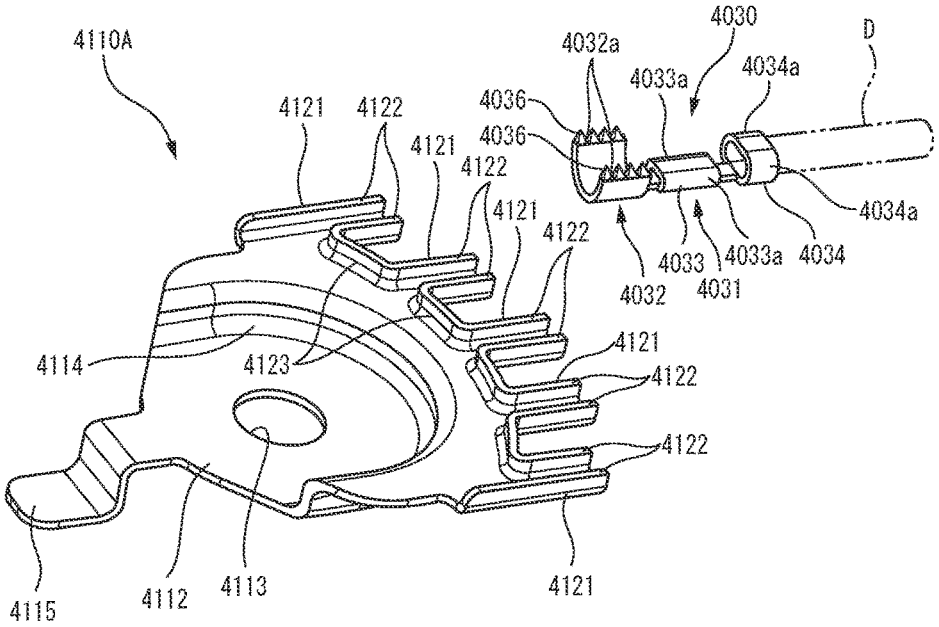
Figure 75B:
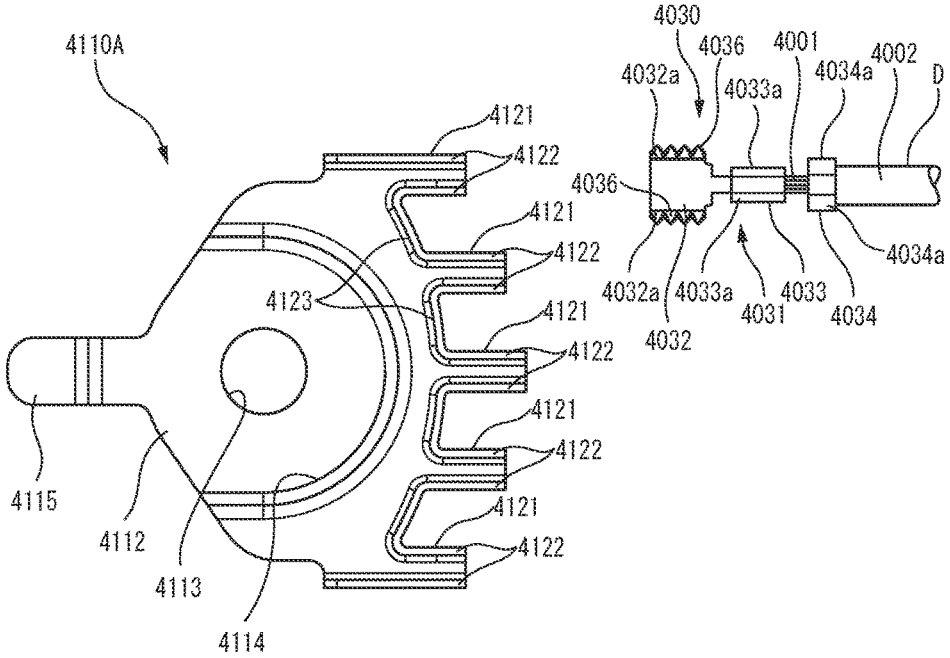

FIGS. 74A and 74B are diagrams explaining a connection structure for terminals according to a modification of Embodiment 4-2, in which FIG. 74A is a perspective view of a terminal fitting connected to a ground wire, and FIG. 74B is a plan view of the terminal fitting connected to the ground wire. FIGS. 75A and 75B are diagrams explaining the connection structure for terminals according to the modification of Embodiment 4-2, in which FIG. 75A is a perspective view of the terminal fitting and a connection terminal, and FIG. 75B is a plan view of the terminal fitting and the connection terminal.

As illustrated in FIGS. 74A, 74B, 75A and 75B, this terminal fitting 4110A has five terminal connecting portions 4121. These terminal connecting portions 2121 are also extended in the same direction and are disposed at intervals in the width direction. Then, a connection terminal 4030 is also fastened to each of the terminal connecting portions 4121 of this terminal fitting 4110A for connection to a ground wire D. The connection terminal 4030 is connected to a ground wire D of a size smaller than 8 sq., for example, a size of 0.5 sq.

In this manner, when the terminal fitting 4110A having five terminal connecting portions 4121 is used, a larger number of ground wires D of a smaller size can be electrically connected all together to be grounded.

In addition, in Embodiments 4-1 and 4-2 described above, the ground wires D of the in-vehicle circuit (the auxiliary device) are connected to the terminal fitting 4010, 4110 or 4110A to be grounded all together, but a wire to be connected to the terminal fitting 4010, 4110 or 4110A is not limited to a wire for grounding.

Besides, instead of providing the rotation stopper piece 4015 or 4115 to the terminal body 4111 of the terminal fitting 4010, 4110 or 4110A, a step or a rotation stopper piece to be brought into contact with and stop rotation of the terminal fitting 4010, 4110 or 4110A when the terminal fitting 4010, 4110 or 4110A is attached onto the grounding surface may be provided on the side of the grounding surface.

It is noted that the present invention is not limited to the embodiments described above but can be appropriately changed and modified. In addition, the materials, the shapes, the dimensions, the numbers, the positions and the like of the respective components described in the aforementioned embodiments are not restrictive but optional.

Here, the features of the embodiments (mainly, Embodiment 1-1, Embodiment 2-1 and Embodiment 2-2) of the present invention will be simply summarized as the following (1) to (11):

(1) A connection structure for a terminal fitting, the connection structure comprising:

a terminal fitting including: a terminal body (1011) to be fastened and fixed to a grounding surface; and a plurality of terminal connecting portions (1021) extended from the terminal body; and a junction terminal (1030) electrically connected to a ground wire (D) and electrically connected to the terminal connecting portion, the junction terminal having a pair of crimping pieces (1032*a*), the pair of crimping pieces (1032*a*) being crimped on the terminal connecting portion (1021) in such a manner to externally roll up both sides of the terminal connecting portion (1021) without crimping the ground wire (D), and thus fastening the junction terminal (1030) to the terminal fitting (1010) to connect the terminal fitting (1010) to the ground wire (D) via the junction terminal (1030).

(2) The connection structure for a terminal fitting according to item (1), wherein a plurality of ground wires are electrically connected to the junction terminal (1030).

(3) The connection structure for a terminal fitting according to item (1), wherein the terminal connecting portion has engagement walls (1022) extended from both sides of the terminal connecting portion (1021) to rise on a plane on which the terminal connecting portion is extended from the terminal body (1011), and the crimping piece (1032*a*) is crimped to engage with the engagement walls.

(4) The connection structure for a terminal fitting according to item (3), wherein the engagement wall (1022) has an engaging piece formed (1022*a*) by folding an upper end of the engagement wall inward.

(5) The connection structure for a terminal fitting according to item (1), wherein the junction terminal (2030) defines a holding space (S) surrounded by the crimping pieces (2032*a*), and side surfaces (2021) of the crimping pieces facing the holding space (S) serve as rotation restricting surfaces (2036) to restrict rotation of the terminal connecting portion around an axis along an inserting direction into the holding space by contacting with both sides of the terminal connecting portion inserted into the holding space.

(6) The connection structure for a terminal fitting according to item (5), wherein a bottom (2037) of the holding space (S) is curved to be swollen downward.

(7) The connection structure for a terminal fitting according to item (1), wherein the terminal connecting portions (1021, 2021) are extended radially on a same plane.

(8) The connection structure for a terminal fitting according to item (1), wherein the terminal connecting portions (1021, 2021) are extended on a same plane in a same direction to have a space between each other.

(9) A connection method for a terminal fitting, the method being to connect the terminal fitting (2020) including a terminal body (2011) and a plurality of terminal connecting portions (2021) extended from the terminal body with a junction terminal (2030) connected to a ground wire (D) by crimping a pair of crimping pieces (2032*a*) formed in the junction terminal to the terminal connecting portion, the method comprising:

a first step of forming a holding space (S) in the junction terminal (2030) by using the crimping pieces to allow the terminal connecting portion to be inserted into the holding space;

a second step of holding the terminal connecting portion (2021) with the junction terminal (2030) by inserting the terminal connecting portion (2021) into the holding spaces; and a third step of crimping the crimping piece (2032*a*) in such a manner to externally roll up both sides of the terminal connecting portion (2021) located in the holding space.

(10) The connection method for a terminal fitting according to item (9), wherein the ground wire (D) is electrically connected to the junction terminal (2030) before the second step.

(11) A wire harness comprising the connection structure for a terminal fitting (1010, 2010) according to item (1).

Besides, other features of the embodiments (mainly, Embodiments 3-1 to 3-5) of the present invention described above are summarized as the following [1] to [12]:

[1] A terminal fitting including a terminal body (3211), a wire connecting body (3219) connected to a plurality of wires (ground wires D), and a plurality of linking portions (3220A, 3220B) linking the terminal body and the wire connecting body in a plurality of positions, in which at least one of the linking portions has a linking strength adjusting function capable of adjusting linking strength between the terminal body and the wire connecting body.

[2] The terminal fitting according to [1], in which the terminal body or the wire connecting body has a catching piece (3217) folded in an edge portion of the wire connecting body or the terminal body to catch the edge portion of the wire connecting body or the terminal body, and a linking portion where the terminal body and the wire connecting body are linked to each other with catching force attained by the catching piece corresponds to the linking portion having the linking strength adjusting function.

[3] The terminal fitting according to [2], in which a window portion (3218) into which the catching piece is insertable is formed in the edge portion of the wire connecting body or the terminal body caught by the catching piece.

[4] The terminal fitting according to [1], in which the terminal body and the wire connecting body have crimping pieces (3224, 3225) to be stacked on each other, and a linking portion where the terminal body and the wire connecting body are linked to each other by fastening the crimping pieces through burring crimping corresponds to the linking portion having the linking strength adjusting function.

[5] The terminal fitting according to [1], in which a plurality of plate portions integrally linking the terminal body and the wire connecting body to each other are formed between the terminal body and the wire connecting body, each of the plate portions is provided with a notch (3226) formed as a groove extending in a direction crossing a linking direction of the terminal body and the wire connecting body, so as to work as the linking portion having the linking strength adjusting function.

[6] A connection structure for a terminal fitting, in which the plurality of wires are crimped and electrically connected to the wire connecting body of the terminal fitting according to any one of [1] to [5] described above.

[7] A connection structure for a terminal fitting, in which a plurality of connection terminals (3030) electrically connected to the wires are fastened and connected to the wire connecting body of the terminal fitting according to any of [1] to [5] described above.

[8] The connection structure for a terminal fitting according to [7], in which a plurality of terminal connecting portions (3021) to be fastened and connected to the connection terminals are extended from the wire connecting body, a pair of crimping pieces (3032*a*) are formed in each of the connection terminals, and the terminal fitting is connected to the wires via the connection terminals when the connection terminals are fastened to the wire connecting body by crimping the pair of crimping pieces to externally roll up both sides of each of the terminal connecting portions.

[9] The connection structure for a terminal fitting according to [8], in which engagement walls (3022) provided to rise from a plane, on which the terminal connecting portions extend from the wire connecting body, are formed as both sides of each of the terminal connecting portions, and the crimping pieces having been crimped are engaged with the engagement walls.

[10] The connection structure for a terminal fitting according to [9], in which each of the engagement walls has an engaging piece (3022*a*) formed by folding an upper end of the engagement wall inward.

[11] The connection structure for a terminal fitting according to any one of [8] to [10], in which the terminal connecting portions (3021) are extended radially on the same plane.

[12] The connection structure for a terminal fitting according to any one of [8] to [10], in which the terminal connecting portions (3121) are extended on the same plane in the same direction at intervals.

Furthermore, still other features of the embodiments (mainly, Embodiment 4-1 and Embodiment 4-2) of the present invention described above are simply summarized as the following <1> to <10>:

<1> A connection structure for a pair of terminals (a terminal connecting portion 4021, a connection terminal 4030) made of conductive metal materials, a first one of the terminals (the connection terminal 4030) has a pair of crimping pieces (4032*a*) capable of crimping to externally roll up side walls (engagement walls 4022) corresponding to both sides of a second one of the terminals (the terminal connecting portion 4021), and in at least one of the first terminal and the second terminal, biting teeth (4036) biting into a pressure contacting part in a pressure contacting position where the terminals are pressed against each other in crimping the crimping pieces.

<2> The connection structure for terminals according to <1>, in which the biting teeth include a plurality of V-shaped projections (4037).

<3> The connection structure for terminals according to <1>, in which the biting teeth include a plurality of rectangular projections (4038).

<4> The connection structure for terminals according to <1>, in which the biting teeth include a plurality of grooves (4039) arranged in a line.

<5> The connection structure for terminals according to any one of <1> to <4>, including a plurality of wires (ground wires D) connected to the first one of the terminals, and a terminal fitting (3010) formed integrally with a plurality of the second one of the terminals, in which the plurality of wires are connected to the terminal fitting by fastening the first one of the terminals to the second one of the terminals.

<6> The connection structure for terminals according to any one of <1> to <4>, including connection terminals (4030) connected to wires (ground wires D) corresponding to the first one of the terminals; and a terminal fitting (4010) corresponding to the second one of the terminals and including a terminal body (4011) and a plurality of terminal connecting portions (4021) extended from the terminal body, in which the pair of crimping pieces (4032*a*) are formed in each of the connection terminals, and the terminal fitting is connected to the wires via the connection terminals when the pair of crimping pieces are crimped to externally roll up both sides of each of the terminal connecting portions to fasten the connection terminals to the terminal fitting.

<7> The connection structure for terminals according to <6>, in which engaging walls (4022) provided to rise on a plane, on which the terminal connecting portions extend from the wire connecting body, are formed as both sides of each of the terminal connecting portions, and the crimping pieces having been crimped are engaged with the engagement walls.

<8> The connection structure for terminals according to <7>, in which each of the engagement walls has an engaging piece (4022*a*) formed by folding an upper end of the engagement wall inward.

<9> The connection structure for terminals according to any one of <6> to <8>, in which the terminal connecting portions (4021) are extended radially on the same plane.

<10> The connection structure for terminals according to any one of <6> to <8>, in which the terminal connecting portions (4121) are extended on the same plane in the same direction at intervals.

REFERENCE SIGNS LIST

1010 terminal fitting
1011 terminal body
1021 terminal connecting portion
1030 junction terminal
2010, 2010A, 2110, 2110A terminal fitting
2011, 2111 terminal body
2021, 2121 terminal connecting portion
2022, 2122 engagement wall
2022*a* engaging piece
2030 junction terminal
2032 fastening connecting portion
2032*a* crimping piece
2036 rotation restricting surface
2037 bottom
D ground wire
S holding space

The invention claimed is:

1. A connection structure for a terminal fitting, the connection structure comprising:

a terminal fitting including: a terminal body to be fastened and fixed to a grounding surface; and a plurality of terminal connecting portions extended from the terminal body; and a junction terminal electrically connected to a ground wire and electrically connected to the terminal connecting portion, the junction terminal having a pair of crimping pieces, the pair of crimping pieces being crimped on the terminal connecting portion in such a manner to externally roll up both sides of the terminal connecting portion without crimping the ground wire, and thus fastening the junction terminal to the terminal fitting to connect the terminal fitting to the ground wire via the junction terminal.

2. The connection structure for a terminal fitting according to claim 1, wherein a plurality of ground wires are electrically connected to the junction terminal.

3. The connection structure for a terminal fitting according to claim 1, wherein the terminal connecting portion has engagement walls extended from both sides of the terminal connecting portion to rise on a plane on which the terminal connecting portion is extended from the terminal body, and the crimping piece is crimped to engage with the engagement walls.

4. The connection structure for a terminal fitting according to claim 3, wherein the engagement wall has an engaging piece formed by folding an upper end of the engagement wall inward.

5. The connection structure for a terminal fitting according to claim 1, wherein the junction terminal defines a holding space surrounded by the crimping pieces, and side surfaces of the crimping pieces facing the holding space serve as rotation restricting surfaces to restrict rotation of the terminal connecting portion around an axis along an inserting direction into the holding space by contacting with both sides of the terminal connecting portion inserted into the holding space.

6. The connection structure for a terminal fitting according to claim 5, wherein a bottom of the holding space is curved to be swollen downward.

7. The connection structure for a terminal fitting according to claim 1, wherein the terminal connecting portions are extended radially on a same plane.

8. The connection structure for a terminal fitting according to claim 1, wherein the terminal connecting portions are extended on a same plane in a same direction to have a space between each other.

9. A wire harness comprising the connection structure for a terminal fitting according to any one of claim 1.

10. A connection method for a terminal fitting, the method being to connect the terminal fitting including a terminal body and a plurality of terminal connecting portions extended from the terminal body with a junction terminal connected to a ground wire by crimping a pair of crimping pieces formed in the junction terminal to the terminal connecting portion, the method comprising:

a first step of forming a holding space in the junction terminal by using the crimping pieces to allow the terminal connecting portion to be inserted into the holding space;

a second step of holding the terminal connecting portion with the junction terminal by inserting the terminal connecting portion into the holding spaces; and a third step of crimping the crimping piece in such a manner to externally roll up both sides of the terminal connecting portion located in the holding space without including the ground wire in the holding space.

11. The connection method for a terminal fitting according to claim 10, wherein the ground wire is electrically connected to the junction terminal before the second step.

* * * * *